United States Patent [19]

Keen et al.

[11] 4,107,838

[45] Aug. 22, 1978

[54] ARRANGING RANDOMLY POSITIONED ARTICLES INTO PRESELECTED POSITIONS

[75] Inventors: Ralph H. Keen; Raymond D. Kimsey, both of Arvada; Gary G. Seaman, Broomfield, all of Colo.

[73] Assignee: Western Electric Company, Incorporated, New York, N.Y.

[21] Appl. No.: 647,248

[22] Filed: Jan. 7, 1976

[51] Int. Cl.[2] ..... H01R 43/04

[52] U.S. Cl. ..... 29/628; 29/564.1; 29/564.6; 29/703; 29/704; 29/705; 29/753; 29/755

[58] Field of Search ..... 29/628, 568, 564.1, 29/564.6, 702, 703, 704, 706, 714, 115, 716, 717, 753, 754, 755, 748, 749, 711, 712; 179/175.3 A; 324/66

[56] References Cited

U.S. PATENT DOCUMENTS

| | | | |
|---|---|---|---|
| 3,377,901 | 4/1968 | Gurski et al. | 83/368 |
| 3,650,018 | 3/1972 | Perry et al. | 29/568 |
| 3,902,026 | 8/1975 | Rogers et al. | 179/175.3 A |
| 3,936,933 | 2/1976 | Folk et al. | 29/628 |
| 3,968,555 | 7/1976 | Holt | 29/715 |

*Primary Examiner*—Othell M. Simpson

*Attorney, Agent, or Firm*—K. R. Bergum; R. P. Miller

[57] ABSTRACT

Trailing wire ends of a cable supply on a pay-off reel initially are connected to respective matrix points of a controller in a preselected numerical order. The cable then is fed from the reel, and a leading end portion is desheathed, using heat. The desheathed portions of the cable wires then are pressed or "ironed" from a twisted-pair bundle configuration into an individual-wire common plane configuration. As the desheathed portions of the wires next are fanned out of the common plane configuration in random order, they are sorted into two groups, depending on the side of a connector plug on which they are to be located, in response to signals from the controller, which also identifies each wire and stores information as to its random numerical position in its respective group. The cable then is cut to length adjacent the supply reel and a new sequence of operations is initiated. At thwe same time, a collating device, in response to signals from the controller, rearranges the wires into their proper wiring positions, after which the wires are secured to the connector plug. A second connector plug can be attached on the opposite end of a cable in the same manner, except that the first attached plug is plugged directly into the controller for the identification step. The production output of the system can be essentially doubled by feeding two different cables from separate supplies on alternate cycles of operation, and processing both cables simultaneously.

45 Claims, 38 Drawing Figures

147
146
38
144
122
111
121
112
143
142
126
127
113
119
126c
127c
117
116
114
141
123
154
139
107
157
158
109
128
131
159
137
129
138
12
12
134
31LE
108
108
106
163
32
37

129d
141
129n
129n
148
31LE
153
136
149
151
152

284G
286G
279G
274
256
43
299
298
282G,283G
262
264
268
273
267,
271
276
266
263
277
281G
269
272
258
20
261
258
259
254G
253G
33
33TG
260G
287G
261
292G
289G
20A
20
257G,257S
33
31LE
55°
32JE
20A
32L

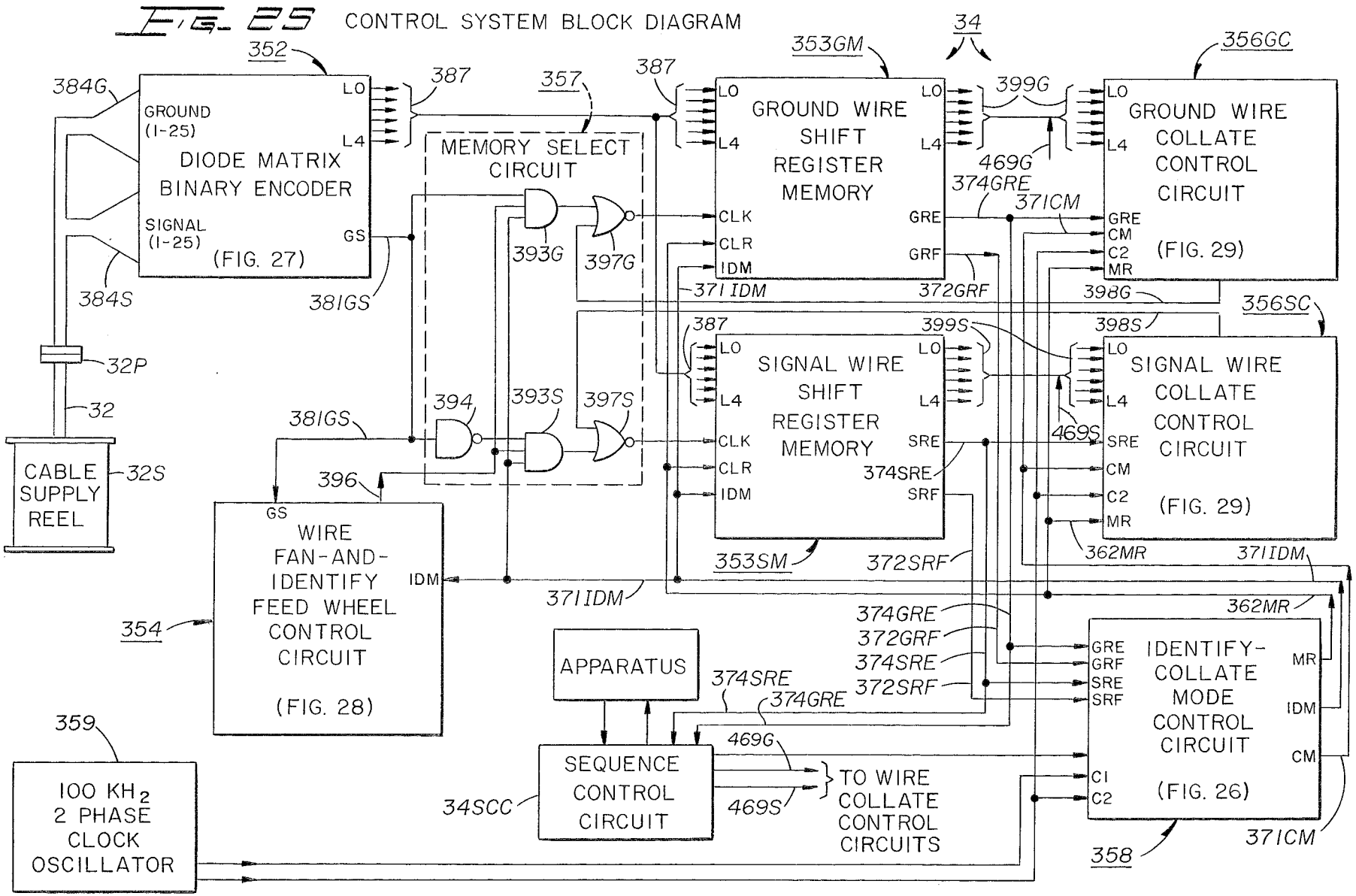
FIG. 25 CONTROL SYSTEM BLOCK DIAGRAM

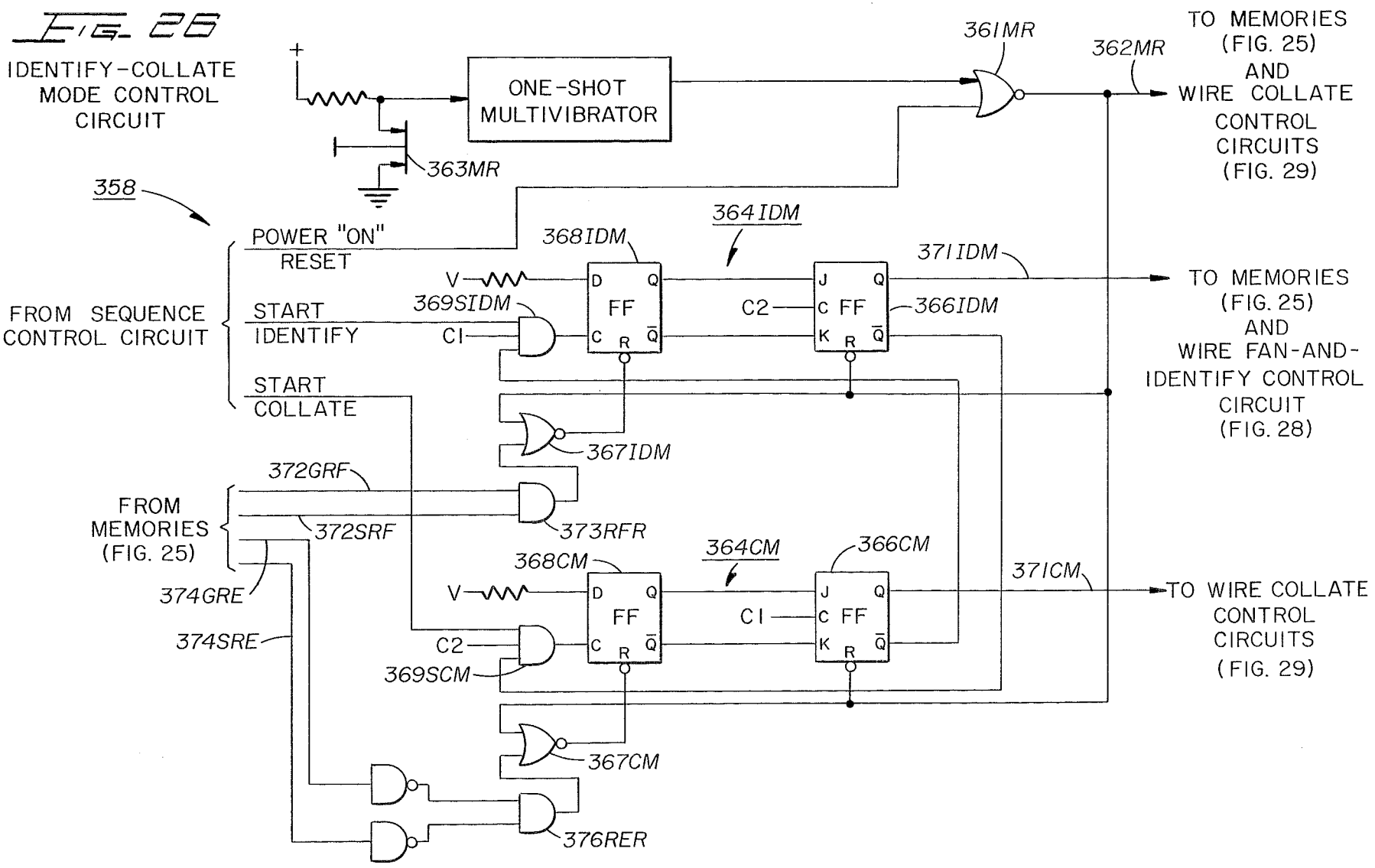
TO MEMORIES (FIG. 25) AND WIRE COLLATE CONTROL CIRCUITS (FIG. 29)
TO MEMORIES (FIG. 25) AND WIRE FAN-AND-IDENTIFY CONTROL CIRCUIT (FIG. 28)
TO WIRE COLLATE CONTROL CIRCUITS (FIG. 29)
362MR
361MR
371IDM
366IDM
371CM
366CM
364IDM
364CM
C2
C1
368IDM
367IDM
373RFR
368CM
367CM
376RER
369IDM
369SCM
ONE-SHOT MULTIVIBRATOR
363MR
POWER "ON" RESET
START IDENTIFY
START COLLATE
372GRF
372SRF
374GRE
374SRE
FROM SEQUENCE CONTROL CIRCUIT
FROM MEMORIES (FIG. 25)
358
FIG. 28
IDENTIFY-COLLATE MODE CONTROL CIRCUIT

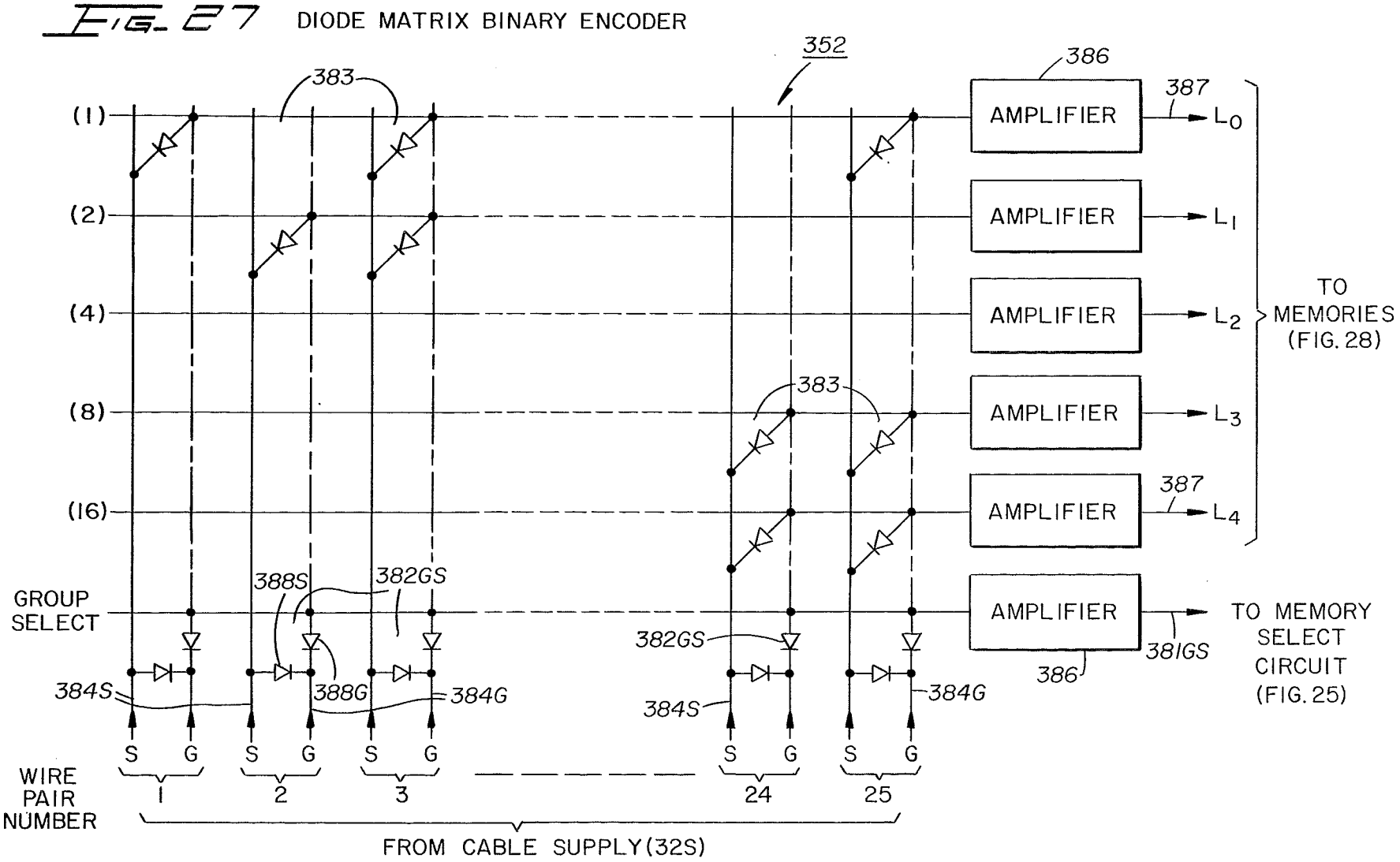
FIG. 27 DIODE MATRIX BINARY ENCODER

WIRE FAN-AND-IDENTIFY FEED WHEEL CONTROL CIRCUIT

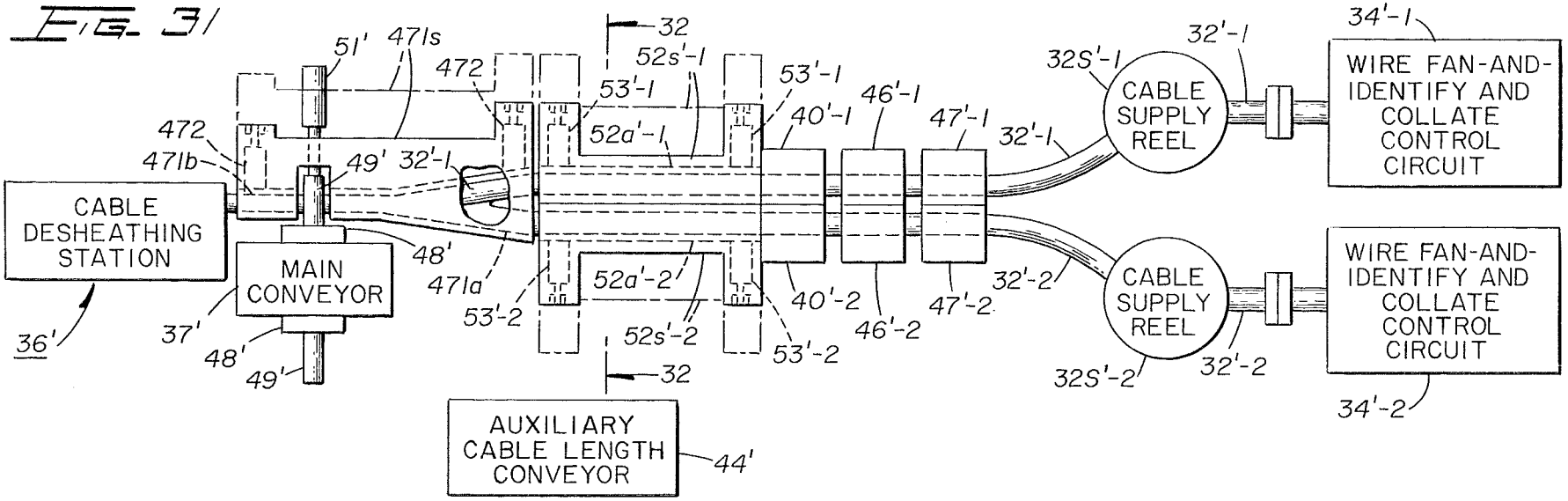
FIG. 31
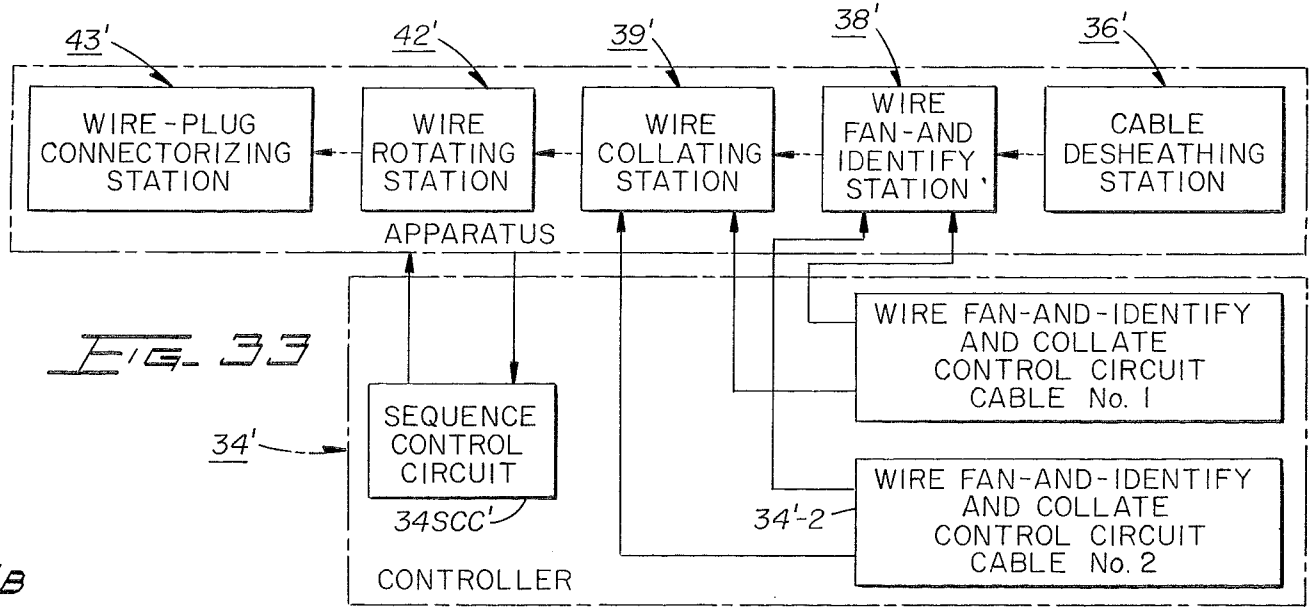
FIG. 33
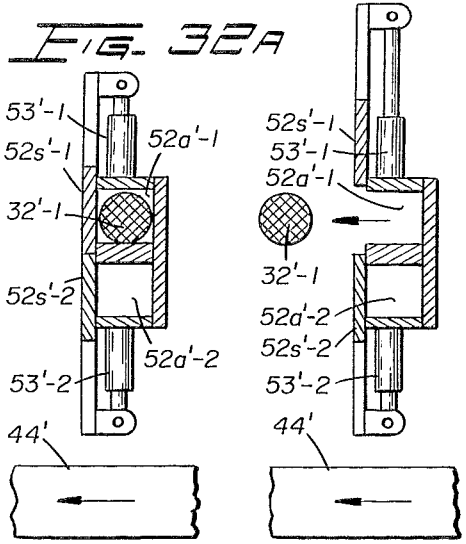
FIG. 32B
FIG. 32A

ARRANGING RANDOMLY POSITIONED ARTICLES INTO PRESELECTED POSITIONS

BACKGROUND OF THE INVENTION

1. Field of the Invention

This invention relates to a system for arranging randomly positioned articles into preselected positions, and more particularly to a system for arranging a twisted-pair bundle of randomly positioned wires (e.g., a cable) into preselected wiring positions and connecting the wires to respective electrical contacts of an electrical device.

2. Description of the Prior Art

In the manufacture of electrical wired equipment, it frequently is necessary to connect a plurality of wires which are in random unknown positions, to preselected terminals on an electrical device. This requires that an operator manually sort the randomly positioned wires and arrange them into their proper wiring positions, a procedure which is relatively time consuming, laborious and frequently subject to human error, particularly where a large number of wires are involved.

By way of illustration, in the manufacture of PBX cable and other similar type cable formed of twisted wire pairs, it is standard practice to attach a connector plug of the type having rows of terminals on its opposite sides, to one or both ends of a sheathed cable having an irregular periphery. As an initial step in this operation, the cable generally is manually cut into preselected lengths from a continuous supply. Sheath or jacket portions then are removed from the opposite ends of each cable length with a manual cutting tool, a step which may cause damage to the insulated wires of the cable as a result of the cutting tool nicking or cutting completely through the wire insulation. An operator then sorts the color coded desheathed wire portions at one end of the cable length as to their positions on the connector plug, untwists the wire pairs and places the wire portions for the one side of the plug in their proper respective positions in a soldering apparatus, which may be a manual type fixture, or semi-automatic apparatus as disclosed in the U.S. Pat. No. 3,110,083, issued Nov. 12, 1963 to R. M. Stine et al., or the U.S. Pat. No. 3,230,608, issued January 25, 1966 to G. P. Adams et al. In the alternative, the wires may be positioned in an apparatus for assembling the wires into a solderless-type connector plug, as disclosed in the U.S. Pat. No. 3,864,802, issued Feb. 11, 1975 to J. J. Tucci.

In the soldering apparatus, the wire portions are cut to length (if necessary), insulation adjacent the ends of the wire portions is stripped therefrom, and the stripped wire end portions are positioned in their respective terminals in the connector plug and soldered to the terminals. To connect the other desheathed wire portions to the opposite side of the plug, the cable and the connector plug are inverted, the wire portions are placed in their proper respective positions in the soldering apparatus, and the same procedure is repeated for these wires. Where a cable connector plug is to be connected to the opposite end of the cable, the same procedure, including the manual sorting, is followed with the wires at that end of the cable. The same procedures, except for the insulation stripping and soldering steps, is required with the use of solderless-type connector plugs mentioned in the preceding paragraph.

Apparatus for automatically fanning randomly positioned wires into a spaced, but still random relationship, is disclosed in the U.S. Pat. No. 2,382,922, issued Aug. 14, 1945 to G. C. Spillman and the U.S. Pat. No. 3,377,901, issued Apr. 16, 1968 to E. P. Gurski et al. Prior known wire identification systems include the U.S. Pat. No. 3,410,405, issued Nov. 12, 1968 to F. T. Cyrsky, Jr. et al., which discloses apparatus for identifying colored wires electrooptically. Identifying the leading ends of wires manually, by completing electrical circuits through the wires to respective electrical reference points also is known, as is exemplified by the U.S. Pat. No. 3,772,685, issued Nov. 13, 1973 to J. V. Masi, the U.S. Pat. No. 3,476,888, issued Nov. 4, 1969 to A. W. Rollins et al., and the U.S. Pat. No. 3,902,026, issued Aug. 26, 1975 to S. Rogers et al.

BRIEF SUMMARY OF THE INVENTION

In general, this invention relates to a system for arranging portions of electrical conductor wires which are in random positions, into preselected positions on a wire-receiving member, wherein electrical circuits are sequentially completed through the wires to an electrical reference to identify each of the randomly positioned wire portions. Arranging the thus identified randomly positioned wire portions into their preselected positions may be accomplished by locating each wire portion in a reference position, causing relative movement between the wire-receiving member and the wire portion to locate the preselected position for the wire portion on the wire-receiving member adjacent the reference position, and then feeding the wire portion into its preselected position on the wire-receiving member.

More specifically, the above-mentioned electrical conductor wires may be twisted pairs in the form of a bundle, such as a continuous supply of sheathed cable wherein the wires are to be wired in respective subgroups, such as to opposite sides of a connector plug in preselected numerical positions. Initially, the trailing ends of the wires for each subgroup are connected to electrical reference points in a preselected numerical order corresponding to a preselected numerical order of the wiring positions in that subgroup. A leading end portion of the cable then is fed ad desheathed, using heat, and the desheathed portions of the cable wires are pressed or "ironed" from their twisted-pair bundle configuration into an individual-wire common plane configuration by exerting pressure forces to opposite successive wire portions and repetitively moving the pressure forces longitudinally of the wires toward their free ends. Next, as the wire leading end portions are fanned out of the common plane configuration, they are electrically contacted in sequence to sequentially close respective normally open circuits through the wires to the electrical reference points, to identify each wire leading end portion and to store data information representative of each wire portion and the sequence in which it was contacted. At the same time, the leading end portions of the wires are arranged into their proper positions in their respective subgroups. The sheathed wires then are cut to length between their desheathed leading end portions and the continuous supply, and the wire leading end portions subsequently are connected to respective terminals of the connector plug, utilizing the stored data information. Further, where greater production output is desired, two different cables may be fed from separate supplies on alternate cycles of operation and processed simultaneously.

BRIEF DESCRIPTION OF THE DRAWINGS

FIG. 15 is a plan view of the wire collating station shown in FIG. 14;

FIG. 16 is a cross-sectional view of the wire collating station taken along the line 16—16 in FIG. 15;

FIG. 25 is a block diagram of a control circuit for the apparatus shown schematically in FIG. 1;

FIG. 26 illustrates a control circuit for interfacing a memory with the wire fan-and-identify station of FIGS. 9–13 and the wire collating station of FIGS. 14–16;

FIG. 27 illustrates a diode matrix binary encoder circuit for identifying the cable wires, including their respective subgroups;

FIG. 31 is a schematic view of an alternate embodiment of the invention;

FIG. 32A is a cross-sectional view of the apparatus shown in FIG. 31, taken along the line 32—32, and showing the apparatus in a first operating position;

FIG. 32B is a cross-sectional view similar to FIG. 32A, showing the apparatus of FIG. 31 in a second operating position; and FIG. 33 is a schematic block diagram of a control circuit for the apparatus shown schematically in FIG. 31.

DETAILED DESCRIPTION - GENERAL

Figures 1, 30:
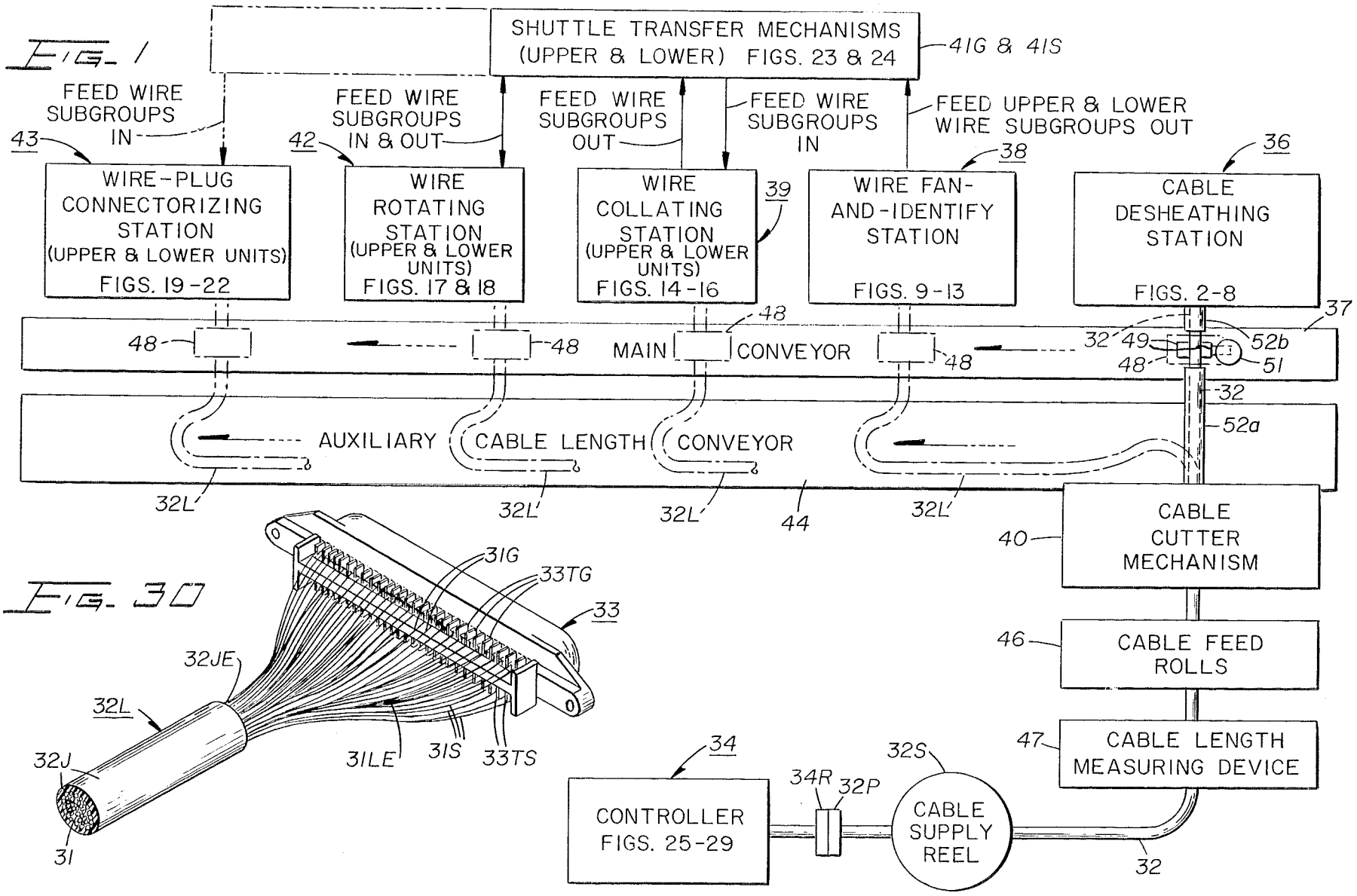
FIG. 1 is a schematic diagram of apparatus in accordance with the invention, for connecting wire leading end portions of a sheathed or jacketed cable to a connector plug in subgroups on opposite sides of the plug.
FIG. 30 is an isometric view of a sheathed or jacketed cable having desheathed wire portions secured to terminals of a cable connector plug.

Referring to FIGS. 1 and 30, the disclosed embodiment of the invention is directed to a system for automatically arranging leading end portions 31LE of a bundle of thermoplastic insulated wires 31, which initially are in random positions in a sheathed cable 32 having an irregular periphery, into respective preselected wiring positions, cutting a preselected length of cable 32L from a cable supply 32S, and connecting the wire leading end portions to a cable connector plug 33. The wires 31 are in the form of twisted pairs, with one wire of each pair being designated a ground wire 31G and the other wire of each pair being a signal wire 31S. The cable connector plug 33 is of a commercial type in which end portions of the ground and signal wires 31G and 31S are mounted in preselected wiring positions in respective rows of subgroups on the opposite sides (e.g., upper and lower as viewed in FIG. 30) of the plug by being press-fitted into sequentially numbered terminals 33TG or 33TS having spaced legs for cutting through the insulation on the wires and making electrical contact with the wires.

Referring to FIG. 1, in the disclosed embodiment of the invention, trailing wire ends of the cable supply 32S, which is wound on a suitable reel, initially are connected to a controller 34, with the wires 31G and 31S connected in a numerical order corresponding to their plug terminals 33TG or 33TS. For example, if the cable 32 includes 25 wire pairs, the wires 31G and 31S are each assigned wire numbers WN from 1–25 corresponding to numbers 1–25 of their respective terminals 33TG or 33TS.

The leading end of the cable 32 then is fed into a desheathing station 36 in which a leading end portion (e.g., 5") of a sheath or jacket 32J is removed from the cable, utilizing radiant heat. The desheathed bundle of cable wires 31 next is transferred by a main indexing conveyor 37 to a wire fan-and-identify station 38, where the desheathed portions of the twisted wires are arranged into an untwisted or individual-wire common plane configuration. The wire fan-and-identify station 38, in response to signals from the controller 34, also sorts the desheathed wire leading end portions 31LE into their upper (ground wires 31G) and lower (signal wires 31S) subgroups, depending upon the side of the cable connector plug 33 to which they are to be connected. At the same time, the controller 34 identifies the desheathed wire portions 31LE and their respective subgroups, and stores this information in sequence and by subgroup for subsequent use by a wire collating station 39.

Preferably, the cable length 32L then is cut from the cable supply 32S by a cutter mechanism 40 so that a new leading end of the cable supply can be fed into the desheathing station 36, while the wire leading end portions 31LE are transferred as upper and lower wire subgroups by the conveyor 37 and a pair of upper and lower shuttle transfer mechanisms 41G and 41S, from the wire fan-and-identify station 38 to the wire collating station 39. Utilizing the sequentially stored information in the controller 34, the collating station 39 then arranges the wire portions 31LE into their proper wiring order for connection to the cable connector plug 33, after which the collated wire portions are transferred as subgroups by the main conveyor 37 and the shuttle transfer mechanisms 41G and 41S to a wire rotating station 42. In the station 42, the collated wire portions 31LE are rotated as subgroups 180° to eliminate twist introduced into the subgroups at the previous fan-and-identify and collating stations 38 and 39. The main conveyor 37 and the shuttle transfer mechanisms 41G and 41S then transfer the wire portions 31LE to a wire-plug connectorizing station 43, where the wire portions 31LE are cut to length and connected to the cable connector plug 33. During the transferring of the wire portions 31LE between the stations 36, 38, 39, 42 and 43, the cable length 32L is transferred therewith by a suitable auxiliary conveyor 44 operated in synchronism with the main conveyor 37, and preferably disposed at a level below the level of the main conveyor to facilitate feeding of the cable 32 onto the auxiliary conveyor.

To preclude the necessity of rotating the cable supply reel 32S, the cable 32 preferably is fed off of the reel over one end thereof through a rotatable flyer (not shown) in a known manner. The controller 34 also preferably includes a plug-in type receptacle 34R for connection of the cable wires 31 thereto, and the trailing ends of the cable wires on the supply reel 32S initially are preconnected to a plug 32P receivable in the receptacle for this purpose. The cable 32 is pulled from the supply reel 32S through the above-mentioned flyer and over guide rolls (not shown) by a set of opposed feed rolls 46, which are driven by suitable torque motors and which operate in conjunction with a cable length measuring device 47 and the cable cutting mechanism 40 to feed and cut the cable 32 into the successive cable lengths 32L.

The main conveyor 37 preferably is of a continuous-loop precision indexing type, such as the "Type BW Trans-o-mator" available from the Ferguson Machine Company of St. Louis, Missouri (see U.S. Pat. No. 2,793,733, issued May 28, 1957 to S. Karogeorgieff), having a flexible belt carrier mechanism as disclosed in the U.S. Pat. No. 3,636,783, issued Jan. 25, 1972 to D. W. Woltjen, and upon which a plurality of suitable carriers 48 have been mounted in spaced relationship. For example, in the illustrated embodiment of the invention, each of the carriers 48 includes a set of opposed clamping jaws 49 shown schematically in FIG. 1, one of which is fixedly mounted and the other of which is pivotally mounted and spring-biased to a closed clamping position. As each carrier 48 is moved into a position adjacent the cable desheathing station 36, an actuating rod of an air cylinder 51 above the main conveyor 37 is moved downward to cam the pivoted jaw 49 to an open position for the reception of the cable 32. After the cable 32 has been fed, via aligned guideways **52*a* and 52*b*, through the open jaws 49 and into the desheathing station 36 by the set of opposed feed rolls 46, the air cylinder 51 is deactuated to permit the spring-biased pivoted jaw to clamp the cable. Adjacent the discharge end of the conveyor 37, the pivoted jaw 49 on each carrier 48 again is cammed to an open position for discharge of each assembled cable length 32L and connector plug 33** in a similar manner, by another air cylinder (not shown).

Figure 2:
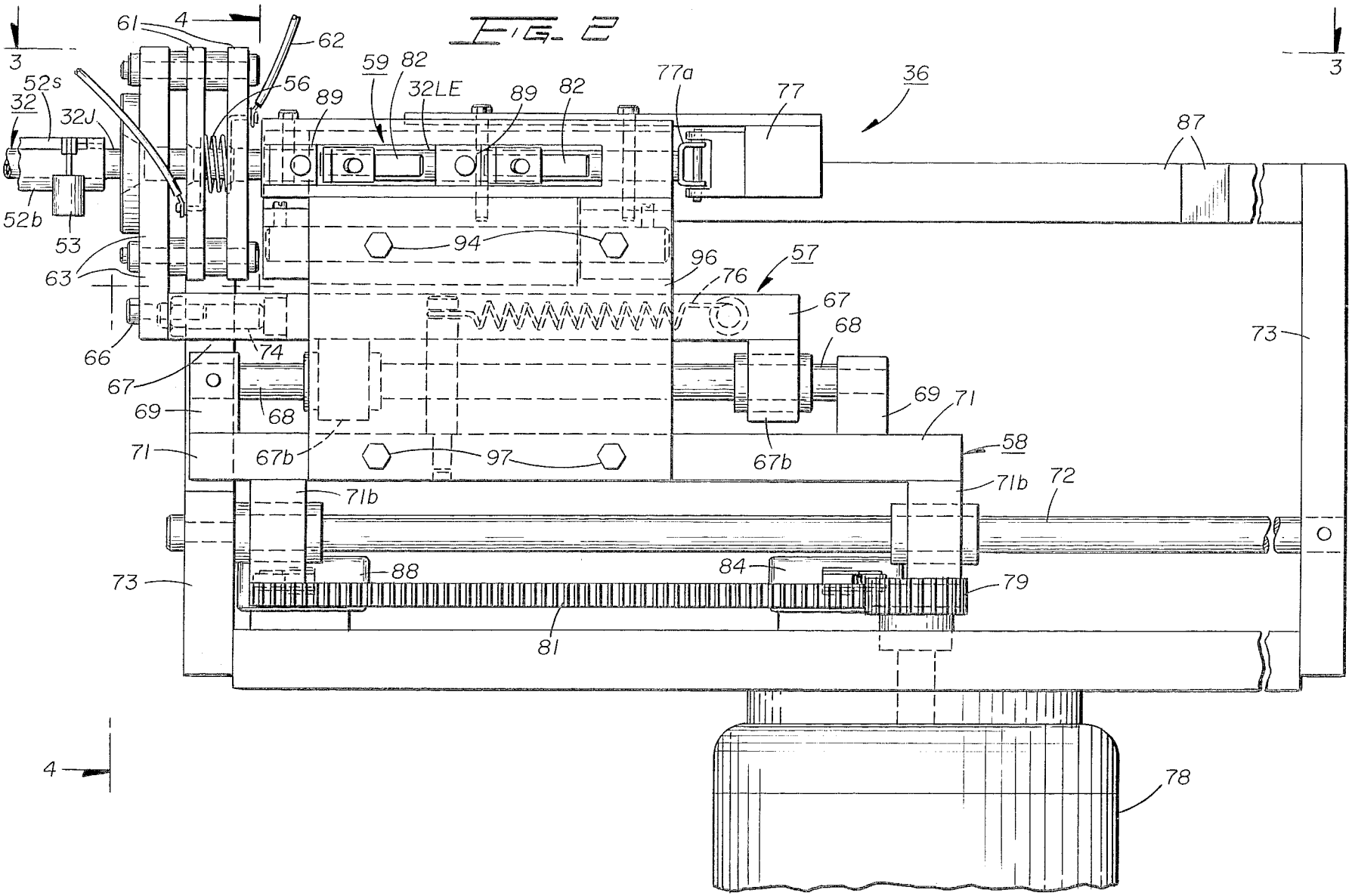
FIG. 2 is a plan view of a cable desheathing station of the apparatus shown schematically in FIG. 1, in an advanced operating position.
Figure 3:
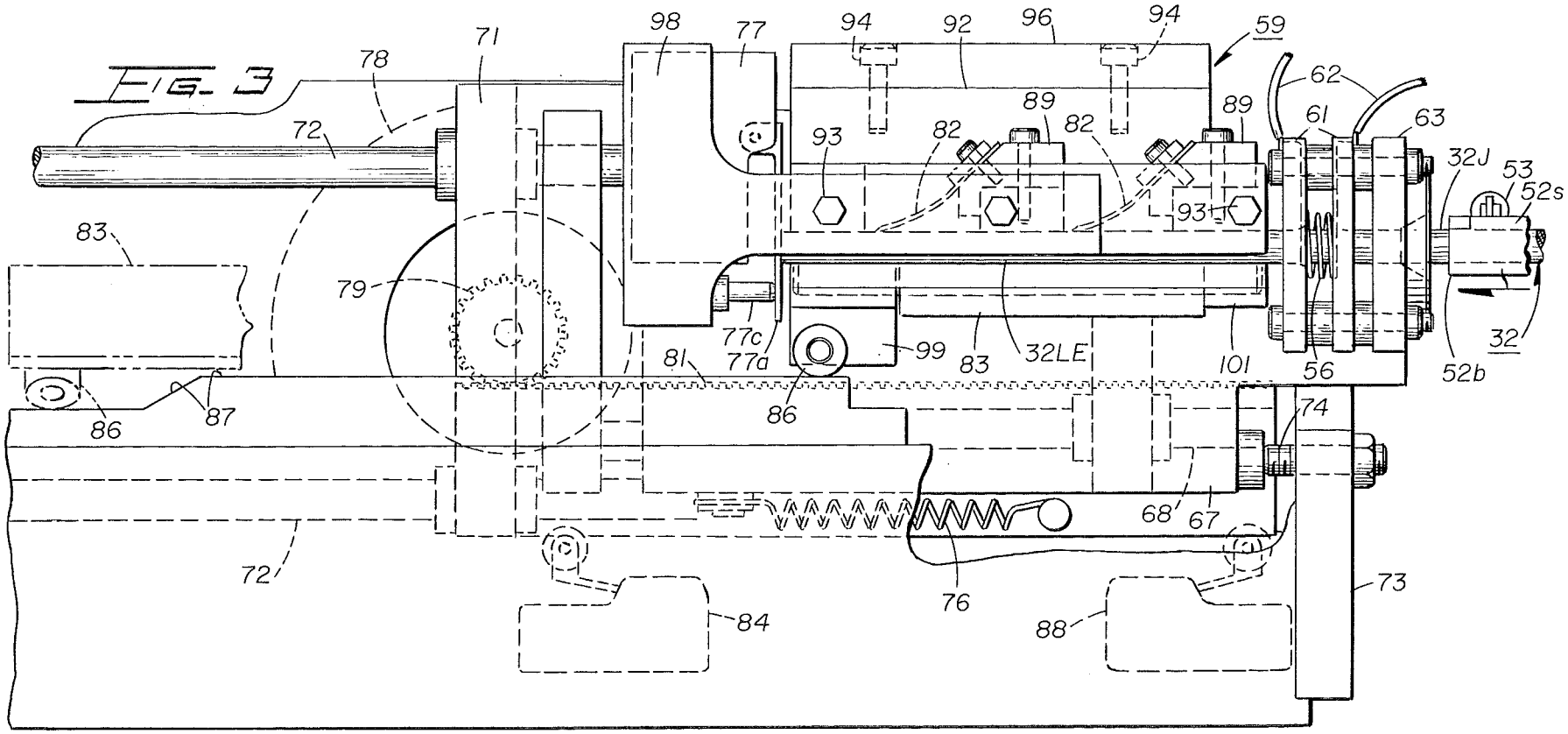
FIG. 3 is a side elevational view of the cable desheathing station shown in FIG. 2, as viewed in the direction of the arrows 3—3.

Each of the guideways **52*a* and 52*b* may be of any suitable type capable of opening to permit sideways discharge of the cable 32 therefrom (to permit indexing of the conveyor 37), or in the case of the guideway 52*a*, to permit outward looping of the cable 32 therefrom onto the auxiliary conveyor 44 as the desired cable length 32L is fed by the cable feed rolls 46 after the cable 32 has been gripped by the carrier clamping jaws 49. For example, each of the guideways 52*a* and 52*b* may be in the form of a tube of rectangular cross-section having a hinged sidewall 52*s* movable to an open position by one or more air cylinders 53 on the top of the guideway, and having a piston rod suitably connected to an upstanding lug on the sidewall, as is illustrated in FIGS. 2 and 3 for the guideway 52*b***.

Cable Desheathing Station (FIGS. 2–8)

Referring to FIGS. 2–8, the cable desheathing station 36 is of the same type disclosed in the copending application of R. H. Keen and G. G. Seaman, Ser. No. 647,249, filed on even date herewith and assigned to the same assignee. Thus, a leading end portion 32LE of the cable 32 is fed into the desheathing station 36 so that the cable is surrounded by an annular radiant heat source 56, such as an electrical heat coil of greater diameter than that of the cable jacket or sheathing 32J, whereby the jacket is receivable through the heat coil without being engaged thereby.

Figure 8:
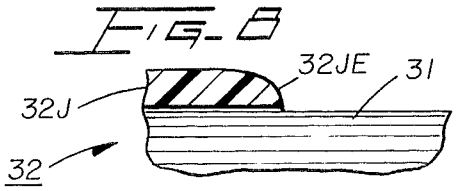
FIG. 8 is an enlarged partial cross-sectional view of the cable shown in FIG. 6, illustrating a separation edge formed in the jacket of the desheathed cable.
Figure 7:
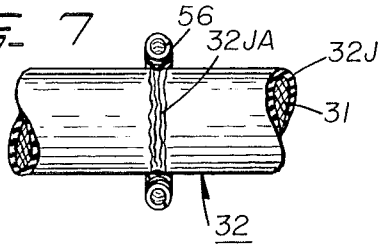
FIG. 7 is an enlarged partial view of the cable in FIG. 6, illustrating a cable jacket heating step.
Figure 6:
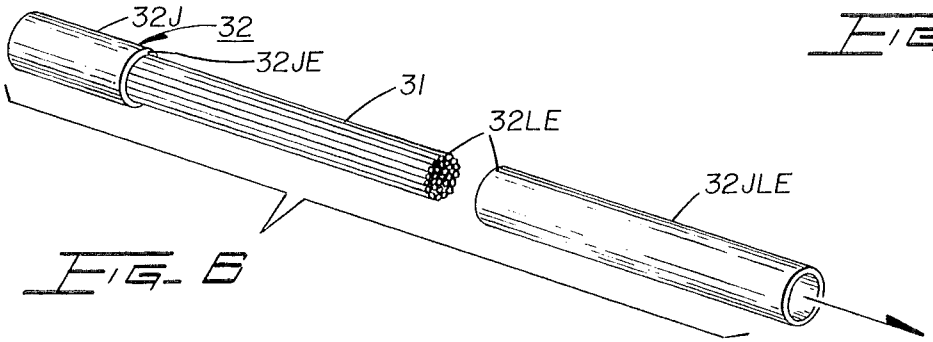
FIG. 6 is an isometric view illustrating jacketed cable after desheathing of a leading end portion of the cable.
Figure 5:
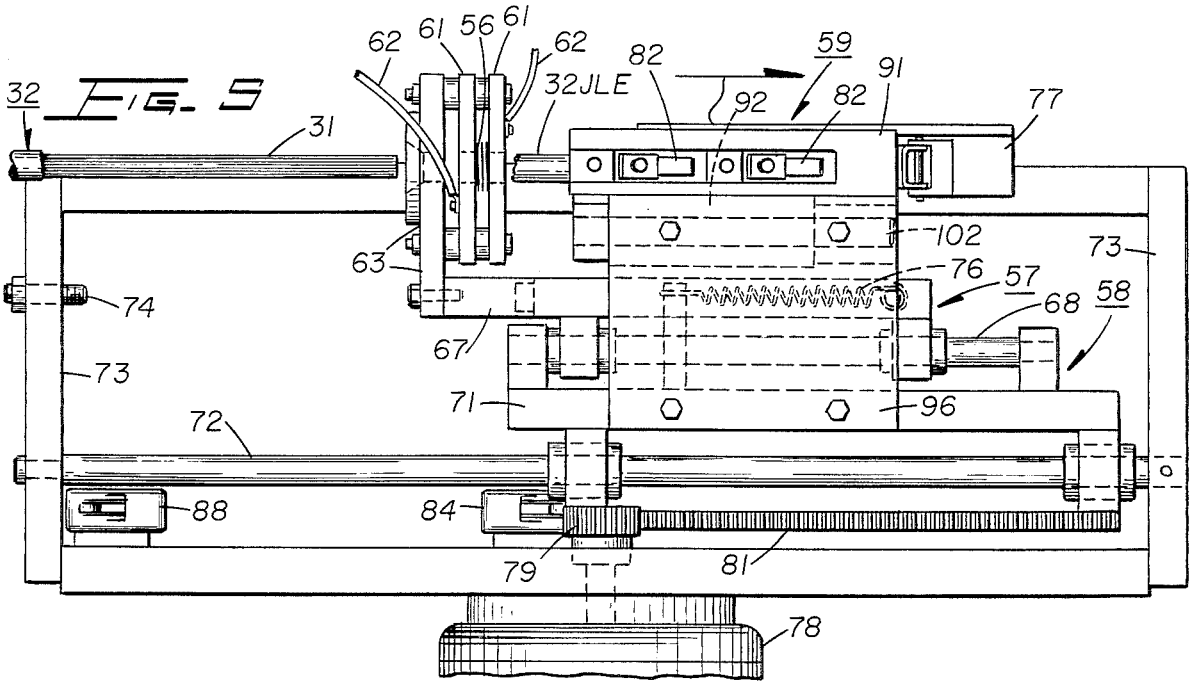
FIG. 5 is a reduced plan view of the cable desheathing apparatus in a retracted operating position.

The heat coil 56, which in the illustrated embodiment of the invention is continuously energized, may be of any suitable material, such as nickel-chromium resistance wire, and is carried on a secondary slide assembly 57, which is mounted upon a main slide assembly 58. After the heat coil 56 has sufficiently softened a narrow annular section 32JA of the thermoplastic cable jacket 32J, as illustrated in FIG. 7, the main slide assembly 58 is driven to the right in FIG. 2 (which is to the left in FIG. 3) parallel to the cable leading end portion 32LE toward a retracted position as illustrated in FIG. 5, and a jacket gripping mechanism 59 on the main slide assembly grips the leading end portion 32JE of the cable jacket and applies tension on the jacket to separate the jacket along the circumferential center of the heat-softened section. The secondary slide assembly 57 then is moved with the main slide assembly 58 toward the retracted position in FIG. 5 to remove the heat coil 56 from the area of cable jacket separation, so as to preclude damage to the thermoplastic insulation on the cable wires 31, and to terminate the application of heat to the cable jacket 32J remaining on the cable 32, whereby the heat softened material thereof rehardens and forms a smooth edge 32JE along the line of jacket separation, as illustrated in FIGS. 6 and 8.

More specifically, the heat coil 56 is supported between a pair of spaced electrical insulator blocks 61 in circular recesses therein. An integral wire portion at each end of the heat coil 56 extends upward adjacent a respective one of the insulator blocks 61 and is electrically connected to an electrical terminal mounted on the insulator block and having an electrical lead 62 connected thereto from an electrical power source (not shown). The insulator blocks 61 are connected together and to a vertical front plate 63 having an annular funnel-shaped cable entrance guide portion formed integral therewith, by bolt and nut assemblies, with the insulator blocks and support plate separated by suitable spacers. The insulator blocks 61 include cable receiving apertures having a diameter on the order of the cable jacket 32J, but smaller than that of the electrical heat coil 56, for supporting the jacket axially within the coil without engaging the coil. The vertical front plate 63 is mounted adjacent a vertical edge by screws 66 (FIGS. 2 and 4) to a front edge of a vertically disposed support plate 67 of the secondary slide assembly 57.

The secondary slide assembly 57 is mounted for relative movement on the main slide assembly 58 by spaced bushing support members **67*b* fixedly mounted on the vertical support plate 67 and slidable on a pair of upper and lower guide shafts 68 fixedly mounted at their opposite ends in brackets 69 on a vertically disposed support plate 71 of the main slide assembly 58. The main slide assembly 58 is similarly supported for reciprocal movement by means of bushing support members 71*b* fixedly secured to its vertical support plate 71 and slidable on a pair of upper and lower guide shafts 72 fixedly mounted at their opposite ends on frame members 73 of the desheathing station 36. The secondary slide assembly 57 is biased on the main slide assembly 58 to the left, as viewed in FIG. 3 (to the right as viewed in FIG. 2) against an adjustable stop screw 74 mounted in one of the frame members 73, by a coil spring 76 connected between the slide vertical support plates 67 and 71**.

Movement of the cable 32 into the desheathing station 36 is limited by the leading end of the cable engaging an actuating arm **77*a* of a limit switch 77 and pivoting the arm against a rigid stop member 77*c* (FIG. 3). Pivoting of the actuating arm 77*a* closes the limit switch 77 to cause deactuation of the carrier clamp air cylinder 51 (FIG. 1) so that the cable 32 becomes gripped in the carrier clamping jaws 49, as above described. As the carrier clamp air cylinder 51 reaches its retracted position, it closes a limit switch (not shown) to cause actuation of the air cylinders 53 (not shown in FIGS. 2 and 3), which open the sidewalls of the cable guideways 52*a* and 52*b* (FIGS. 1, 2 and 3) to permit continued feeding of the cable 32 from the guideway 52*b* onto the auxiliary conveyor 44, and to prepare the guideway 52*b* for subsequent indexing of the cable by the main conveyor 37. In addition, the closed limit switch 77 causes operation of a time delay relay (not shown), which after a short time period (a few seconds) which is sufficient to cause the necessary softening of the narrow annular section 32JA of the cable jacket 32J by radiant heat from the heat coil 56, energizes a reversible drive motor 78 mounted on the frame of the desheathing station 36. The motor 78, which has a gear 79 engaged with a gear rack 81 fixedly mounted on the bushing support members 71*b* of the main slide assembly 58, then causes the main slide assembly to move parallel to the cable 32 to the right in FIG. 2, as above described, toward a retracted position. Under certain conditions, where the use of an intermittently operated heat coil 56 may be desirable, the aforementioned time delay relay can be used to de-energize the heat coil to terminate the application of heat to the cable 32**.

Figure 4:
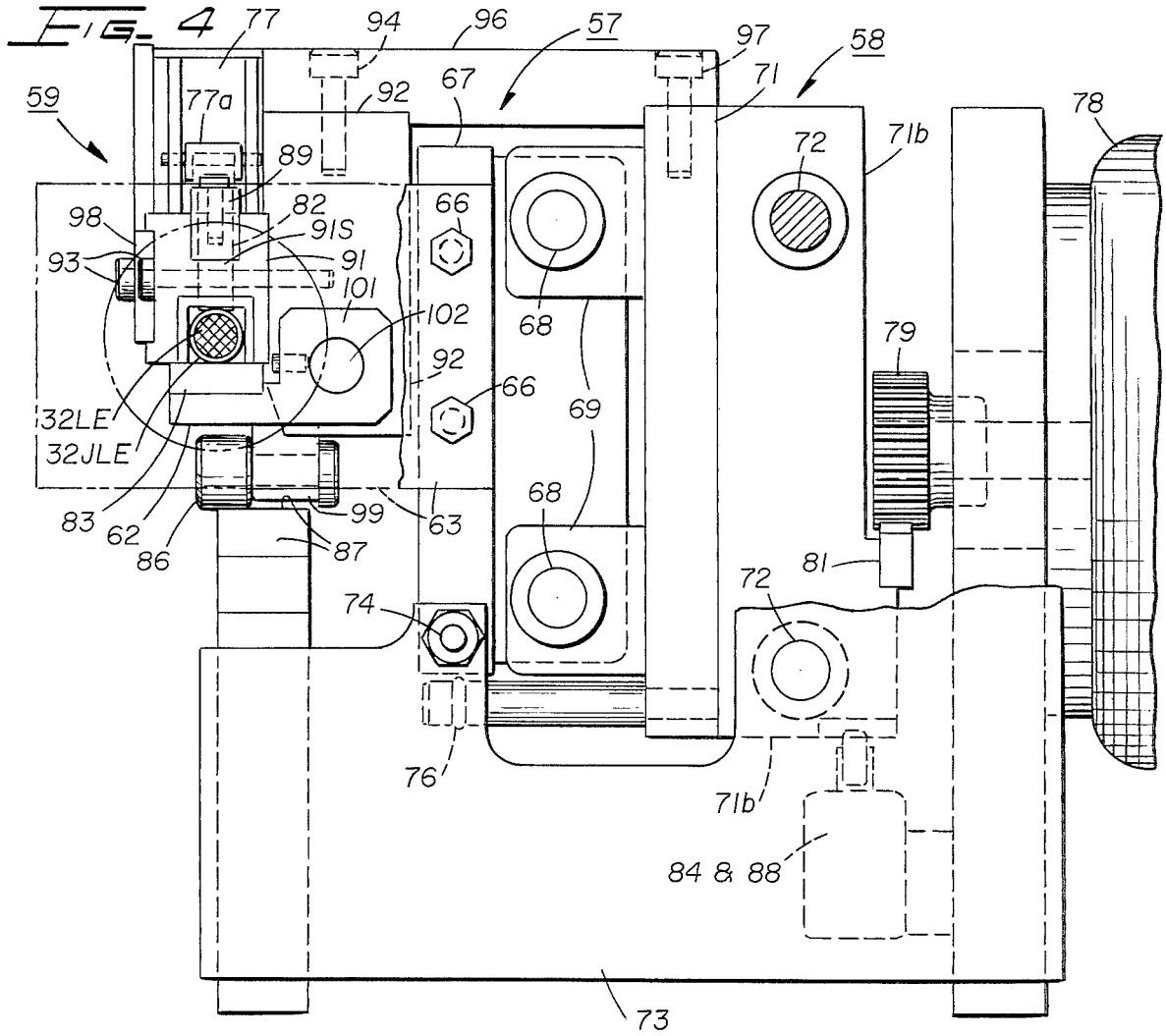
FIG. 4 is a cross-sectional view of the cable desheathing apparatus, taken along the line 4—4 in FIG. 2.

As is best shown in FIGS. 3 and 4, the cable jacket gripping mechanism 59 includes a set of one-way gripping blades 82 extending downward in the direction of cable feed into the apparatus, and an opposed hinged trapdoor 83 for insuring positive engagement of the blades with the cable jacket 32J. Thus, during the initial movement of the main slide assembly 58, the hinged trapdoor 83 and the gripping blades 82, which permit initial entry of the cable 32 into the desheathing apparatus 36, but which bite into the cable jacket 32J to preclude relative movement between the jacket and the gripping blades in the opposite direction, cooperate to cause a leading end portion 32JLE (FIG. 6) of the jacket to move longitudinally relative to the cable, thereby causing the cable jacket to separate in tension along the circumferential center of the softened annular jacket section 32JA. At the same time, the main slide assembly 58 moves relative to the spring-biased secondary slide assembly 57 to withdraw the jacket leading end portion 32JLE from within the heat coil 56 and the innermost insulator block 61, to prevent excessive melting of the jacket portion and to permit subsequent discharge of the jacket portion from the apparatus without interference from the heat coil and the insulator block. The left-hand shaft support bracket 69 (as viewed in FIG. 2) of the main slide assembly 58 then engages the adjacent mounting bushing **67*b* of the secondary slide assembly 57 to cause the secondary slide assembly and the heat coil 56** to move with the main slide assembly.

The secondary and main slide assemblies 57 and 58 travel together to the right in FIG. 2 (to the left in FIG. 3) to the retracted position shown in FIG. 5, until the left-hand shaft support bracket **71*b* (as viewed in FIG. 2) of the main slide assembly rides over a limit switch 84 (FIGS. 3 and 4) on the station frame, to de-energize the drive motor 78. As is illustrated in FIG. 3, during this travel a cam follower 86 on the hinged trapdoor 83 rides into a depressed portion of a cam track 87 on the station frame to permit the trapdoor to pivot to an open position, thereby discharging the removed leading end portion 32JLE of the cable jacket 32J** into a suitable receptacle.

As the indexing conveyor 37 advances the now desheathed portion of the cable 32 out of the desheathing station 36 to the wire fan-and-identify station 38, the conveyor operates a limit switch (not shown) to reverse the drive of the motor 78, which then returns the slide assemblies 57 and 58 to their original positions for the reception of a new leading end portion 32LE of the cable 32 from the supply reel 32S. As the main slide assembly 58 reaches its original position, one of its bushing support members **71*b* operates a limit switch 88 on the desheathing station frame to de-energize the drive motor 78**.

Each of the jacket gripping blades 82 is of resilient leaf-spring construction and is suitably mounted (e.g., by a screw and a retaining plate) adjacent its upper end on a respective blade holder 89. As is best shown in FIG. 4, each blade holder 89 is located in a longitudinal slot defined by opposed spaced upper side walls of a generally H-shaped mounting member 91 and is secured (e.g., by a screw) on the top of one of a plurality of intermediate spacer portions 91*S* of the H-shaped mounting member. The mounting member 91 is secured to a depending support bracket 92 by screws 93, and the support bracket is connected at its upper end by screws 94 to the bottom of a horizontal top plate 96 adjacent one side thereof. The top plate 96 is mounted adjacent an opposite side by screws 97 to the upper edge of the main slide vertical support plate 71. A lower end portion of the gripping blade 82 projects downward through an opening in the H-shaped mounting member 91 into an elongated cable receiving cavity defined by a lower longitudinal slot in the mounting member and the trapdoor 83. The limit switch 77 also is supported on the mounting member 91 so as to block one end of the thus defined cavity, by an arm 98 and the screws 93.

The trapdoor 83 is secured adjacent its opposite ends to hinge members 99 and 101 (FIGS. 3 and 4), with the hinge member 99 carrying the cam follower 86. As is best shown in FIG. 4, the hinge members 99 and 101 are fixedly mounted (by means of integral apertured ear portions and set screws) to respective opposite ends of a pivot shaft 102 journalled in depending lugs of the support bracket 92. The trapdoor 83 may pivot to its open position solely by gravity, and discharge of the jacket leading end portion 32JLE may be accomplished solely by gravity, or a small leaf spring (not shown) for facilitating discharge of the jacket leading end portion may be suitably mounted on one of the mounting member spacer portions 91*S*, if so desired.

The temperature of the electrical heat coil 56 and the duration of exposure of the thermoplastic cable jacket 32J thereto, in order to soften the narrow annular section 32JA of the jacket so that it will separate properly without tearing (insufficient heat-softening) or elongating (excessive heat-softening) so as to cause "stringing out", and then reharden or coalesce to form the smooth edge 32JE (FIG. 8), will vary depending on the material involved. By way of illustration, however, in the case of a vinyl jacketed cable 32, by adjusting the temperature of the electrical heat coil 56 with a rheostat (not shown) in a known manner, favorable results have been achieved with a heat-exposure time of 3-4 seconds. Similarly, to avoid excessive elongation or "stringing out" of the cable jacket 32J during the jacket separating operation, whereby the jacket will not reharden to form the smooth edge 32JE, the width of the heat-softened annular section 32JA of the jacket preferably is kept on the order of ⅛inch or less, this dimension being readily controlled by varying the axial length of the heat coil 56 (i.e., the spacing between the insulator blocks 61).

Wire Fan-and-Identify Station (FIGS. 9-13)

Figure 9A:
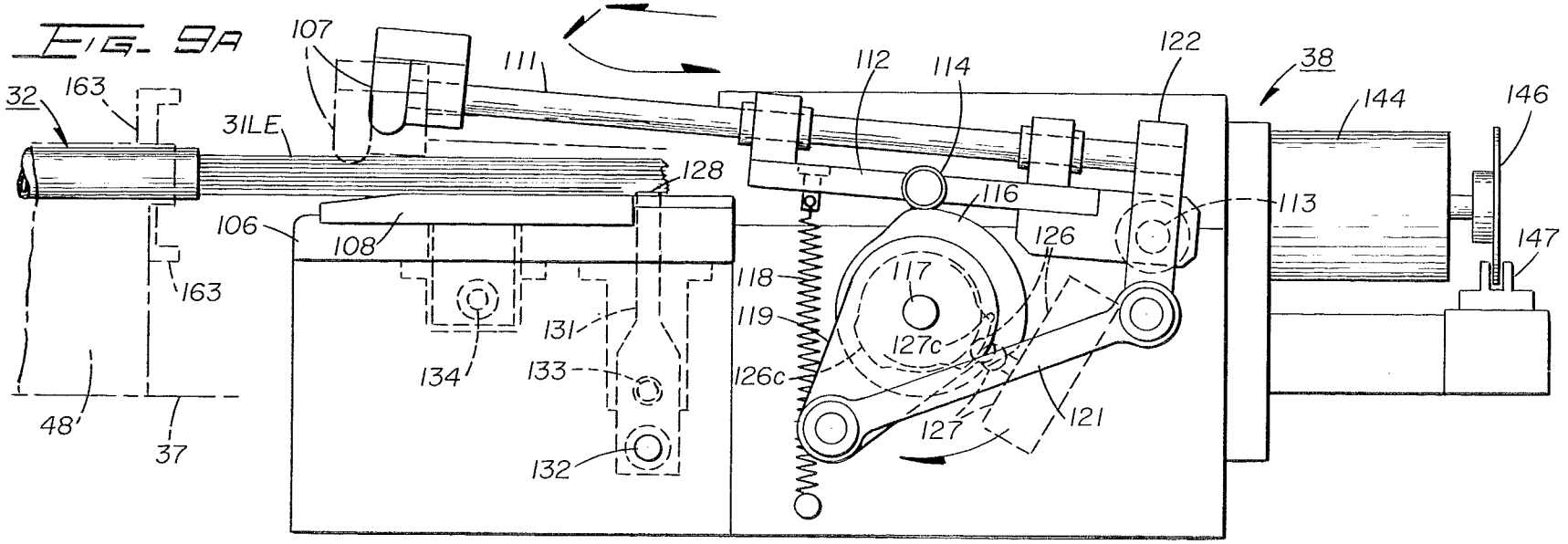
FIGS. 9A and 9B are side elevational views of a wire fan-and-identify station of the apparatus shown schematically in FIG. 1, illustrating the station in two different operating conditions.
Figure 9B:
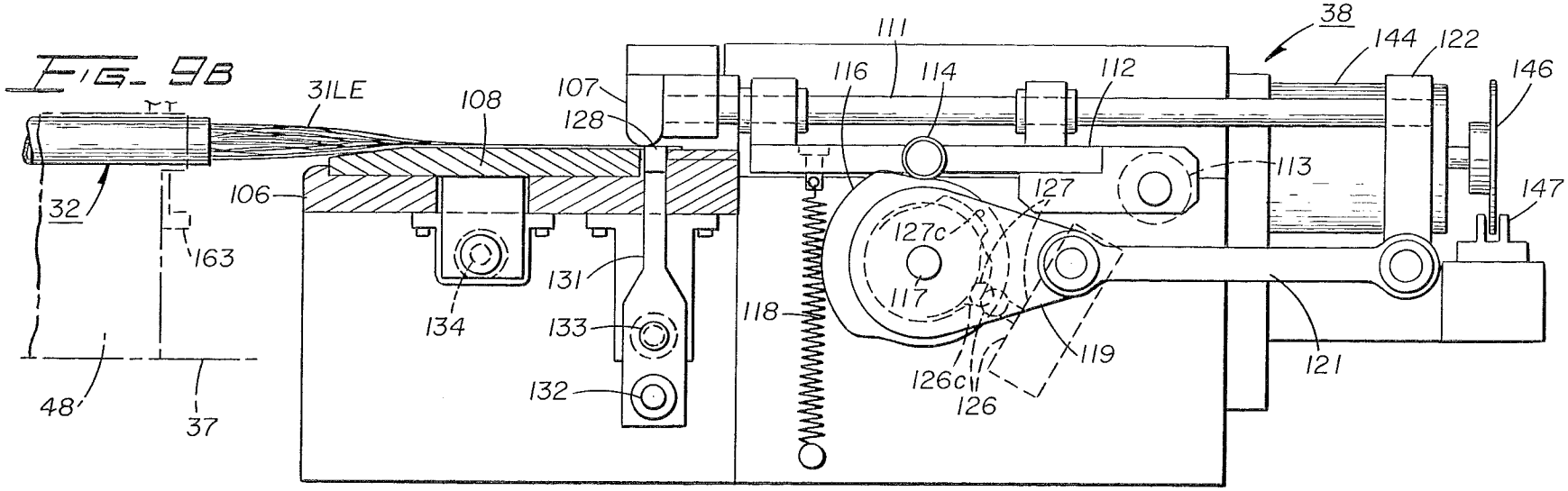
Figure 10:
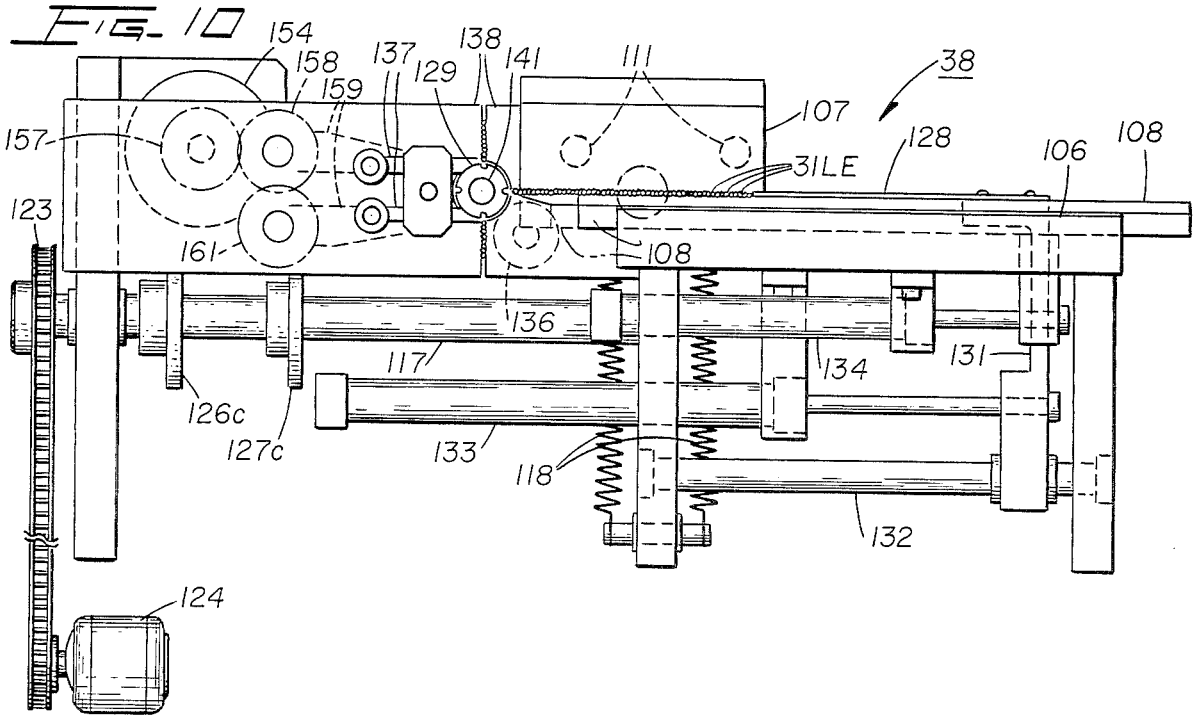
FIG. 10 is a front elevational view of the wire fan-and-identify station shown in FIG. 9.
Figures 11, 13:
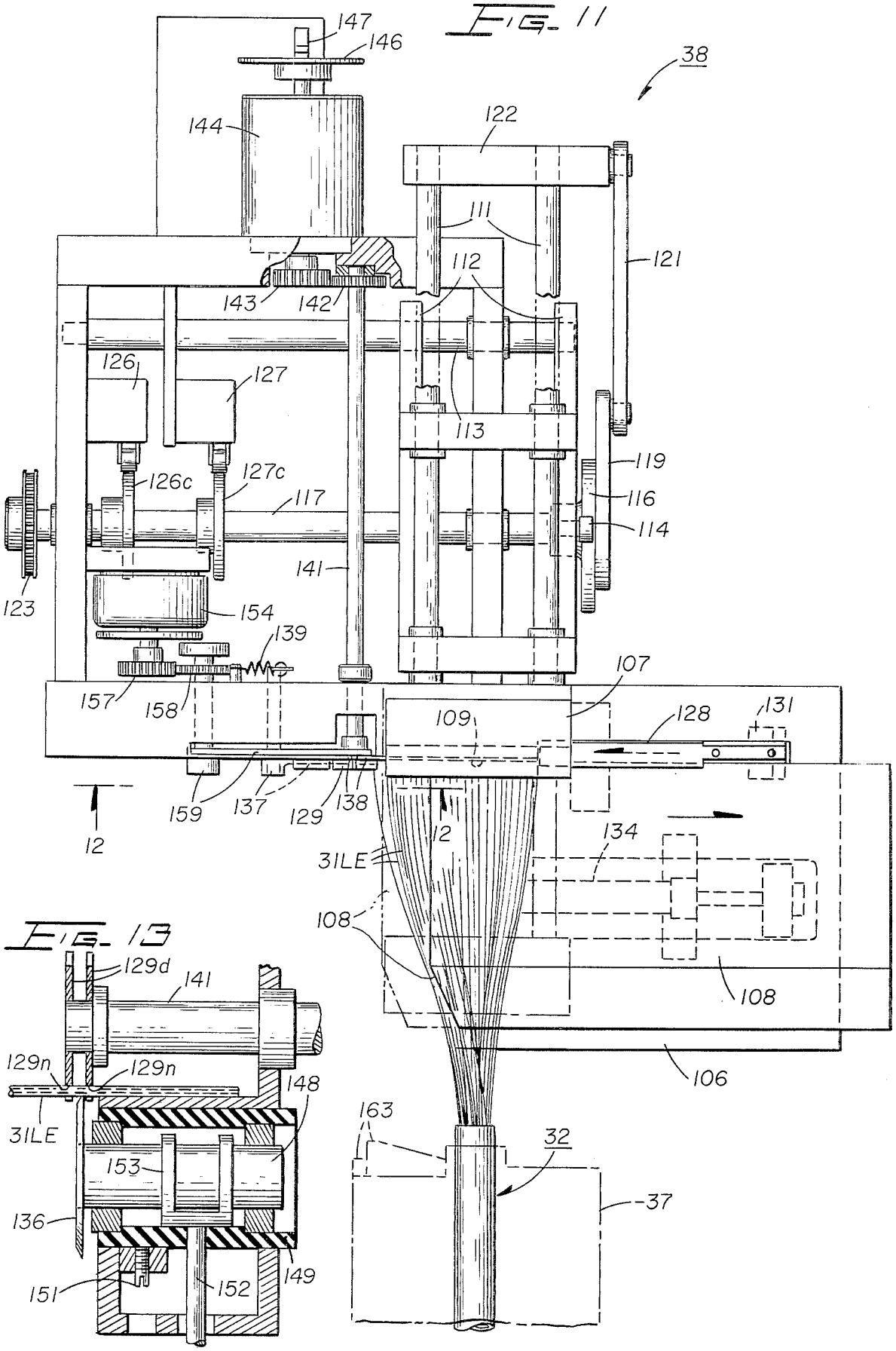
FIG. 11 is a plan view of the wire fan-and-identify station shown in FIGS. 9 and 10.
FIG. 13 is an enlarged cross-sectional view taken along the line 13—13 in FIG. 12.

In the wire fan-and-identify station 38, the desheathed bundle of cable wire leading end portions 31LE is moved by the indexing conveyor 37 into a position on a support table 106, and beneath a reciprocably and pivotally mounted anvil member 107, which initially is in a raised forward position, substantially as shown in solid lines in FIG. 9A. The anvil member 107 then is moved counterclockwise in FIG. 9A into pressure engagement with the bundle of wire portions 31LE in spaced relationship to their free ends, as illustrated in broken lines in that figure. Next, the anvil 107 is moved to the right in FIG. 9A longitudinally of the wire portions 31LE and toward their free ends to an inner retracted position, substantially as shown in solid lines in FIG. 9B, while exerting downward pressure on the wire portions against the support table 106. Since the plastic insulation (e.g., polyvinyl chloride) on the wire portions 31LE has a low coefficient of friction, whereby they readily slide relative to one another, this movement of the anvil 107 tends to cause the wire portions to move from a bundle configuration into a common plane configuration as illustrated in FIGS. 9B, 10 and 11. The anvil 107 then is pivoted clockwise in FIG. 9B away from the wire portions 31LE and moved linearly back to the left to its initial raised position in FIG. 9A, whereupon this "ironing" of the wire portions by the anvil is repeated until the untwisting of the wire portions is complete.

The upper wire-engaging surface of the support table 106 preferably is formed by a plate member 108 having a low coefficient of friction, such as a polished chrome finish on the order of 0.002inch thick, whereby the insulated wire portions 31E can readily slide over the plate member during the "ironing" of the wire portions, to facilitate the untwisting thereof. After the anvil 107 has been moved through a sufficient number of these wire "ironing" steps (three or four) to achieve untwisting of the wire portions 31LE, movement of the anvil is stopped in an innermost lower position, as shown in FIGS. 9B and 10, where it cooperates with a fixed lower guide member 109 (FIG. 12) on a station main frame to define a horizontal feed slot for the wire portions.

The anvil 107 is mounted for its reciprocating movement on the front ends of a pair of spaced elongated rods 111 slidable in bushings fixed to the top of a subframe 112. The subframe 112 is fixedly mounted adjacent an inner end thereof (right-hand as viewed in FIG. 9) on a pivot shaft 113 journalled in side members of the station main frame. Pivotal movement of the subframe 112 is accomplished by a cam follower 114 thereon engaged with a cam 116 adjacent one end of a rotatable drive shaft 117 journalled in the main frame for moving the subframe, and thus the anvil member 107, vertically against the action of a pair of biasing springs 118 connected between opposite sides of the subframe and the main frame. Longitudinal reciprocating movement of the slide rods 111 is achieved by a crank member 119 on the one end of the drive shaft 117 and pivotally connected by a rod 121 to a projecting portion of a transverse bar member 122 fixedly interconnecting the inner (right-hand) ends of the slide rods. Adjacent its opposite end the drive shaft 117 carries a sprocket 123 (FIGS. 10 and 11) driven by a suitable motor 124 (FIG. 10).

Stopping of the anvil 107 in its lower retracted position (FIGS. 9B and 10) and its upper raised position (FIG. 9A) may be accomplished in any suitable manner. For example, in the illustrated embodiment of the invention first and second motor control limit switches 126 and 127 (FIGS. 9 and 11) are mounted on the station frame adjacent the drive shaft 117, and respective operating cams 126*c* and 127*c* are fixed on the drive shaft. After the bundle of wire leading end portions 31LE has been indexed onto the support table 106, a sequence control circuit 34SCC (FIG. 25) of the controller 34 energizes the motor 124 for the drive shaft 117, causing the anvil 107 to press or "iron" the bundle of wire portions as above described. As the drive shaft 117 rotates, the second cam 127*c* opens the second limit switch 127 on each revolution of the shaft, with each opening of the switch being detected by a counting circuit (not shown) in the sequence control circuit 34SCC. After the desired number of shaft revolutions has occurred, the sequence control circuit 34SCC places the shaft drive motor 124 under the control of the first limit switch 126 so that when this switch is subsequently opened by its cam 126*c*, the motor is de-energized to stop the anvil 107 in its lower feed position shown in FIGS. 9B and 10. After the fanning of the wire portions 31LE into subgroups has been completed, as is subsequently to be described, the sequence control circuit 34SCC places the shaft drive motor 126 under the control of the second limit switch 127, which at that time is closed, whereby the motor is again energized and runs until the second limit switch is subsequently opened by its cam 127*c*, to stop the anvil 107 in its upper raised position in FIG. 9A in readiness for the next cycle of operation.

Figure 12:
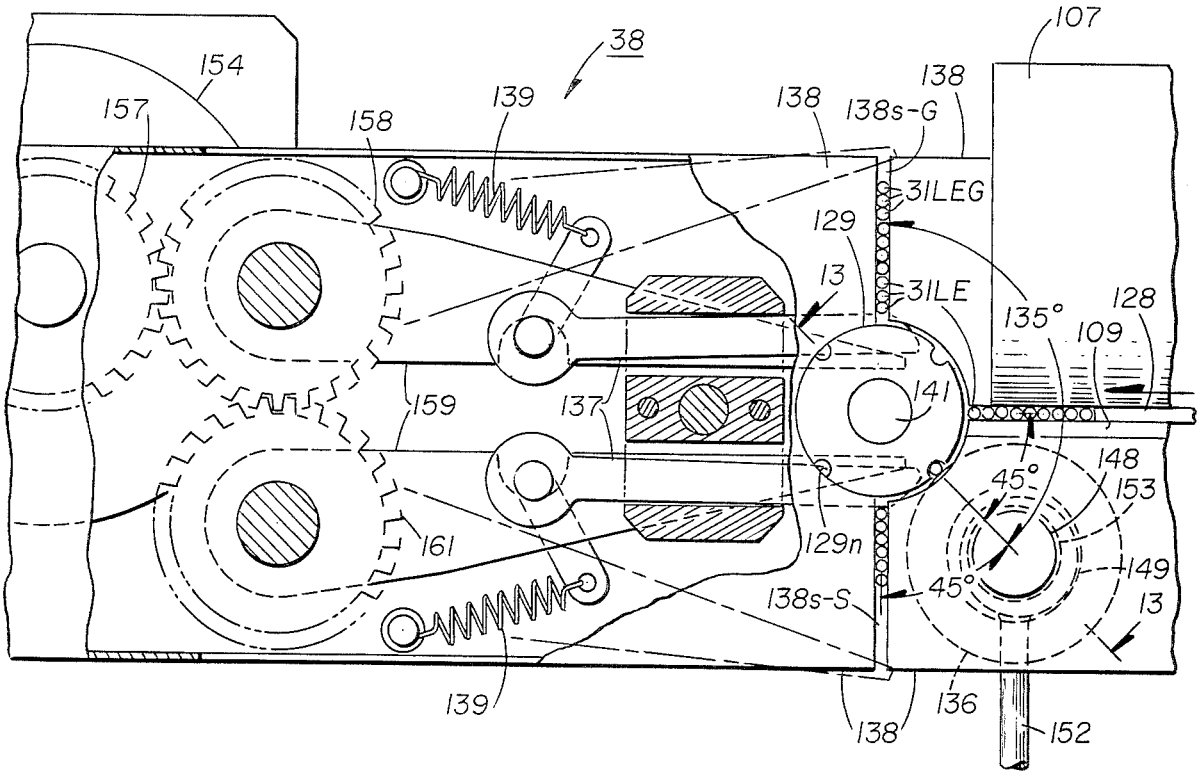
FIG. 12 is an enlarged partial cross-sectional view taken along the line 12—12 in FIG. 11.

Referring to FIGS. 10, 11 and 12, after the "ironing" of the wire leading end portions 31LE into a common plane configuration is completed, a pusher blade 128 is advanced longitudinally between the anvil 107 and the fixed guide member 109 to push the wire portions through the horizontal feed slot defined thereby, so that the first wire portion comes into engagement with a notched feed wheel 129 at a discharge end of the slot. The pusher blade 128 is mounted on a vertical bracket 131 depending through a slot in the support table 106 and slidably mounted by suitable bushings on vertically spaced guide shafts 132 (only one shown) having their opposite ends fixedly mounted on the station main frame. Movement of the pusher blade 128 to urge the wire portions 31LE continuously toward the feed wheel 129 is accomplished by de-energizing a small internally spring-loaded air cylinder 133 mounted on the station main frame beneath the support table 106 and having its piston rod suitably connected to the bracket 131. With the cable wire end portions 31LE now received between the anvil 107 and the fixed slot-defining guide member 109, the plate member 108, which is slidably mounted on the support table 106, then is moved by an air cylinder 134 on the support table to the right as viewed in FIGS. 10 and 11, from a position as illustrated by broken lines to a position as illustrated by solid lines, to eliminate interference between the plate member and the cable wire portions of the signal wires 31S as they are fanned into a lower subgroup in a manner to be described.

Referring to FIG. 12, the wire leading end portions 31LE in the feed slot defined by the anvil 107 and the fixed guide member 109 are urged toward the feed wheel 129 so that the first wire portion is received in one of a plurality of a set of notches 129*n* in the feed wheel's periphery, the notches being sized to receive only one wire portion at a time therein. The controller 34 then causes the feed wheel 129 to be rotated 45° clockwise in FIG. 12 to bring the first wire portion 31LE into engagement with a grounded electrical contact wheel 136. Referring to FIG. 1, as the first wire portion 31LE engages the electrical contact wheel 136, the wheel cuts through the insulation on the wire portion to establish an electrical circuit through its cable wire 31 (FIG. 30), from the controller 34 to ground. The controller 34 then identifies the grounded wire 31 as to its preselected numerical wiring position and the subgroup in which it belongs, and stores information as to its identity and its numerical random position (in this case, "one") in its subgroup for subsequent use at the wire collating station 39.

If the preselected wiring position for the grounded wire 31 is in the lower row or subgroup of terminals 33TS (FIG. 30) on the connector plug 33 (i.e., a signal wire portion 31LES), the controller 34 causes the feed wheel 129 to be indexed an additional 45° clockwise in FIG. 12, and the wire portion 31LES is cammed out of the associated peripheral notch 129*n* in the feed wheel by one end of a lower pivoted pawl member 137, into a lower vertical wire-receiving slot 138s-S defined by spaced edges of station frame members 138. However, if the grounded wire 31 is in the upper row of plug terminals 33TG (i.e., a ground wire portion 31LEG), the controller 34 causes the feed wheel to be indexed 135° counterclockwise in FIG. 12 past the feed slot, and the wire portion 31LEG is cammed out of the notch 129*n* in the periphery of the feed wheel 129 by one end of an upper pivoted pawl member 137, into an upper vertical wire-receiving slot 138s-G defined by spaced edges of the frame members 138. In the latter instance, since the peripheral feed wheel notches 129*n* are sized to receive only one wire portion 31LE at a time, the filled notch merely bypasses the next wire portion in the feed slot as the notch moves to the upper discharge position. Further, in either instance, since the peripheral notches 129*n* are located at 90° intervals, the rotation of the feed wheel 129 ultimately brings an empty peripheral notch opposite the discharge end of the feed slot for the reception of the next wire leading end portion 31LE. The upper and lower camming pawls 137 are pivotally mounted on the station main frame, and include integral projecting levers to which biasing springs 139 are connected for urging the pawls toward their respective wirereceiving slots 138s-S and 138s-G against suitable stops.

As is best shown in FIG. 13, the feed wheel 129 is made up of two spaced discs 129*d* having the peripheral notches 129*n* formed therein in aligned pairs so that when one of the wire leading end portions 31LE is received in a pair of the notches, the wire portion is capable of flexible movement between the discs. Thus, as the discs 129*d* move the wire portion 31LE into engagement with the electrical contact wheel 136, the contact wheel initially cuts through the insulation on the wire portion, as above described. However, upon the contact wheel 136 cutting through the wire insulation and engaging the metal wire, the wire is flexed by the contact wheel to eliminate the possibility of the contact wheel severely nicking or cutting through the metal wire. Thus, the contact wheel 136 can be set to insure positive cutting through the insulation on the wires 31 so as to make positive electrical contact with each wire, despite variations in insulation thickness on the wires.

The feed wheel 129 is secured to one end of an elongated shaft 141 which is journalled in the station main frame and driven by a gear 142 secured to its opposite end and engaged with a gear 143 on one end of a drive shaft of a stepping motor 144. To insure that the feed wheel 129 is properly indexed on each wire processing cycle, the opposite end of the stepping motor drive shaft carries a circular disc 146 having a plurality of openings located therethrough at 90° intervals in positions corresponding to the positions of the peripheral notches 129*n* in the feed wheel. The openings in the disc 146 are alignable with a photocell and a photoelectric sensor of a photoelectric device 147 supported on the station frame so that when the feed wheel is properly indexed the sensor is actuated to condition the controller 34 for the next processing step. However, if the feed wheel 129 is improperly indexed the sensor of the photoelectric device 147 is not actuated and the apparatus stops processing the wires 31 until the mis-indexing condition has been corrected.

The electrical contact wheel 136 is fixedly mounted on a free rotating shaft 148 (FIGS. 12 and 13) so that as each wire leading end portion 31LE is brought into engagement with the wheel, the shaft and the wheel rotate slightly, such as 5°. This reduces wear on the cutting edge of the contact wheel 136 since the cutting action of the wheel through the wire insulation is a rotary slicing action, as opposed to a pure friction slicing action, as would be the case if the wheel were fixed in position. This arrangement also exposes a different portion of the cutting edge of the contact wheel 136 to each successive wire portion 31LE, whereby the entire periphery of the cutting edge is utilized, thereby prolonging the life of the contact wheel.

The contact wheel 136 may be mounted on the station frame for adjustment relative to the feed wheel 129 and for connection to the controller 34 in any suitable manner. For example, the illustrated embodiment of the invention, the contact wheel shaft 148 is journalled in an offset passageway through an insulating sleeve 149 so as to be eccentric to the longitudinal axis of the sleeve, as illustrated in FIG. 12, and the sleeve is releasably secured against rotation in the station frame by a set screw 151, as shown in FIG. 13. Thus, by rotating the sleeve 149 in its mounting, a fine adjustment of the depth of cut by the contact wheel 136 can be attained. Electrical contact between the contact wheel 136 and the controller 34 is achieved by an insulated lead 152 and an electrical fork-like terminal 153 having a plurality of opposed leaf-spring contacts between which the contact wheel shaft 148 is received.

Figures 23, 24:
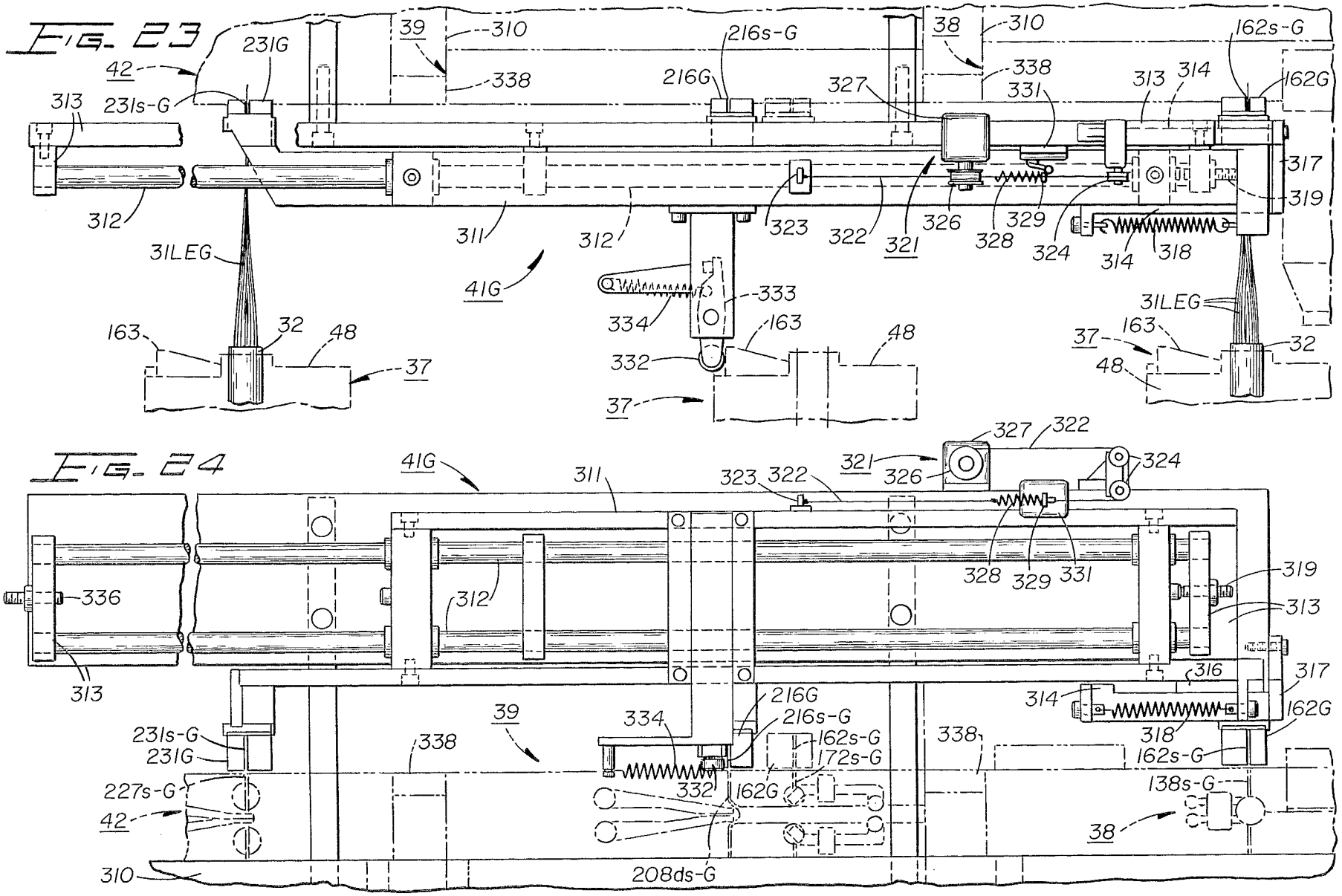
FIG. 23 is a plan view of an upper shuttle transfer mechanism of the apparatus shown schematically in FIG. 1.
FIG. 24 is a front elevational view of the shuttle transfer mechanism shown in FIG. 23.

Referring to FIGS. 11, 12, 23 and 24, after all of the wire leading end portions 31LE have been fed into the upper and lower vertical wire-receiving slots 138s-G and 138s-S, the controller 34 energizes a rotary solenoid 154 (FIGS. 11 and 12) to load the wire portions into the reciprocable upper and lower shuttle transfer mechanisms 41G and 41S (41G being shown in FIGS. 23 and 24). The rotary solenoid 154 includes a gear 157 which is engaged with a second gear 158 fixed on a pin pivoted in the station frame and having one end of an upper wire ejecting member 159 secured thereto, with an opposite end of the ejecting member extending adjacent the upper wire-receiving slot 138s-G. The second gear 158 is engaged with a third gear 161 (FIG. 12) fixed on a second pivot pin having a lower wire ejecting member 159 secured to the pin and having its opposite end extending adjacent the lower wire-receiving slot 138s-S. Thus, on operation of the rotary solenoid 154, the gear train 157, 158, 161 rotates the wire ejecting members 159 in opposite directions (counterclockwise and clockwise, respectively) to push the wire portions 31LE into aligned slots 162s (see 162S-G in FIGS. 23 and 24) in members 162 of the shuttle transfer mechanisms 41G and 41S.

As the conveyor 37 then is indexed, the carrier 48 in the wire fan-and-identify station 38 moves the gripped leading end portion of the cable 32 to the collating station 39, while upper and lower arms of a pusher member 163 (shown schematically in FIG. 23) on the carrier engage the upper and lower shuttle transfer mechanisms 41G and 41S to move the mechanisms and the desheathed wire portions 31LE therein to the collating station. The cable length 32L also is cut from the main cable 32 by operation of the cutter mechanism 40 adjacent the cable feed rollers 46 as previously described, and the trailing end of the cut length drops onto the auxiliary conveyor 44. Subsequently, a new leading end portion of the cable 32 is fed from the supply reel 32S, through the newly aligned set of clamping jaws 49 of the next main conveyor carrier 48 and into the cable desheathing mechanism 36, whereupon the new leading end portion of the cable is desheathed as above described.

Figure 14A:
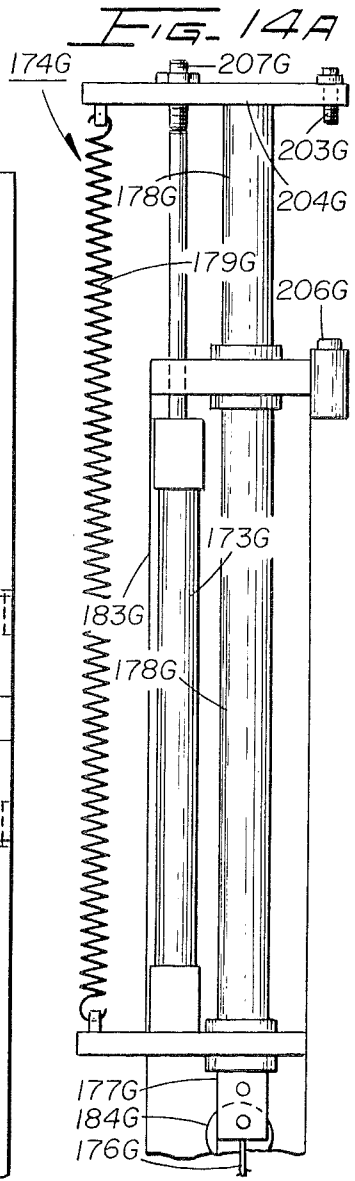
FIGS. 14 and 14A are front elevational views of a wire collating station of the apparatus shown schematically in FIG. 1.
Figure 14:
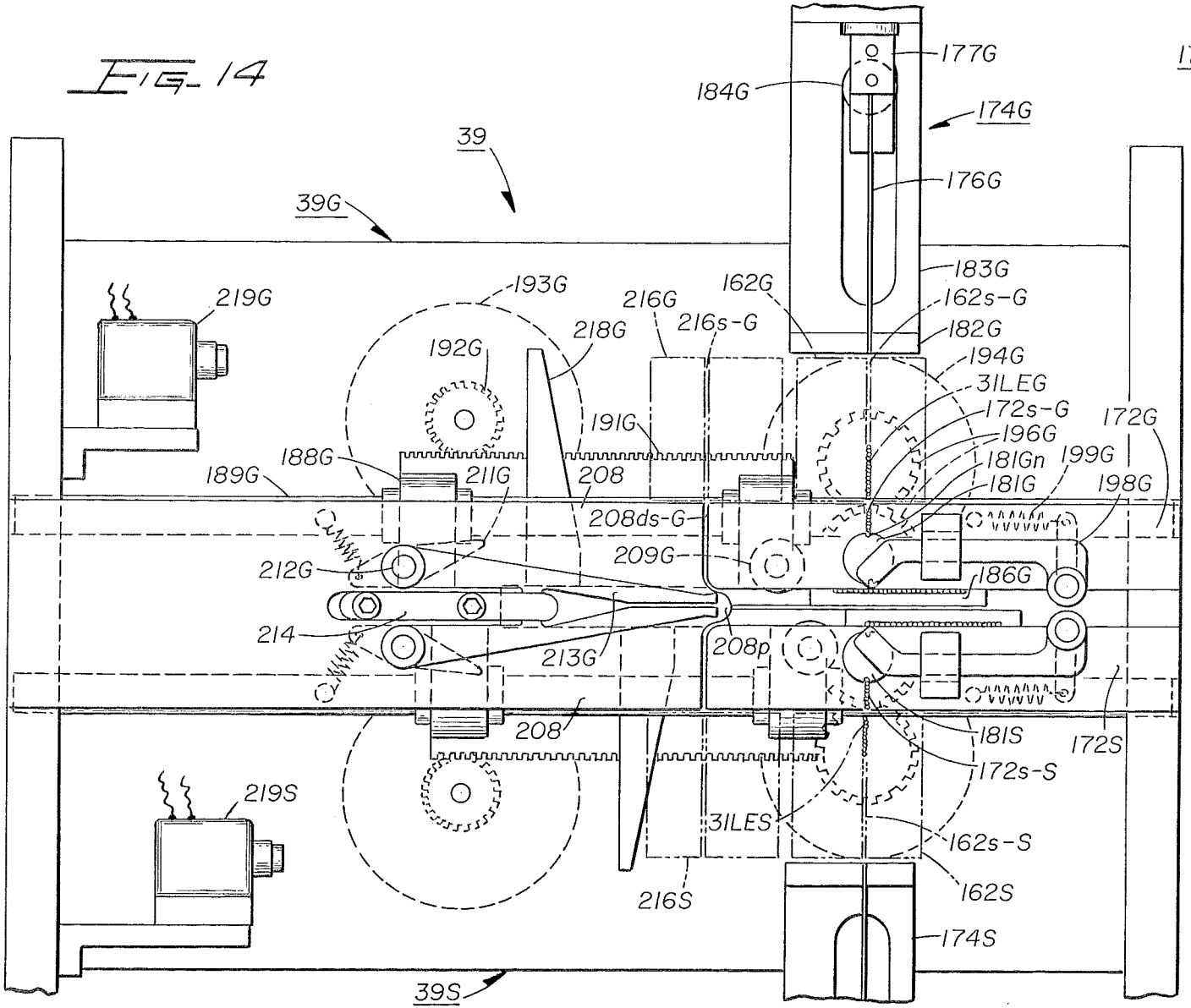

Wire Collating Station (FIGS. 14, 15 and 16)

The conveyor 37 moves the shuttle transfer mechanisms 41G and 41S so that, as is best shown in FIG. 14, the slots 162s-G and 162s-S of the shuttle members 162G and S, which contain the sorted cable wire leading end portions 31LEG and 31LES, are brought in alignment with respective upper and lower wire holding feed-in slots 172s-G and 172s-S formed in upper and lower frame members 172G and 172S of the wire collating station 39. An air cylinder 173G (FIG. 14A) of an upper wire feed-in mechanism 174G then is de-energized to permit a vertically movable pusher blade 176G, which is fixedly mounted by an interconnecting member 177G on the lower end of a slidably mounted vertical rod 178G, to be moved downward by a coil spring 179G to push the ground wire portions 31LEG from the slot 162s-G into the upper wire holding feed-in slot 172s-G toward a notched upper feed wheel 181G. Twisting of the pusher blade 176G during this vertical movement is precluded by a forwardly projecting slotted guide member 182G fixed to the lower end of a vertical support member 183G, and a roller 184G mounted on the interconnecting member 177G and disposed in a guide slot in the vertical support member. At the same time, an identical lower wire unloading mechanism 174S pushes the signal wire portions 31LES in the slot 162s-S into the lower wire holding feed-in slot 172s-S toward a notched lower feed wheel 181S.

The collating station 39 includes, in effect, an upper ground wire processing unit or substation 39G and a lower signal wire processing unit or substation 39S, of which the unloading mechanisms 174 and the feed wheels 181 form respective parts. Since each of the upper and lower processing substations 39G and 39S is capable of functioning independently of the other, and since in other respects they are identical, only the upper substation 39G will be described further in detail.

The upper feed wheel 181G is journalled in the frame of the collating station 39 and has a pair of wire receiving notches 181Gn on opposite sides of its periphery 180° apart, with each of the notches being dimensioned so as to receive only one of the cable wire portions 31LEG at a time. Disposed beneath the feed wheel 181G for receiving the cable wire portions 31LEG therefrom in their proper wiring order, is a wire rack 186G having a plurality of upwardly facing wire-receiving notches, one for each of the wire portions, formed in its upper surface. The wire rack 186G is fixedly mounted by means of a bracket plate 187G (FIG. 15), on a slide assembly 188G which is reciprocably mounted, by means of suitable bushings, on horizontally-spaced guide shafts 189G having their opposite ends fixedly mounted in the station frame. A gear rack 191G is fixedly mounted along one side of the slide assembly 188G and is engaged by a drive gear 192G on the shaft of a stepping motor 193G secured to the station frame.

As the ground wire portions 31LEG are urged downward in the wire holding feed-in slot 172s-G toward the feed wheel 181G by the spring-biased pusher blade 176G, the leading (lower) wire portion becomes received in the feed wheel notch 181Gn which is then in alignment with the discharge end of the slot. The controller 34, having stored information as to the identity and actual numerical position of the leading wire (in this case, position "one"), then compares the actual numerical position of the wire with its proper numerical wiring position for connection to the plug 33, and applies the necessary number of pulses to the stepping motor 193G to index the wire rack 186G in the proper direction so that the notch therein corresponding to the proper numerical wiring position for the wire portion comes directly opposite the feed wheel 181G. The controller 34 then causes the feed wheel 181G to be rotated 180° by another stepping motor 194G mounted on the frame of the collating station 39, through a set of gears 196G on this motor's drive shaft and a mounting shaft 197G of the feed wheel, respectively. This causes the leading wire portion 31LEG in the wire holding feed-in slot 172s-G to be carried by the feed wheel 181G to a position opposite its respective notch in the wire rack 186G, where it is cammed out of the notch in the feed wheel into the notch in the wire rack by one end of a pawl member 198G, which is pivoted at its opposite end on the station frame. For this purpose, the pawl member 198G also is biased counterclockwise in FIG. 14 by a spring 199G connected between the station frame and a lever arm integral with the pawl member.

The foregoing procedure then is repeated for each of the cable wire portions 31LEG in the upper wire holding feed-in slot 172s-G, until each of the wire portions has been positioned in its respective notch in the upper wire rack 186G.

As in the case of the stepping motor 144 (FIG. 9) in the wire fan-and-identify station 38, the shaft of the feed wheel stepping motor 194G(FIG. 15), on the opposite end from that on which its drive gear 196G is mounted, is provided with a reference disc 201G having openings corresponding to the positions of the peripheral notches in the feed wheel 181G and alignable with a photocell and a sensor of a photoelectric device 202G to determine whether or not the feed wheel has been properly indexed on each wire feeding cycle.

When the last ground wire portion 31LEG in the feed-in slot 172s-G has been removed therefrom, an adjustably mounted screw 203G (FIG. 14A) on a horizontal arm 204G which is fixed to the upper end of the vertical rod 178G of the wire feed-in mechanism 174G, operates a limit switch 206G to energize the air cylinder 173G, the piston rod of which acts on a second adjustably mounted screw 207G on the arm to return the rod and the blade 176G to their upper retracted position. Closing of the limit switch 206G also causes horizontal retraction of the upper shuttle mechanism 41G in a manner described herein under the heading "Shuttle Transfer Mechanisms". If the limit switch 206G is not closed, indicating that one or more wire portions 31LEG have become hung up in the feed-in slot 172s-G, the controller 34 stops the apparatus until the condition is corrected. Further, to avoid premature operation of the limit switch 206G as a result of the pusher blade 176G causing excessive compressing of the insulation of the wire portions 31LEG in the feed-in slot 172s-G, the coil spring 179G is selected to exert only enough force on the wire portions to produce reliable feeding thereof, e.g., one pound of pressure on the leading (lower) wire portion.

Next, as viewed in FIGS. 14 and 15, the slid assembly 188G is moved to the left by the stepping motor 193G in response to pulses from the controller 34. During this movement the wire portions 31LEG in the notches of the wire rack 186G sequentially engage a protruding nose portion 208p on a frame member 208 common to both of the upper and lower collating substations 39G and 39S, such that the wire portions are cammed out of their respective rack notches upwardly into a vertical discharge slot 208ds-G defined by opposing surfaces of this frame member and the upper frame member 172G. Subsequently, a cam 209G on the slide assembly 188G engages a spring-biased lever arm 211G, which is fixed to one end of a pin 212G rotatably mounted in the station frame, to rotate the pin counterclockwise in FIG. 14. This causes an outer end portion of a wire discharge arm 213G, fixed to the opposite end of the pin 212G and biased against a stop member 214 suitably mounted on the frame member 208 end common to both of the substations 39G and 39S, to engage and push the wire portions 31LEG from the discharge slot 208ds-G into an aligned wire-receiving slot 216s-G in a member 216G of the upper shuttle transfer mechanism 41G.

After the ground wire portions 31LEG have been discharged, the slide assembly 188G is indexed further to the left in FIG. 14 by the motor 193G until an upstanding bar 218G on the slide assembly closes a motor reversing limit switch 219G mounted on the station frame, in a manner subsequently described herein in greater detail under the heading "Collate Control Circuits". Subsequently, on the next indexing of the conveyor 37 and the upper shuttle transfer mechanism 41G, the member 216G transfers the collated wire portions 31LEG to the wire subgroup rotating station 42.

Figure 18:
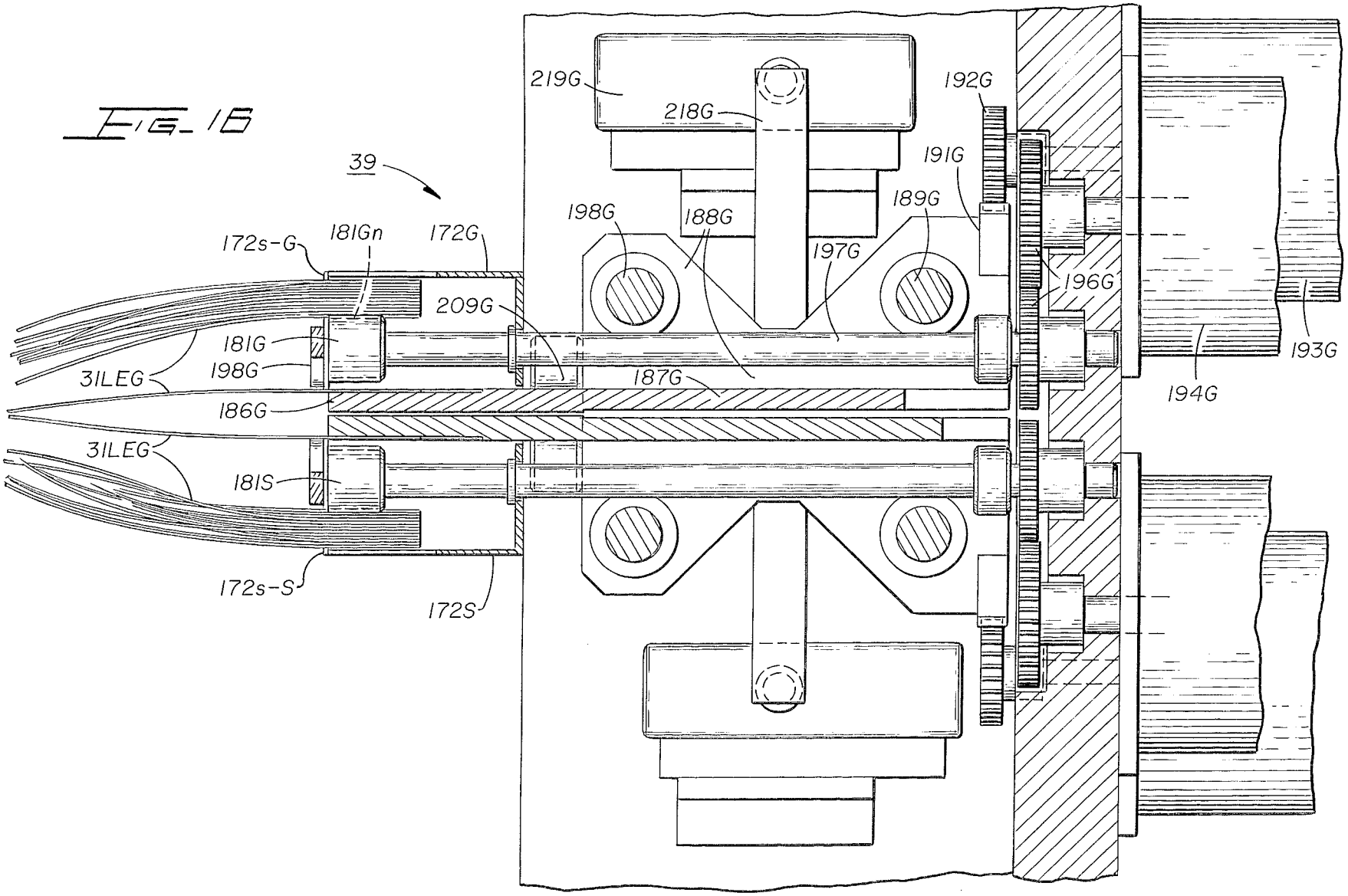
FIG. 18 is a front elevational view of the wire subgroup rotating station shown in FIG. 17.
Figure 17:
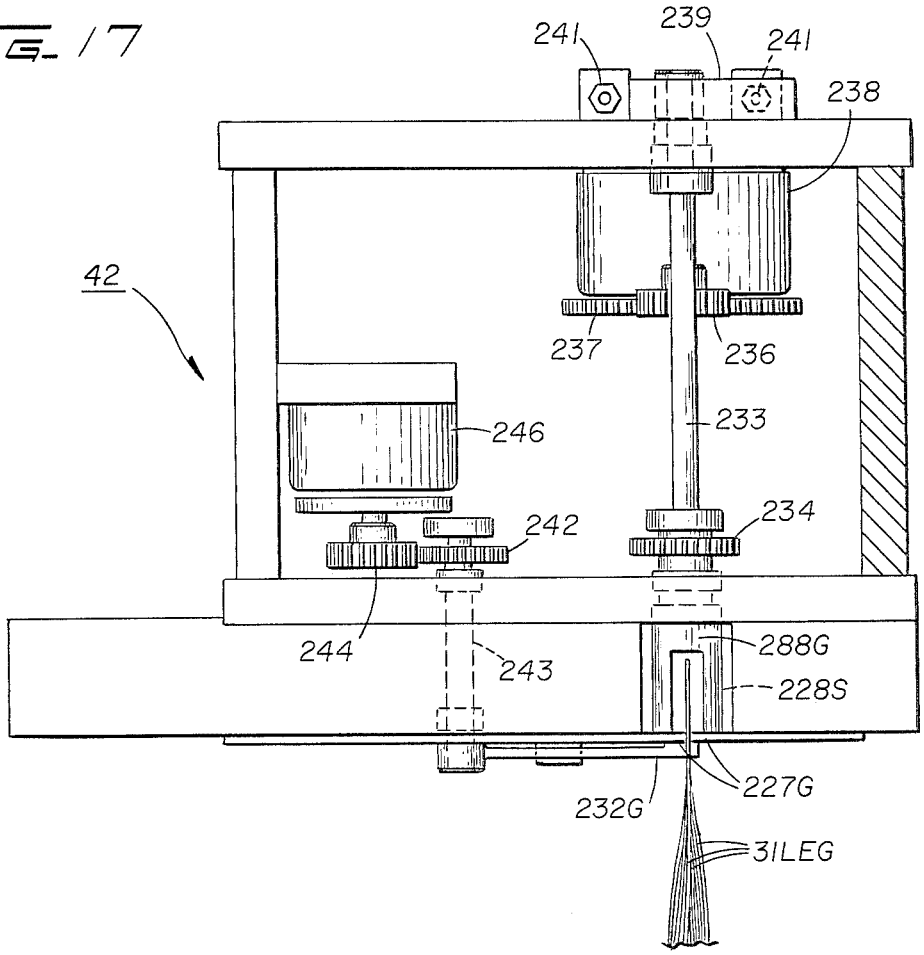
FIG. 17 is a plan view of a wire subgroup rotating station of the apparatus shown schematically in FIG. 1.
Figure 18:
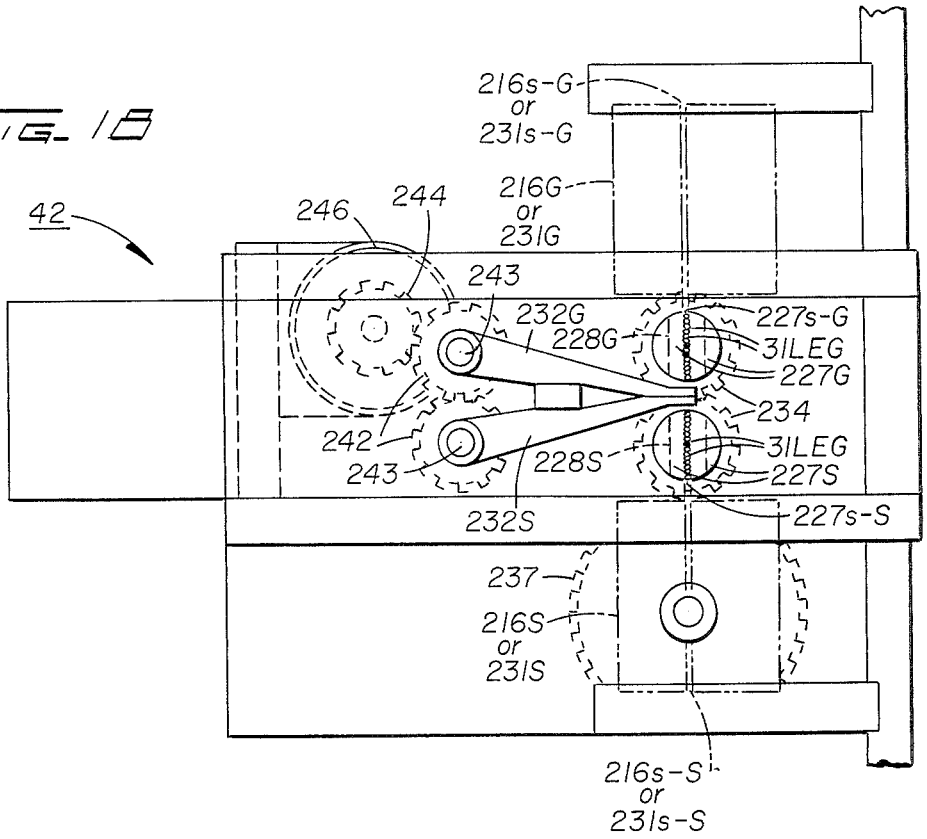
Figure 19:
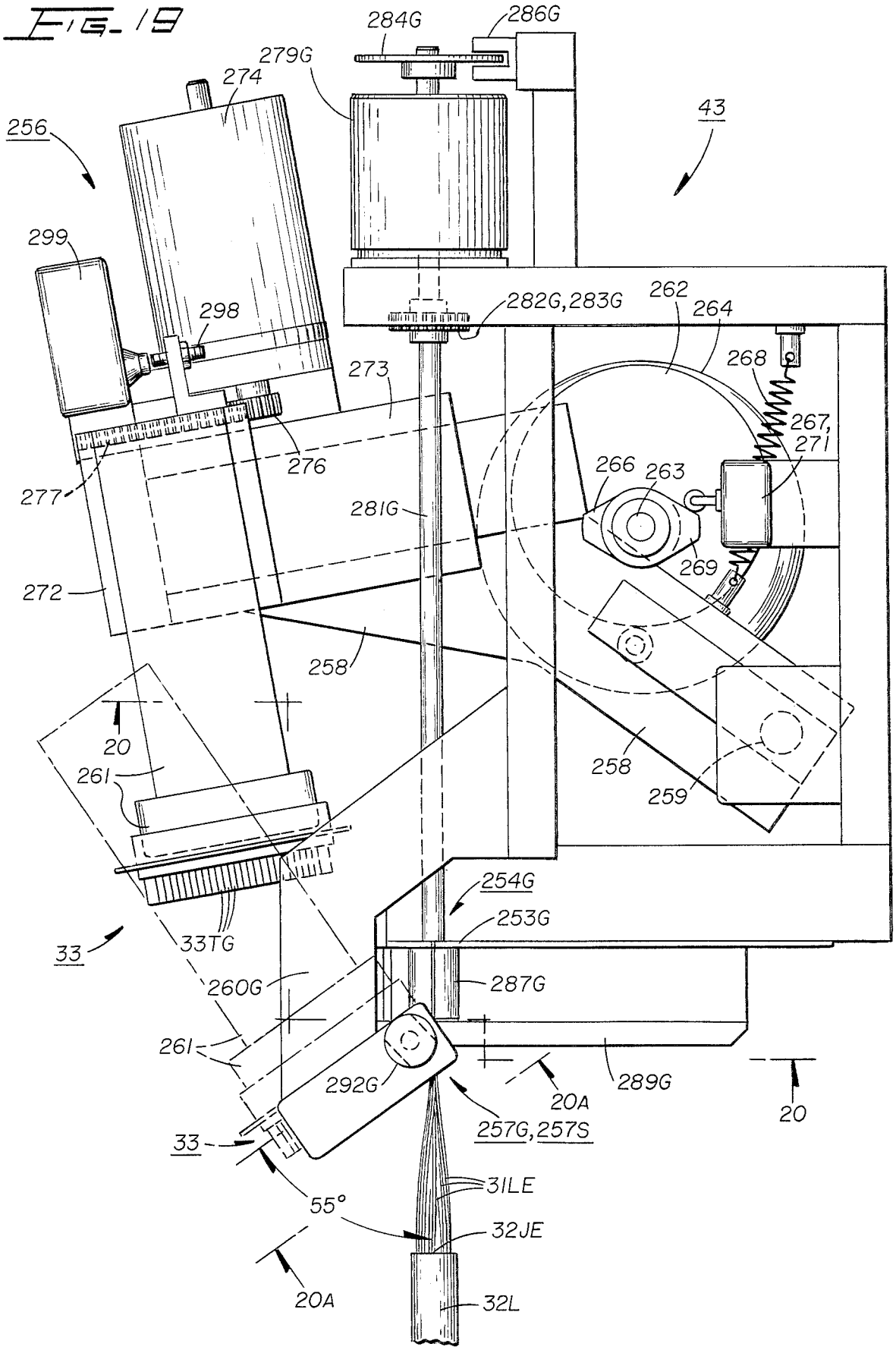

Wire Subgroup Rotating Station (FIGS. 17 and 18)

In discharging of the wire leading end portions 31LEG and 31LES in their respective upper and lower subgroups from the wire fan-and-identify station 38 and the wire collating station 39 as above described, a 90° twist is inherently placed in each of the wire subgroups as a result of the discharge operation, whereby each of the wire subgroups now received in the second shuttle members 216G and S contain a 180° twist between the cable jacket leading end 32JE and the outer ends of the wire portions. Where relatively long (e.g., five inches) unsheathed wire portions 31LEG and 31LES are to be utilized, this twist in the wire subgroups presents no particular problem from the standpoint to connecting the wire portions to the cable plug 33. However, in the illustrated embodiment of the invention, where the unsheathed wire portions 31LEG and 31LES are to be trimmed to a shorter length (e.g., three inches) prior to connection to the cable plug 33, this twist in the wire subgroups interferes with proper connection of the wires to the plug. Accordingly, the twist in the wire subgroups is removed therefrom in the wire subgroup rotating station 42.

Specifically, the second shuttle members 216G and 216S are advanced into the rotating station 42 by the conveyor 37 so that the slots 216s-G and 216s-S containing the cable wire portions 31LEG and 31LES are in alignment with slots 227s-G and 227s-S defined by respective sets of opposed disc halves 227G and 227S. The disc halves 227G and S are secured to the front ends of respective spaced legs of forked cylindrical members 228G and S journalled in a station frame. The wire portions 31LEG and 31LES then are pushed from the shuttle member slots 216s-G and S into the slots 227s-G and S by upper and lower wire feed-in mechanisms (not shown) of the same type as the wire feed-in mechanism 174G (FIGS. 14 and 14A) described hereinabove in connection with the wire collating station 39. When the shuttle transfer mechanisms 41G and S then are retracted, third wire receiving members 231G and S thereof are moved into the wire rotating station to align wire receiving slots 231s-G and S in these shuttle members with the station slots 227s.

The upper cylindrical member 228G and its disc halves 227G then are rotated 180° counterclockwise and the lower cylindrical member 228S and its disc halves 227S are rotated 180° clockwise, as viewed in FIG. 18, to remove the twist from the wire portions 31LEG and 31LES. Upper and lower wire discharge levers 232G and S on the station frame then are pivoted counterclockwise and clockwise, respectively, to push the now untwisted wire portions 31LEG and 31LES from the slots 227s and into the wire receiving slots 231s of the shuttle members 231. The disc halves 227, cylindrical members 228 and levers 232 then are moved back to their initial positions in readiness for the next cycle of operation. On the next indexing step of the conveyor 37, the untwisted wire portions 31LEG and 31LES will be advanced in the shuttle members 231 into the wire-plug connectorizing station 43.

A mechanism for rotating the disc halves 227 and the cylindrical members 228 includes a pair of upper and lower drive shafts 233 fixedly connected to the cylindrical members, and intermeshed gears 234 fixed to the drive shafts adjacent the cylindrical members. Opposite end portions of the upper and lower drive shafts 233 are journalled in the station frame, and a third gear 236 is fixed on the lower shaft in meshing engagement with a gear 237 fixed on an output shaft of a rotary solenoid 238 mounted on the station frame. The solenoid 238 is of a known spring-return type having a rotation capacity of 95° when energized, and the ratio of the gears 236 and 237 is 2 to 1, to provide a possible rotation capability of 190° for the lower drive shaft 233. Rotation of the lower drive shaft 233 to the desired 180° is limited by a stop arm 239 fixed on an outer end portion of the shaft and alternately engageable with adjustable set screws 241 (FIG. 17) mounted on the station frame.

The discharge levers 232 are pivoted by a mechanism including a pair of upper and lower meshed gears 242 fixedly mounted on pivot shafts 243 for the levers adjacent inner ends (FIG. 17) of the shafts. The upper gear 242 is meshed with a third gear 244 fixedly mounted on an output shaft of a second rotary solenoid 246 mounted on the station frame and of a known spring-return type having a rotation capacity on the order of 25°. Thus, energization of the rotary solenoid 246 in one direction causes pivoting of the discharge levers 232 to push the wire portions 31LEG and 31LES from the disc slots 227*s* into the third shuttle members 231, and de-energization of the solenoid causes the levers to be returned to their initial positions.

Wire-Plug Connectorizing Station (FIGS. 19-22)

Figure 19:
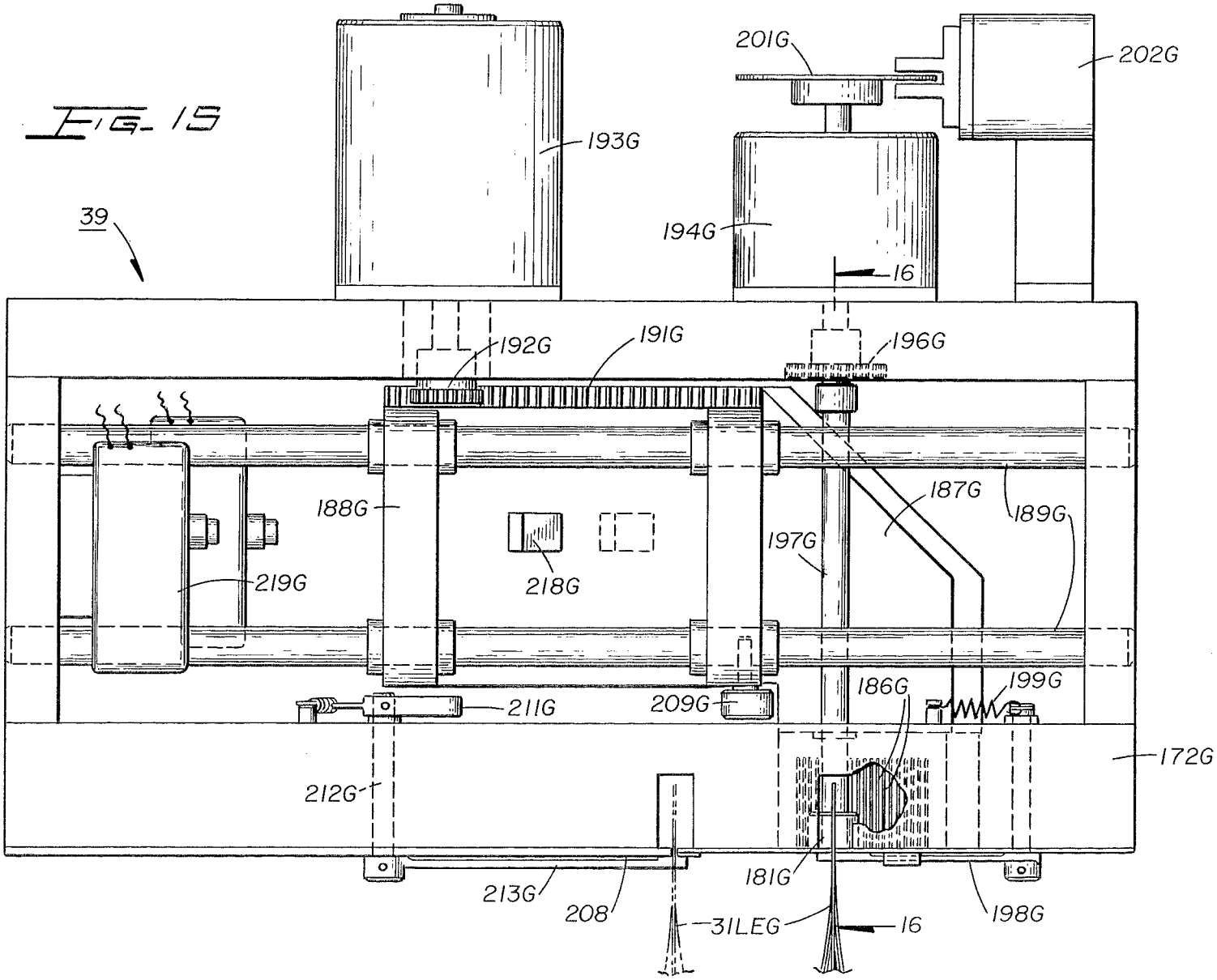
FIG. 19 is a partial plan view of a wire-plug connectorizing station of the apparatus shown schematically in FIG. 1, with a connector plug feeding portion thereof not shown.
Figures 20, 22:
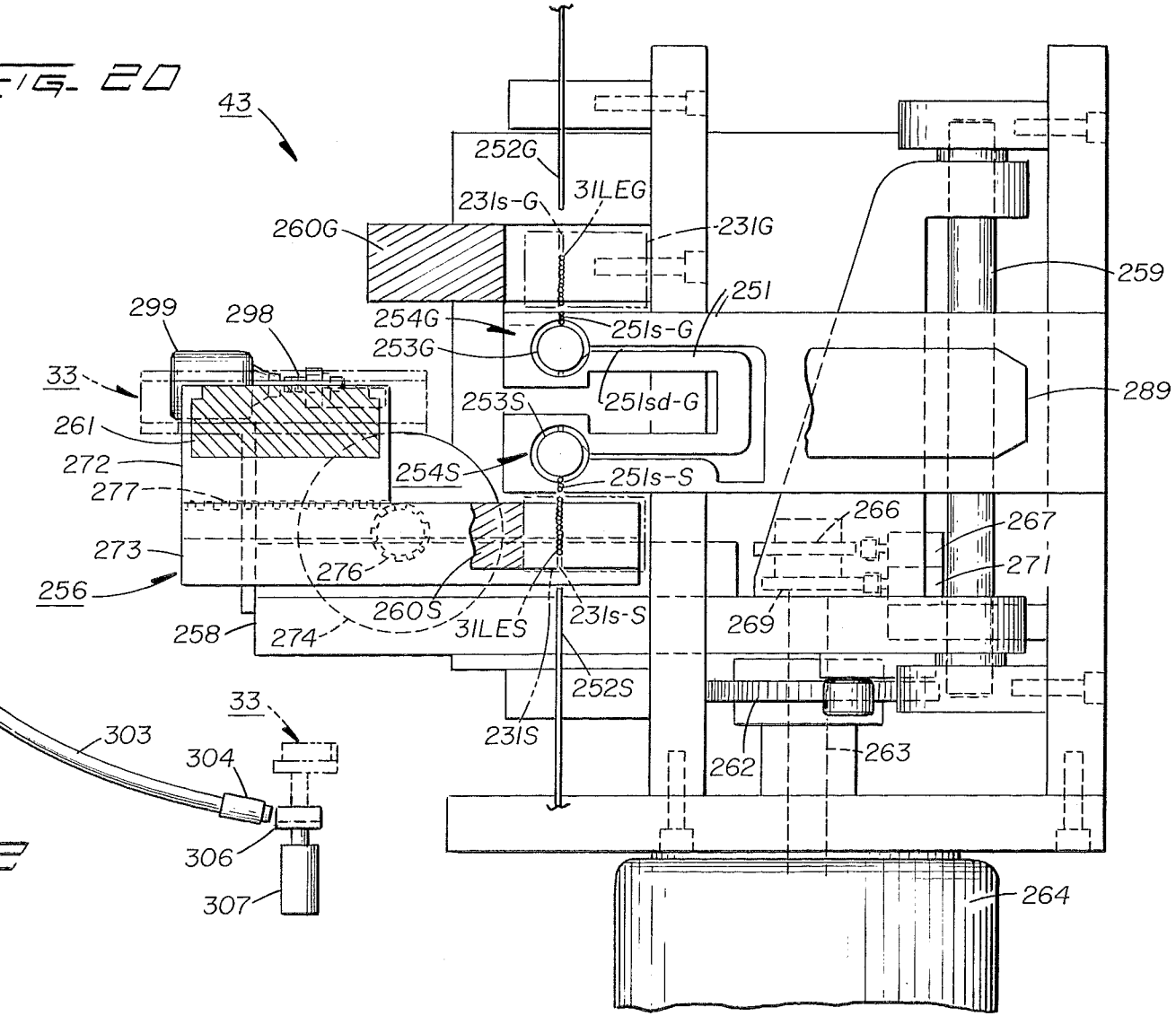
FIG. 20 is a front elevational view, partially in cross-section, of the connectorizing station as shown in FIG. 19, and as viewed substantially along the line 20—20.
FIG. 22 is a schematic front elevational view illustrating a plug feeding mechanism of the wire-plug connectorizing station.

Referring to FIG. 20, the upper and lower wire leading end portions 31LEG and 31LES in the members 231G and S of the shuttle mechanisms 41G and S are advanced into the wireplug connectorizing station 43 so that the slots 231s-G and S of the shuttle members are in alignment with respective upper and lower feed-in slots 251s-G and 251s-S defined by opposed edges of a plurality of plate members 251 fixedly mounted on a station frame. An upper wire feed-in mechanism 252G, which is identical to the wire feed-in mechanism 174G in the wire collating station 39, then is operated to push the upper wire portions 31LEG in the upper shuttle member 231G downward into the upper feed-in slot 251s-G until the first wire portion is received in one of two peripheral notches (180° apart) in a feed wheel 253G of a rotatable wire feeding mechanism 254G. At the same time, an identical lower wire feed-in mechanism 252S pushes the lower wire portions 31LES upward into the lower feed-in slot 251s-S until the first of the lower wire portions is received in one of two peripheral notches in a feed wheel 253S of a lower rotatable wire feeding mechanism 254S. The upper and lower wire end portions 31LEG and 31LES then are inserted into their respective terminals 33TG and TS of one of the cable connector plugs 33 in sequence by the rotatable wire feeding mechanisms 254G and 254S, in cooperation with a connector plug indexing mechanism 256 (FIGS. 19 and 20) and identical upper and lower wire inserting heads 257G (FIG. 20A) and 257S (not shown).

More specifically, a horizontally-disposed support arm 258 is mounted in cantilever fashion adjacent an inner end on a vertical pivot shaft 259 journalled in the station frame, and carries the connector plug indexing mechanism 256 adjacent its opposite outer end. The upper and lower wire inserting heads 257G (FIG. 20A) and 257S (not shown) are secured on the outer ends of projecting support brackets 260G and 260S (FIG. 20) having their inner ends fixedly mounted on the station frame. Initially, the support arm 258 is pivoted counterclockwise in FIG. 19 to locate the cable connector plug 33, which has been pre-fed onto an outer end of a holder 261 of the indexing mechanism 256 in a manner subsequently described herein, between the upper and lower wire inserting heads 257G and 257S. Pivoting of the arm 258 is accomplished by a cam 262 fixed to a drive shaft 263 of a torque motor 264 which is energized and de-energized from the controller 34. Stopping of the torque motor 264 to locate the cable connector plug 33 in the desired position between the wire inserting heads 257G and 257S is achieved by a first control cam 266 on the motor shaft 263 engaging a limit switch 267 on the station frame to de-energize the motor 264 after the shaft has been rotated 180°. Subsequently, after all of the wire leading end portions 31LEG and 31LES have been inserted into their respective terminals 33TG and TS in the cable connector plug 33, the torque motor 264 is again energized by the controller 34, and a coil spring 268 pivots the support arm 258 back toward its initial position under the control of the cam 262, with a second control cam 269 on the motor shaft 263 engaging a second limit switch 271 to again de-energize the motor 264 after 180° of rotation, to stop the support arm in its initial position.

Figure 20A:
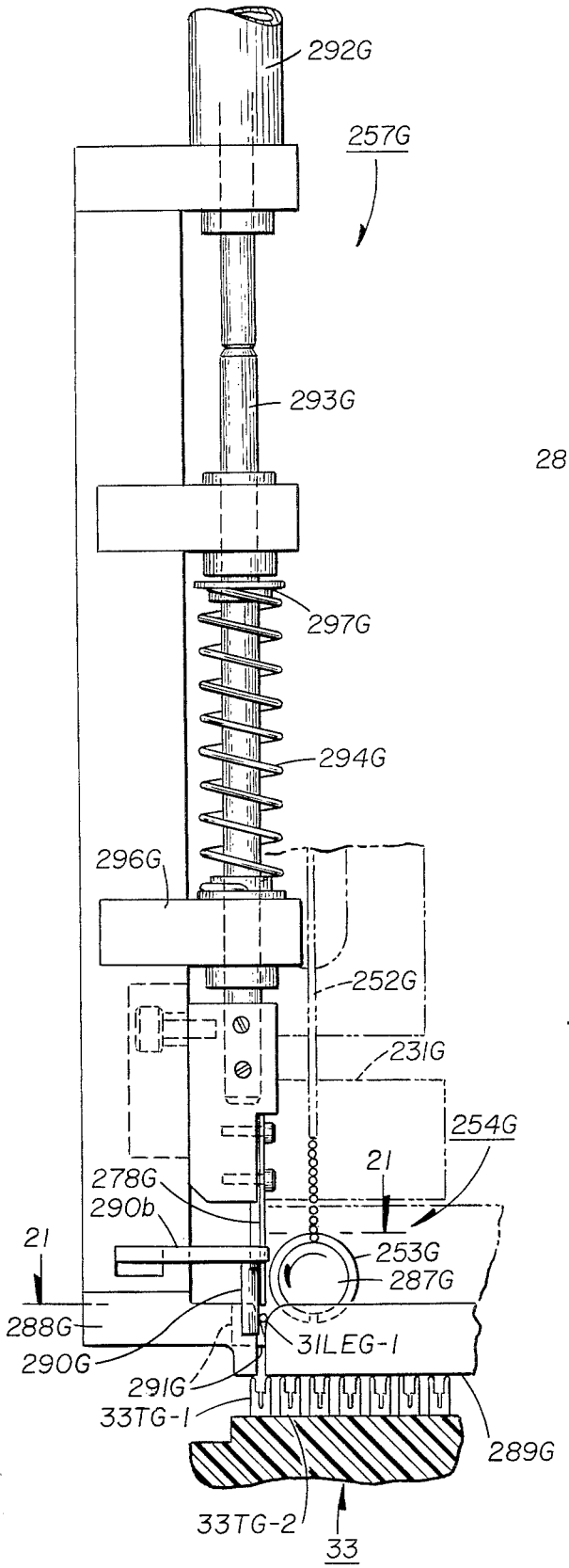
FIG. 20A is a front elevational view of a wire severing and inserting device of the connectorizing station, as viewed substantially along the line 20A—20A in FIG. 19, in a first operating position.
Figure 21:
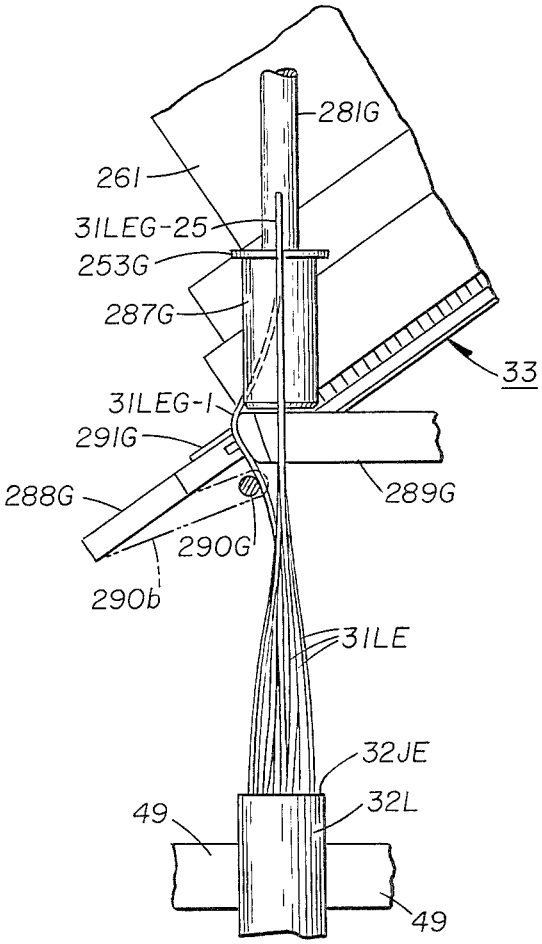
FIG. 21 is a cross-sectional view taken along the line 21—21 in FIG. 20A.

The outermost end of the plug holder 261 is of a suitable configuration for receiving the cable connector plug 33 thereon with a snug fit, and the innermost end of the plug holder is fixedly mounted on a slide 272 movable horizontally on a guideway 273 secured on the pivoted support arm 258. After the support arm 258 has been pivoted to position the cable connector plug 33 between the upper and lower wire inserting heads 257G and 257S, as illustrated by broken lines in FIG. 19, the slide 272 is driven by a stepping motor 274 to a right-hand position, as viewed in FIGS. 19 and 20, through a gear 276 on the motor's drive shaft and a gear rack 277 on the slide. This locates the first (left-hand in FIG. 20A) upper and lower terminals 33TG-1 and 33TS-1 (not shown) of the connector plug 33 in alignment with wire inserting blades 278 of the wire inserting heads 257G and 257S, as illustrated in FIG. 20A for the head 257G. Subsequently, for the insertion of the remaining wire portions 31LEG and 31LES in their respective plug terminals 33TG and TS, the slide 272 is indexed toward a left-hand position, as viewed in FIGS. 19 and 20, along a path extending at an angle on the order of 55° to the axis of the clamped cable length 32L, so that previously inserted wire portions will not be stretched and/or pulled out of their terminals by the indexing of the slide and the connector plug 33 thereon.

Since the insertion of the upper and lower wire leading end portions 31LEG and 31LES into their respective terminals 33TG and 33TS of the connector plug 33 is identical, only the insertion of the upper wire leading end portions will be described. After the first wire leading end portion 31LEG-1 has been received in one of the peripheral notches in the feed wheel 253G of the rotatable wire feeding mechanism 254G, the mechanism is rotated 180° by a stepping motor 279G to transfer the wire end portion into a position for insertion in the first terminal 33TG-1 of the connector plug 33. For this purpose, the rotatable wire feeding mechanism 254G is fixed on one end of an elongated shaft 181G journalled in the station frame, and the opposite end of the shaft carries a gear 282G engaged with a gear 283G on the drive shaft of the stepping motor 279G. The stepping motor 279G, as in the case of the stepping motor 144 in the wire fan-and-identify station 38, carries a notched disc 284G on its drive shaft which cooperates with a photosensing device 286G connected to suitable circuitry in the controller 34, to insure that the rotatable wire feeding mechanism 254G has been properly indexed through 180° before processing of each wire leading end portion 31LEG continues in its respective wire inserting cycle.

As the wire feeding mechanism 254G rotates, the peripheral notch in the feed wheel 253G causes the wire leading end portion 31LEG-1 therein to partially wrap on a cylindrical mandrel 287G fixedly supported on an extension of the elongated shaft 281G. This causes the wire end portion 31LEG-1 to be guided into a wire-terminal connecting position in the form of a wire retaining slot which extends perpendicular to the path of indexing of the connector plug 33, best seen in FIG. 21, and which is defined by opposed surfaces of a member 288G of the wire inserting head 257G, and a plate member 289G fixedly mounted on the station frame. During the wrapping of the wire portion 31LEG-1 on the mandrel 287G, the wire portion also engages about a depending vertical guide post 290G mounted on the wire inserting head 257G by a bracket 290*b*, to facilitate the locating of the wire portion in the slot between the members 288G and 289G, and to establish a desired length (e.g., 3 inches) of the wire portion between the sheath edge 32JE (FIG. 21) of the cable length 32L and a fixed wire cutting blade 291G on the member 288G.

Figure 20B:
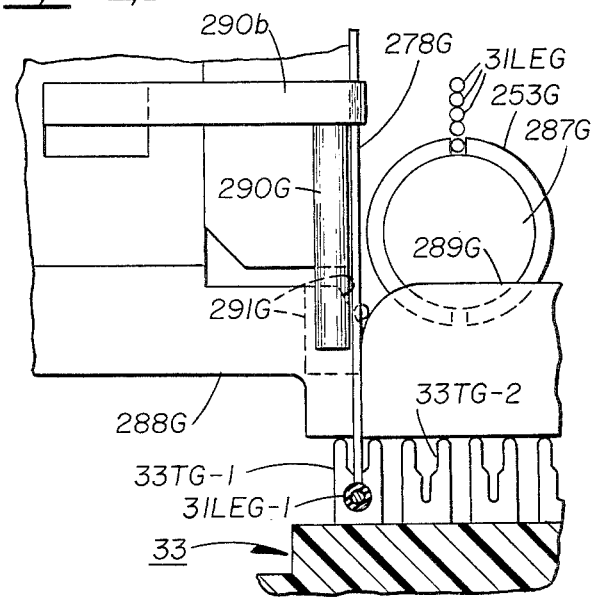
FIG. 20B is an enlarged front elevational view of a portion of the wire severing and inserting device shown in FIG. 20A, in a second operating position.

Referring to FIG. 20A, an air cylinder 292G of the wire inserting head 257G next is operated under the direction of the controller 34 to move a vertical plunger 293G, which has the wire inserting blade 278G fixedly mounted on its lower end, so that the blade moves the wire leading end portion 31LEG-1 downward. During this movement, the wire leading end portion 31LEG-1 is first moved past the fixed cutting blade 291G, which cooperates with the wire inserting blade 278G to cut the wire portion to the desired length, after which the inserting blade forces the wire portion into the plug terminal 33TG-1, as shown in FIG. 20B. The air cylinder 292G then is de-energized with the plunger 293G and the wire inserting blade 278G being returned back to their upper position by a coil spring 294G disposed between a guide bracket 296G for the plunger and a collar 297G fixed to the plunger.

The slide 272 of the connector plug indexing mechanism 256 next is stepped by the motor 274 to move the second plug terminal 33TG-2 beneath the wire inserting blade 278G, and the wire feeding mechanism 254G is rotated another 180° by the stepping motor 279G to feed the next wire leading end portion 31LEG-2 into the wire inserting position. The wire portion 31LEG-2 then is trimmed to length and inserted into the connector plug terminal 33TG-2 by downward movement of the wire inserting blade 278G. This procedure is repeated for all of the wire leading end portions 31LEG-3 through -25 until all of the connector plug terminals 31TG-3 through -25 have received their respective wires. As the plug holder 261 then is returned to its original position, the clamped cable length 32L may be relied upon to restrain the connector plug 33 against movement to pull it off of the holder, or a suitable latching device (not shown) may be operated to engage the plug and retain it against movement for this purpose.

Preferably, the slide 272 of the connector plug indexing mechanism 256 is indexed one additional increment by the stepping motor 274 after the insertion of the last wire leading end portion 31LEG-25 in the calbe connector plug 33 so that, if the stepping motor has properly indexed the connector plug 33 throughout the wire inserting cycle, an adjustable screw 298 on the slide closes a limit switch 299 connected to the controller 34 to condition the apparatus for continued operation. If the limit switch 299 is not closed, however, or is closed prematurely, indicating that the stepping motor has not indexed the connector plug 33 properly, and raising the possibility that the wire leading end portions 31LEG have been improperly connected to the plug so as to produce a defective product, suitable logic circuitry (not shown) in the controller 34 is not satisfied, the apparatus ceases to operate, and a signal (e.g., lamp) is energized to indicate to an operator that the station has malfunctioned.

After the first wire leading end portion 31LEG-1 has been cut to length and inserted in its respective plug terminal 33TG-1, on the next rotational indexing of the wire feeding mechanism 254G to move the next wire leading end portion 31LEG-2 into wire inserting position, the outer scrap portion of the first wire is carried by the feed wheel 253G to a discharge position where the scrap portion is cammed out of the peripheral notch in the feed wheel into a horizontal discharge slot 251sd-G (FIG. 20) defined by the plate members 251. As successive wire scrap portions are discharged into the slot 251sd-G, the preceding wire scrap portions are moved horizontally along the slot to the right in FIG. 20 until they reach a discharge point removed from the area of wire insertion, where they can drop into a suitable receptacle (not shown) without interfering with the wire insertion process.

The prepositioning of the cable connector plug 33 on the plug holder 261 may be accomplished automatically in any suitable manner. For example, referring to the schematic representation in FIG. 22, in the illustrated embodiment of the invention the cable connector plugs 33 are fed in succession from a suitable plastic-lined vibratory feeder bowl 302 and down a guide chute 303 to a suitable escapement mechanism 304, which releases the plugs one at a time into a nest on a vertically movable elevator member 306 normally located below the vertical level of the plug holder 261 (FIG. 19). The elevator member 306 then is moved upward by an air cylinder 307 to locate the connector plug 33 which is in the nest, in alignment with the arcuate path of movement of the plug holder 261, as illustrated by broken lines in FIG. 19. As the plug holder 261 then is pivoted with the support arm 258 by the cam 262 about the shaft 259, the outer portion of the holder is moved into the connector plug 33 with a pressfit. The elevator member 306 then is retracted down to its initial position by the air cylinder 307, whereupon the connecting station 43 is in condition for a wire-plug connectorizing operation as described hereinabove.

Shuttle Transfer Mechanisms (FIGS. 23 and 24)

Only the upper shuttle transfer mechanism 41G is shown and described in detail since the shuttle transfer mechanisms 41G and S are essentially identical in construction and operation, with certain minor exceptions. For example, the upper shuttle mechanism 41G is vertically disposed above a station support bed 310 of the apparatus, as shown in FIGS. 23 and 24, while the lower shuttle mechanism 41S preferably is horizontally disposed in a channel of the support bed in a suitable manner, not shown. Further, to distribute the impact stress on the conveyor 37, the shuttle mechanisms preferably are engaged by the conveyor for advancement purposes in the wire collating station 39 and the wire fan-and-identify station 38, respectively.

Thus, referring to FIGS. 23 and 24, the upper shuttle transfer mechanism 41G includes a rectangular main slide assembly 311 comprising opposed parallel upper and lower rails and vertical end members interconnecting the rails. The end members of the main slide assembly 311 are supported by suitable bushings upon spaced parallel guide shafts 312 having their opposite ends fixedly supported in members of an upstanding support frame 313.

The wire-receiving shuttle member 216G, for transferring a set of the wire leading end portions 31LEG from the wire collating station 39 to the wire rotating station 42, and the wire-receiving shuttle member 231G, for transferring a set of the wire portions from the wire rotating station to the cable plug-wire connectorizing station 43 (not shown in FIGS. 23 and 24), are fixedly mounted on one of the rails of the main slide assembly 311. The wire-receiving shuttle member 162G, for transferring a set of the wire leading end portions 31LEG from the wire fan-and-identify station 38 to the wire collating station 39, is fixed on a secondary slide assembly 314 which is mounted for lost motion movement on a depending member 316 (FIG. 24) of the main slide assembly 311 and biased against a stop member 317 on the support frame 313 by a coil spring 318 connected between the two slide assemblies.

The main slide assembly 311 is normally held in a retracted position as shown in FIGS. 23 and 24, with a projection on one of its vertical end members engaged with an adjustable stop screw 319 on the support frame 313, by a suitable retracting mechanism 321. In the illustrated embodiment of the invention, the retracting mechanism 321 includes a flexible cable 322 connected at one end to an upstanding pin 323 on the main slide assembly 311, trained over pulleys 324 mounted on the support frame 313, and wound at its opposite end on a drum 326 secured on the shaft of a torque motor 327. The cable includes a coil spring 328 having a member 329 secured to one end thereof for operating a motor de-energizing limit switch 331 on the support frame 313 as the coil spring is expanded by the shuttle transfer mechanism 41G engaging the stop screw 319 during a retracting operation, at which time the motor 327 is suitably braked in a known manner so that the coil spring 328 retains the shuttle mechanism in tight engagement with the stop screw. When the main slide assembly 311 is being thus held in its retracted position, the shuttle member 162G is located in the wire fan-and-identify station 38 with its wire-receiving slot 162s-G in alignment with the station's wire discharge slot 138s-G, the wire receiving member 216G is in the wire collating station 39 with its wire-receiving slot 216s-G in alignment with this station's wire-discharge slot 208ds-G, and the wire-receiving member 231G is located in the wire rotating station 42 with its wire-receiving slot 231s-G in alignment with this station's wire-receiving slot 227s-G.

In the embodiment of the invention shown in FIGS. 1-29, on alternate indexing cycles of the main conveyor 37, sets of the wire leading end portions 31LEG are discharged into the wire-receiving shuttle members 162G and 231G in the wire fan-and-identify station 38 and the wire rotation station 42, respectively. When the motor 327 then is debraked and permitted to free-wheel, and the main conveyor 37 is indexed under the direction of the controller 34, the upstanding pusher member 163 (FIG. 23) on the conveyor carrier 48 which is then in the collating station 39 engages a cam follower 332 mounted on an outer end of a lever arm 333 pivoted on the main slide assembly 311 and held against a stop member by a coil spring 334 connected between an opposite end of the arm and a fixed arm on the main slide assembly. The main conveyor 37 thus causes movement of the main slide assembly 311 to the left in FIGS. 23 and 24 until a projection on the second vertical end member of the slide assembly engages a second adjustable stop screw 336 on the support frame 313. Preferably, the main conveyor 37 then continues in its movement a short distance to pivot the lever arm 333 slightly, but without the cam follower 332 moving past the upstanding member 163, to produce a tight engagement of the slide assembly 311 with the stop screw 336.

Referring to FIG. 24, in the illustrated embodiment of the invention, the wire leading end portions 31LEG are fed into the collating station 39 in the feed-in slot 172s-G and discharged from the station through the slot 208ds-G and the distance which is traveled by the shuttle member 162G in a wire transfer operation is less than that which is traveled by the shuttle members 216G and 231G, by an amount corresponding to the distance between these two slots. Accordingly, during the initial movement of the main slide assembly 311, the secondary slide assembly 314 thereon, through the action of the coil spring 318, remains in a fixed position until the main slide assembly has traveled the distance corresponding to the spacing between the wire feed-in slot 172s-G and the wire discharge slot 208s-G in the collating station 39. The secondary slide assembly 314 then is engaged by its mounting member 316 of the main slide assembly 311 so that the two slide assemblies travel in unison toward their advanced position. Thus, when the main slide assembly 311 reaches its advanced position, the wire portions 31LEG carried by the shuttle members 162G and 231G will be in alignment with the wire feed-in slot 172s-G in the wire collating station 29 and the wire-receiving slot 251s-G (FIG. 20) in the plug-wire connectorizing station 43, respectively, for processing in these stations as above described. During the transfer operation, the wire leading end portions 31LEG are retained in the shuttle members 162G and 231G by the station frames and wire support rails 338 extending between the stations 38, 39 and 42.

Similarly, on second alternate indexing cycles of the main conveyor 37, a set of the wire leading end portions 31LEG are discharged into the wire-receiving shuttle member 216G in the collating station 39, and transferred to the wire rotating station 42 upon the indexing of the main conveyor 37.

After the wire leading end portions 31LEG have been unloaded from the shuttle transfer members 162G and 231G, or from the shuttle transfer member 216G, as the case may be, the motor 327 is energized to overcome (through the cable 322) the biasing spring 334 of the pivoted lever 333 so that the lever pivots and the cam follower 332 thereon rides past the upstanding pusher member 163 (FIG. 23) on the engaged conveyor carrier 48. The motor 327 then winds the cable 322 on the drum 326 to return the main slide assembly 311 to its retracted position. Then, when the main slide assembly 311 engages its stop screw 319, the coil spring 328 in the cable 322 is expanded until the member 329 operates the limit switch 331 to de-energize the motor 327, as above described.

Control System - General (FIG. 25)

Referring to FIG. 25, the sequence control circuit 34SCC of the controller 34 in the illustrated embodiment of the invention may include a punched tape control device of any suitable type capable of converting data information on a punched magnetic tape to electrical signals for directing certain sequencing operations of the apparatus, such as the feeding of the leading end of the cable 32 into the desheathing station 36 (FIG. 1), the indexing of the conveyor 37, the operation of the cable cutting mechanism 41, and the operation of the various wire feed-in mechanisms, motors and air cylinders at the different wire processing stations 36, 38, 39, 42 and 43, as above described. Since punched tape control devices of this type and the manner of interfacing such devices with suitable sequencing circuitry are common practice and well known in the art, the sequencing control circuit 34SCC has been shown only in block diagram form to illustrate the relationship thereof with other specific unique circuitry suitable for carrying out applicants' invention. It is to be understood that the control of the apparatus also may be accomplished utilizing a suitably programmed computer, such as a microprocessor, if so desired.

With regard to the illustrated embodiment of this invention, the controller 34 includes a diode matrix binary encoder 352 for sequentially identifying the cable wires 31 at the wire fan-and-identify station 38 and for feeding binary numbers representative of the wire numbers 31WN, and thus of the preselected wiring positions for the wires, into a ground wire memory 353GM or a signal wire memory 353SM in the numerical sequence in which the wires are identified. The encoder 352, in cooperation with a control circuit 354 for the feed wheel 129 (FIGS. 10–12) at the wire fan-and-identify station 38, also determines into which of the upper and lower slots 138s at the station each leading wire end portion 31LE is discharged by the feed wheel. The memories 313GM and SM, which store the binary number information as to the preselected wiring positions of the wire end portions 31LE, subsequently cooperate with a pair of respective control circuits 356GC and 356SC (FIG. 29) for the upper and lower substations of the collating station 39 (FIGS. 14–16), to control the feeding of the randomly positioned wire end portions into their proper wiring order in the wire receiving racks 186 at the collating station. Sequential operation of the memories 353, and the control circuits 354 and 356, for wire identification and collating purposes, is achieved by a memory select circuit 357 and by a mode control circuit 358 (FIG. 26) connected to receive high potential clock pulses C1 and C2 from a two-phase clock oscillator 359, which also feeds the pulses C2 to the collate control circuits 356.

Identify-Collate Mode Control Circuit - FIG. 26

Figure 29:
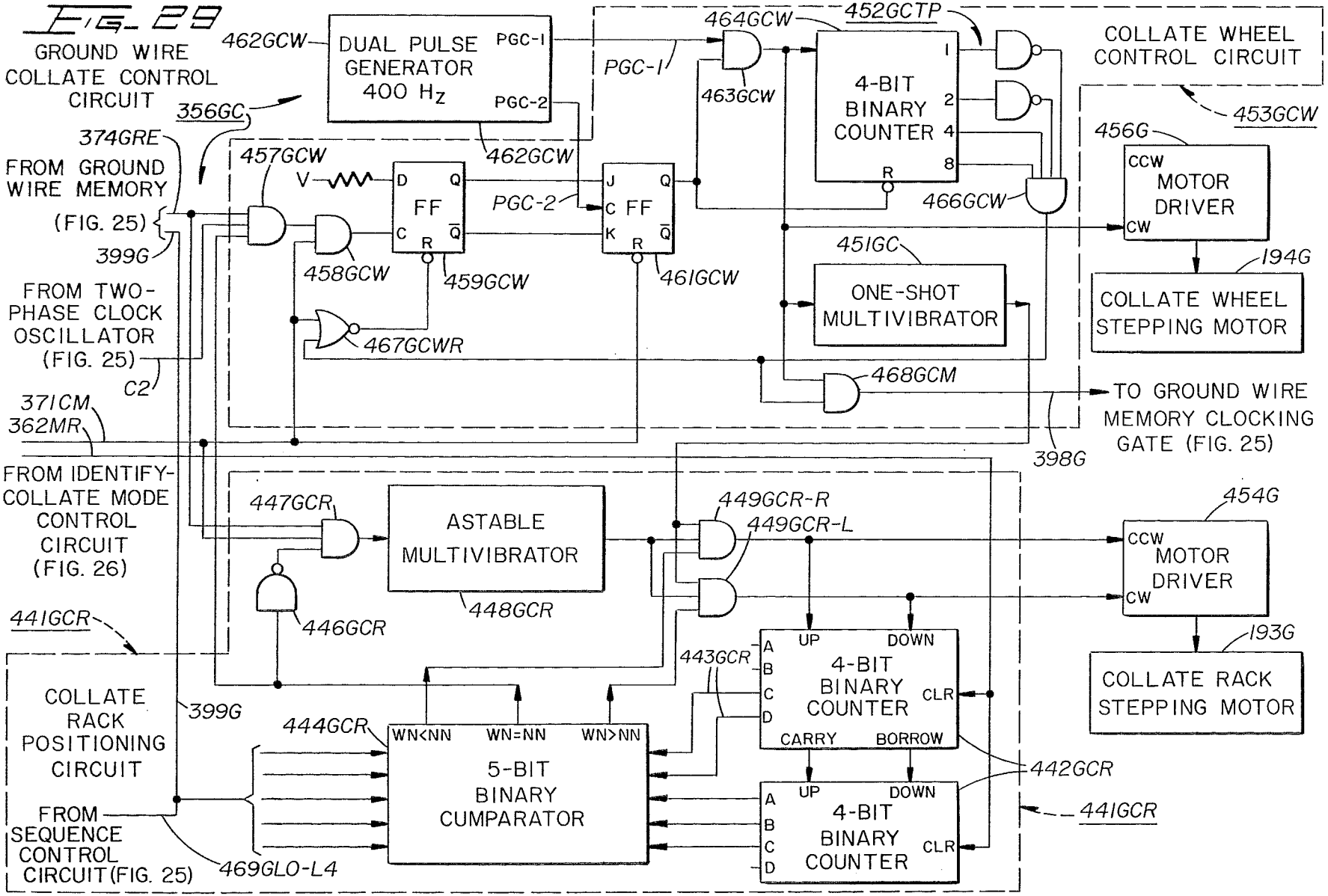
FIG. 29 illustrates a control circuit for the wire collating station shown in FIGS. 14–16.

Prior to each wire identification operation in the wire fan-and-identify station 38 (FIGS. 9–13), the sequence control circuit 34SCC applies a high potential to a first input of a master reset NOR gate 361MR in the identify-collate mode control circuit 358, shown in detail in FIG. 26. This causes a master reset output lead 362MR of the gate 361MR to change to a low potential, a portion of which is fed back to insure resetting of the identify-collate mode control circuit 358, and other portions of which are used to reset or clear the memories 353 (FIG. 25), and to reset the wire collate control circuits 356 (FIG. 29). This resetting of the system also may be accomplished by manually pressing a master reset button 363MR to apply a high potential to a second input lead of the reset gate 361MR.

With specific reference to the wire identify-collate mode control circuit 358 of FIG. 26, a portion of the low potential on the output lead 362MR of the NOR gate 361MR resets wire identify mode circuitry 364IDM by being applied to a reset terminal of a JK flip-flop 366IDM, and to a first input of a NOR gate 367IDM, the output signal of which then resets a D-type flip-flop 368IDM having output leads connected to respective inputs of the flip-flop 366IDM. the low potential output of the gate 361MR also resets similar wire collatemode circuitry 364CM including a JK flip-flop 366CM, a NOR gate 367CM and a D-type flip-flop 368CM.

The sequence control circuit 34SCC then applies a low potential inhibiting signal to a first input of a "start collate mode" AND gate 369SCM and a high potential signal to a first input of a "start identify mode" AND gate 369SIDM, a second input of which is being held at a high potential by an output of the JK flip-flop 366CM. Thus, when the next high-level first phase pulse C1 from the two-phase clock oscillator 359 (FIG. 25) is applied to a third input of the gate 369SIDM, the gate conducts to cause the D-type flip-flop 368IDM to change to a set state. Application of the next high-level second phase oscillator pulse C2 to a clock lead of the flip-flop 366IDM then causes this flip-flop to change state and produce a high potential on an identify mode output lead 371IDM thereof, to enable the memories 353 (FIG. 25) and the wire fan-and-identify control circuit 354 (FIG. 28) for the identifying of the wires 31 and the storing of their wire numbers 31WN. At the same time, a low potential is produced on a second output of the flip-flop 366IDM, which is applied to its respective input of the "start collate" mode AND gate 369SCM, to inhibit its operation. As identification of the wire leading end portions 31LEG and LES and the storing of their wire numbers WN in the memories 353GM and SM (FIG. 25) then is completed, "registers full" output leads 372GRF and 372SRF of the memories apply high potentials to inputs of a "registers full reset" AND gate 373RFR, causing it to conduct to reset the D-type flip-flop 368IDM through the NOR gate 367IDM. The J-K flip-flop 366IDM then is reset by the next positive pulse C2 from the clock oscillator 359 (FIG. 25), to disable the wire fan-and-identify feed wheel control circuit 354 (FIG. 28), and to condition the collate control circuits 356GC and SC (FIG. 29) for a wire collating operation.

Figure 28:
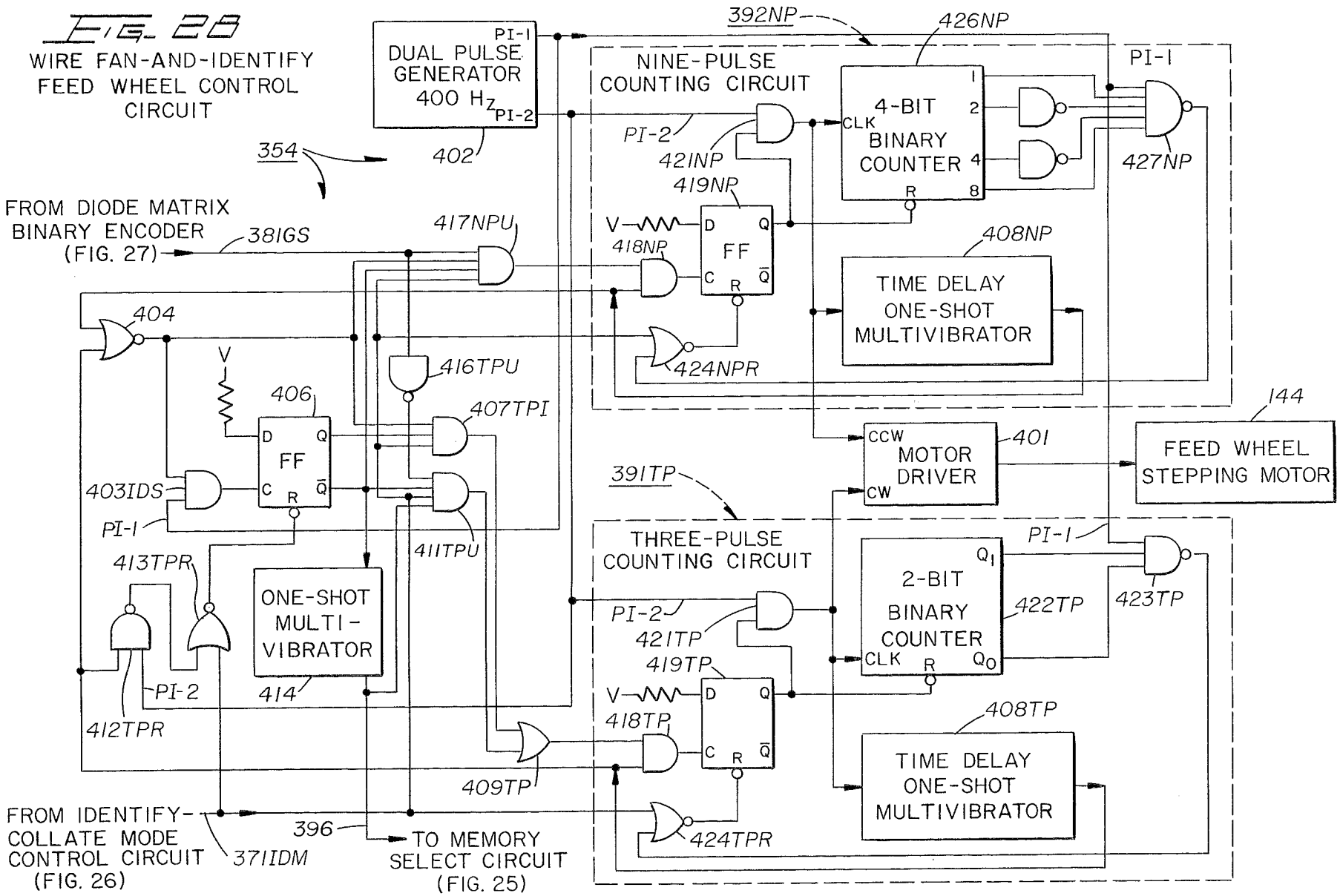
FIG. 28 illustrates a control circuit for the wire fan-and-identify station shown in FIGS. 9–13.

In this regard, after the fanned and identified wire leading end portions 31LEG and 31LES have been received in the feed-in slots 172s-G and 172s-S in the collating station 39, the sequence control circuit 34SCC applies a low potential to the first input of the "start identify mode" AND gate 369SIDM, to inhibit operation of this gate and thus of the wire fan-and-identify feed wheel control circuit 354 (FIG. 28), and also applies a high potential to the first input of the "start collate mode" AND gate 369SCM. Thus, when the next second phase oscillator pulse C2 is applied to a third input of the gate 369SCM from the clock oscillator 359, the gate applies a high potential output to a clock input of the D-type flip-flop 368CM to cause this flip-flop to change to a set state. When the next first phase oscillator pulse C1 then is applied to a clock lead of the flip-flop 366CM, a collate mode output 371CM of this flip-flop changes to a high potential, thereby enabling the wire collate control circuits 356 (FIG. 29) for the collating of the previously identified wire leading end portions 31LE. At the same time, a second output of the JK flip-flop 366CM changes to a low potential to inhibit operation of the "start identify mode" AND gate 369SIDM and the wire fan-and-identify feed wheel control circuit 354 (FIG. 28). When the wire collating operation is completed, "registers empty" output leads 374GRE and 374SRE of the memories 353 (FIG. 25) cause high potentials to be applied to respective inputs of a reset AND gate 376RER through a pair of inverting amplifiers, to reset the flip-flops 366CM and 368CM through the NOR gate 367CM. Application of the next positive pulse C1 of the clock oscillator 359 (FIG. 25) to the flip-flop 366CM, resets this flip-flop, causing its collate mode output 371CM to produce a low potential, to disable the collate control circuits 356, while its second output lead changes back to a high potential to condition the "start identify mode" AND gate 369SIDM for the next wire identification operation.

Diode Matrix Binary Encoder - FIG. 27

The binary encoder 352 is of a known diode matrix type with the exception of a group select output lead 381GS and a row of associated group select crosspoints 382GS for causing selective energization of the proper one of the memories 353GM or SM (FIG. 25) during the identification of a wire 31, and for applying a signal to the control circuit 354 (FIG. 28) for the feed wheel stepping motor 144 (FIGS. 9 and 28) to determine into which of the upper or lower slots 138s-G or S at the wire fan-and-identify station 38 (FIGS. 9–13) each wire end portion 31LE is fed by the feed wheel 129. Thus, with reference to FIGS. 25 and 27, the trailing ends of the fifty wires 31 (twenty-five twisted wire pairs) on the cable supply reel 32S are connected to respective matrix cross-points 383 of the binary encoder 352 in the numerical order into which they are to be sorted, that is, their proper numerical wiring positions in their respective subgroups. More specifically, the signal wire 31S of each wire pair is connected to a respective one of twenty-five "signal" leads 384S of the encoded matrix and the ground wire 31G in the pair is connected to a respective one of twenty-five "ground" leads 384G of the encoder matrix.

Accordingly, when the electrical contact wheel 136 (FIGS. 12 and 13) in the wire fan-and-identify station 38 (FIGS. 9–13) makes contact with a leading end portion of each wire 31 in the cable 32 (FIG. 1) to place a ground potential thereon, the binary encoder 352 operates in a known manner, through the matrix crosspoints 383 and amplifying gates 386, to generate a binary number which is representative of the wire number 31WN and which appears on five binary output leads 387L0–L4. At the same time, if the contacted wire 31 is a signal wire 31S and therefore is to be connected on the lower side of the cable connector plug 33 (FIG. 30), the wire's "signal" lead 384S is also grounded and a signal wire diode 388S between the signal wire lead and its associated ground wire lead 384G at the respective group select matrix crosspoint 382GS is reverse-biased so that the group select lead 381GS remains at a low potential to condition the signal wire memory 353SM (FIG. 25), and a three-pulse counting circuit 391TP (FIG. 28) associated with the feed wheel stepping motor 144, for operation. However, if the wire 31 is a ground wire 31G and therefore is to be connected on the upper side of the cable connector plug 33, grounding of the wire by the electrical contact wheel 136 causes a ground wire diode 388G to be forward-biased, placing the group select lead 381GS at a high potential to condition the ground wire memory 353GM (FIG. 25), and a nine pulse counting circuit 392NP for operation. The adjacent diode 388S also is forward-biased causing the wire number 31WN to appear on the five binary output leads 387L0–L4 as noted above.

Memory Select Circuit — FIG. 25

Referring to FIG. 25, the group select lead 381GS is connected to a first input of a signal wire AND gate 393S in the memory select circuit 357 through a signal inverting gate 394, and to a first input of a ground wire AND gate 393G in the memory select circuit. During a wire identification process, second inputs of the AND gates 393G and S are held at a high potential by the identify mode output lead 371IDM of the wire identify-collate mode control circuit 358 (FIG. 26). The grounding of a signal wire lead 384S in the binary encoder 352, whereby the group select lead 381GS remains at a low potential as above described, then produces a high potential on the first input of the signal wire gate 393S and a low potential on the first input of the ground wire gate 393G. Accordingly, when a high potential is applied on a third input of each of the gates 393S and G by an output lead 396 of the wire fan-and-identify control circuit 354 (FIG. 28), only the signal wire gate conducts to produce a high potential at its output. This high potential then is applied to an input of a signal wire NOR clocking gate 397S, a second input of which is being held at a low level by an output lead 398S of the signal wire collate control circuit 356SC, whereby this gate produces a negative signal on its output lead to clock the binary number on the output leads 387L0–L4 of the binary encoder 352 into the signal wire memory 353SM.

Similarly, when one of the cable ground wires 31G is identified as above described, whereby the group select lead 381GS is placed at a high potential, an inverted low potential appears on the first input of the signal wire AND gate 393S, while the high potential is applied to the first input of the ground wire AND gate 393G. In this case, the high potential signal from the output lead 396 of the wire fan-and-identify control circuit 354 (FIG. 28) causes the ground wire AND gate 393G to conduct and produce a high potential at its output. This high potential then is applied to an input of a ground wire NOR clocking gate 397G, a second input of which is being held at a low level by an output 398G of the ground wire collate control circuit 356GC, causing this gate to clock the binary number on the output leads 387L0–L4 of the binary encoder 352 into the ground wire memory 353GM.

Shift Register Memory — FIG. 25

Each of the memories 353GM and SM may be of any suitable type having 25 serially connected data storage positions for storing the wire numbers WN of the wires 31 during a wire identification operation, and capable of feeding the stored information to the collate control circuits 356 in a wire collating operation in the reverse order in which the information is stored. For example, each of the memories 353GM and SM may include six shift registers (not shown) which are capable of being shifted left or right in a known manner, with five of the registers being used to store the wire numbers WN of the wires 31 being identified, and the sixth register being used to produce signals on the "registers full" leads 372GRF and SRF, and the "registers empty" leads 374GRE and SRE, for control purposes.

More specifically, in the illustrated embodiment of the invention, during the identifying of the cable wires 31 at the wire fan-and-identify station 38, the identify mode output lead 371IDM of the identify-collate mode control circuit 358 applies a high potential to each of the memories 353SM and GM to place its registers in the shift-right mode. Then, as each of the cable wires 31 is grounded and the binary encoder 352 presents the binary coded number WN of the wire on the leads 387L0–L4, operation of the NOR clocking gates 397S or G (FIG. 25), as above-described, causes the registers to shift right and to store the numbers of the wires in the numerical order in which they are identified. During the shift-right mode, the sixth register of each of the memories 353 becomes filled with "ones", and when 25 shifts of each memory have been completed, the "registers full" output leads 372SRF and GRF of the sixth registers both apply high potentials to the reset AND gate 373RFR in the identify-collate mode control circuit 358 (FIG. 26), as above described, to reset the identify mode circuitry 364 IDM.

Similarly, during a wire collating operation, the identify mode output lead 371IDM of the mode control circuit 358 applies a low potential to each of the memories 353GM and SM to place it in a shift-left mode, whereby the application of a low level pulse to each of the memories by its respective NOR clocking gate 397G or S (FIG. 25) causes the wire numbers WN to be fed out of the memories to the collate control circuits 356GC and SC (FIG. 29) in reverse order (i.e., last in first out) on output leads 399GL0–L4 and 399SL0–L4. After 25 shifts of each of the memories 353 to the left, its registers will again be empty and the "registers empty" output leads 374GRE and SRE of the sixth registers both apply a high potential to the reset AND gate 376RER (FIG. 26) in the mode control circuit 358, as above described, to reset the collate mode flip-flop 368CM through the NOR gate 367CM.

Fan-and-Identify Control Circuit — FIG. 28

Referring to FIG. 28, at the beginning of each wire identification operation, one of the peripheral notches in the feed wheel 129 at the wire fan-and-identify station 38 (FIGS. 9–13 ) is in its wire load position (FIG. 10) and contains the first wire leading end portion 31LE to be identified, and the high potential on the identify mode output lead 371IDM of the mode control circuit 358 (FIG. 26) has enabled the fan-and-identify control circuit 354. The three-pulse counting circuit 391TP then operates the stepping motor 144 through a conventional motor driver 401, which indexes the motor 15° for each pulse applied to the driver, in a known manner. This indexes the feed wheel 129 and the wire portion 31LE 45° clockwise in FIG. 12 so that the wire portion is engaged by the electrical contact wheel 136, as above described. After the wire end portion 31LE has been identified and information as to its identity has been stored in its respective memory 353SM or GM (FIG. 25), the feed wheel 129 is indexed an additional 45° in response to the three-pulse counting circuit 391TP if the wire portion is that of a signal wire 31S, or is reverse-indexed 135° in response to the nine-pulse counting circuit 392NP if the wire is that of a ground wire 31G, to discharge the wire portion into the lower or upper slots 138s-S or -G (FIG. 12), respectively.

More specifically, after the wire fan-and-identify feed wheel control circuit 354 has been enabled by the positive signal on the identify mode lead 371IDM, when a next first phase positive "identify" pulse PI-1 from a pulse generator 402 is applied to an input of an "identify-start" AND gate 403IDS, the other input of which has a high potential being impressed thereon from the output of a NOR gate 404, a high potential is provided at the output of the "identify-start" gate and applied to a clock input of a D-type flip-flop 406, causing the flip-flop to change state. This causes a first output of the flip-flop 406 to apply a high potential to an input of an AND gate 407TPI for initiating an "identify" operating phase of the three-pulse counting circuit 391TP, and having second and third inputs which are being held at a high level by the identify mode lead 371IDM and the NOR gate 404, respectively, whereby the gate 407TPI produces a high potential output signal. At this time, dual inputs of the NOR gate 404 are being held at a low level by outputs of retriggerable time delay one-shot multivibrators 408TP and 408NP in the three-pulse counting circuit 391TP and the nine-pulse counting circuit 392NP, respectively.

The high potential output signal of the "initiate identify" AND gate 407TPI is applied to an input of an OR gate 409TP, the other input of which is being held at a low level by the output of an AND gate 411TPU for initiating a wire discharge of "unload" operating phase of the three-pulse counting circuit 391TP. This produces a high potential at the output of the OR gate 409TP to trigger the three-pulse counting circuit 391TP, whereupon the counting circuit, in response to second phase positive "identify" pulses PI-2 from the clock oscillator 402, causes the wire end portion 31LE in the feed wheel 129 (FIG. 12) to be indexed by the stepping motor 144 to the electrical contact wheel 136 (FIG. 12). After a suitable time delay (e.g., 20 milliseconds), which is provided by the output of the one-shot multivibrator 408TP remaining at a low potential, to permit the identification of the wire portion 31LE to take place, the output of the multivibrator produces a high potential output signal, which is impressed on an input of a reset NAND gate 412TPR. The output of the reset gate 412TPR is connected to an input of a reset NOR gate 413TPR having a second input being held high by the identify mode lead 371IDM. The next second phase positive pulse PI-2 from the clock oscillator 402 then causes the reset gate 412TPR to produce a low potential signal, whereby the output of the NOR gate 413TPR changes to a high level to reset the D-type flip-flop 406. This causes a second output of the flip-flop 406 to trigger a one-shot multivibrator 414 which feeds a high potential output pulse to the memory select circuit 357 (FIG. 25) via the output lead 396, to activate the AND gate 393S or 393G, depending upon which gate has been conditioned for operation by the group select lead 381GS of the diode matrix binary encoder 352, to clock the wire number WN into the associated memory 353SM or 353GM, as above described.

The wire fan-and-identify control circuit 354 next causes the stepping motor 144 to index the feed wheel 129 (FIG. 12) to its lower or upper wire unload position, as above described, depending on whether the leading wire is a signal (lower) wire 31S or a ground (upper) wire 31G. For this purpose, the group select lead 381GS of the diode matrix binary encoder 352 (FIGS. 25 and 27) is connected to an input of the "unload" gate 411TPU through an inverting gate 416TPU, and to an input of a four input AND gate 417NPU for initiating an "unload" phase of operation by the nine-pulse counting circuit 392NP. The other inputs of the "unload" gate 411TPU are connected to the output of the one-shot multivibrator 414, the second output of the flip-flop 406, and the identify mode lead 371IDM, respectively.

If the first wire leading end portion 31LE is that of a signal wire 31S (i.e., a leading end portion 31LES), whereby the group select lead 381GS is at a low potential, the inverted high potential signal on the input of the "unload" gate 411TPU causes its output to change to a high level and the output of the OR gate 409TP produces a high level output signal. This retriggers the three-pulse counting circuit 391TP and causes the stepping motor 144 to index the feed wheel 129 another 45° clockwise in FIG. 12, to move the wire portion 31LES to the lower unload position where it is discharged into the wire-receiving slot 138s-S. This indexing of the feed wheel 129 also causes one of its empty peripheral notches **129*n* to move into the wire load position where it receives the next wire leading end portion 31LE** to be identified.

If the first wire leading end portion 31LE is that of a ground wire 31G (i.e., a leading end portion 31LEG), whereby the group select lead 381GS is at a high potential, application of this high potential to the "unload" gate 417NPU causes its output to change to a high potential to trigger the nine-pulse counting circuit 392NP. This causes the stepping motor 144 to index the feed wheel 129 and the wire portion 31LEG in the feed wheel notch **129*n* counterclockwise in FIG. 12 past the wire load position (the notch does not pick up another wire because it already contains one) to the upper wire unload position, where the wire is discharged into the upper wire-receiving slot 138s-G. As in the case of the unloading of a signal wire portion 31LES as above described, this also brings one of the empty notches 129*n* in the feed wheel 129 to the wire load position where the feed wheel picks up the next wire portion 31LE** to be identified.

With more specific reference to the operation of the three-pulse counting circuit 391TP, the high potential output of the OR gate 409TP is applied to an input of an AND gate 418TP having a second input connected to the output of the one-shot multivibrator 408TP. This produces a high potential at the output of the gate 409TP to cause a D-type flip-flop 419TP to change state and apply a high potential to an input of an AND gate 421TP. The second-phase positive pulses PI-2 from the clock oscillator 402 then cause the gate 421TP to produce high potential output pulses at its output, to increment a 2-bit binary counter 422TP, trigger the one-shot multivibrator 408TP, and index the stepping motor 144 clockwise in FIG. 12. After three pulses, both outputs of the counter 422TP apply high potentials to respective inputs of a NAND gate 423TP, whereby this gate produces a low potential upon receiving the next first phase positive pulse PI-1 from the clock oscillator 402. The low potential output of the NAND gate 423TP is applied to an input of a "reset" NOR gate 424TPR, the other input of which is being held at a high potential by the identify mode lead 371IDM, whereby the latter gate resets the D-type flip-flop 419TP, thereby inhibiting operation of the AND gate 421TP and causing resetting of the counter 422TP.

The nine-pulse counting circuit 392NP operates in the same manner as the three-pulse counting circuit 391TP except that the nine-pulse counting circuit causes the motor driver 401 to index the stepping motor 144 counterclockwise in FIG. 12. For this purpose, the nine-pulse counting circuit 392NP utilizes a 4-bit counter 426NP, the outputs of which all are driven to a high potential when the counter receives the ninth positive pulse PI-2 from the clock oscillator 402, and which are connected to inputs of a NAND gate 427NP so that this gate then produces a low potential output upon receiving the next positive pulse PI-1 from the clock oscillator 402. In other respects, the nine-pulse counting circuit 392NP is essentially identical to the three-pulse counting circuit 391TP, and includes an AND "clock" gate 418NP connected to trigger a D-type flip-flop 419NP in response to a high potential signal from the "unload" AND gate 417NPU as above described, a reset NOR gate 424NPR responsive to the gate 427NP for resetting the flip-flop 419NP, and an AND gate 421NP responsive to a high potential output signal from the flip-flop 419NP and positive pulses PI-2 from the clock oscillator 402, to operate the counter 426NP, the one-shot multivibrator 408NP and the stepping motor 144.

Collate Control Circuits — FIG. 29

FIG. 29 discloses the ground wire collate control circuit 356GC for positioning the ground wire leading end portions 31LEG in their collating rack 186G (FIGS. 14–16), utilizing wire number information stored in the ground wire memory 353GM (FIG. 25), in accordance with the illustrated embodiment of the invention. Since the signal wire collate control circuit 356SC is identical in construction and function, except that it operates in conjunction with the signal wire memory 353SM (FIG. 25), rather than the ground wire memory 353GM, only the ground wire collate control circuit 356GC is shown and described in detail.

In general, after the ground wire leading end portions 31LEG at the collating station 39 (FIGS. 14–16) have been loaded into the vertical feed-in slot 172s-G with the first wire received in one of the peripheral notches 181Gn of the collating wheel 181G (FIG. 14), and the sequence control circuit 34SCC (FIG. 25) has placed the identify-collate mode control circuit 358 (FIGS. 25 and 26) in its collate mode, the high potential then appearing on the collate mode lead 371CM is applied to the ground wire collate control circuit 356GC to render it operative. The collate control circuit 356GC, in response to the wire number information in the ground wire memory 353GM (FIG. 25), then causes the stepping motor 193G (FIGS. 14–16) to index the ground wire collating rack 186G into position beneath the collating wheel 181G for receiving the first wire end portion 31LEG in its respective notch in the rack. Next, the collate control circuit 356GC energizes the stepping motor 194G (FIGS. 14–16) to rotate the collating wheel 181G 180°, to deposit the first wire in the collating rack 186G and to bring the second peripheral notch 181Gn of the wheel up into position to receive the next wire in the vertical slot 172s-G. The collating process then is repeated until all of the ground wires 31LEG have been positioned in the rack 186G.

The ground wire collate control circuit 356GC includes a collate rack positioning circuit 441GCR which comprises a binary up-down counter 442GCR having at least 5 output leads 443GCR (e.g., two 4-bit binary counters arranged as shown in FIG. 29), and a 5-bit binary comparator 444GCR. In the usual case, the wire number WN of one of the ground wire end portions 31LEG in the slot 172s-G, as represented by the potentials on the output leads 399G of the ground wire memory 353GM (FIG. 25) and being applied to first inputs of the binary comparator 444GCR, will not correspond with the notch number NN of the rack 186G (FIGS. 14–16) then in the rack loading position. (In the illustrated embodiment of the invention, this will be a "zero reference" position for the first wire end portion LEG in the slot 172s-G as is subsequently described herein). Thus, the binary number on the leads 399G differs from a binary number representative of the rack position and being presented by the binary counter 442GCR at second inputs of the comparator 444GCR on the leads 443GCR, and the comparator develops a low potential on an output lead labeled WN = NN. This low potential is inverted by a gate 446GCR and applied to an input of an AND gate 447GCR having a second input being held at a high potential by the collate mode lead 371CM and a third input being held at a high potential by the "registers empty" lead 374GRE of the ground wire memory 353GM, respectively. The gate 447GCR then develops a high output potential to trigger an astable multivibrator 448GCR which applies high level output pulses to inputs of a pair of AND gates 449GCR-R and 449GCR-L for controlling the driving of the rack 186G right or left (FIGS. 14 and 15) by the rack positioning motor 193G. Second inputs of the gates 449GCR-R and 449GCR-L are being held at a high potential by an output of a one-shot multivibrator 451GC in a 12-pulse counting circuit 452GCTP of a collate wheel control circuit 453GCW, while third inputs of the gates are connected to comparator output leads labeled WN<NN and WN>NN, respectively.

Thus, if the number of the wire end portion 31LEG then being processed is less than the rack notch number NN then in the rack loading position, the binary comparator 444GCR develops a high potential on the output lead WN<NN to cause the AND gate 449GCR-R to conduct in response to signals from the astable multivibrator 448GCR. The resultant high potential output pulses of the gate 449GCR-R actuates the rack stepping motor 193G through an associated driver 454G, to drive the collating rack 186G to the right in FIGS. 14 and 15 so as to move the lower numbered notches of the rack toward the wire loading position. Similarly, if the wire number WN is greater than the rack notch number NN, the binary comparator 444GCR develops a high potential on its output lead WN>NN to cause the AND gate 449GCR-L to conduct in response to signals from the astable multivibrator 448GCR, to cause the stepping motor 193G to drive the collating rack to the left in these figures.

During the pulsing of the gate 449GCR-R to drive the rack stepping motor 193G, a portion of each pulse is applied to an "UP" input of the binary counter 442GCR, and during the pulsing of the gate 449GCR-L, a portion of each pulse is applied to a "DOWN" input of the counter. Subsequently, when the collating rack 186G has been driven so as to locate the rack notch corresponding to the wire end portion 31LEG to be loaded therein, in the wire loading position, the binary comparator 444GCR produces low potentials on both of the output leads WN<NN and WN>NN, and a high potential on the lead WN = NN, to inhibit operation of the AND gates 447GCR, 449GCR-R and 449GCR-L. AT the same time, the high potential on the output lead WN = NN is applied to and enables the 12-pulse counting circuit 452GCTP, which then applies 12 pulses to a driver 456G for the stepping motor 194G to cause the stepping motor to rotate the collating wheel 181G 180° (15° per pulse) to deliver the wire end portion 31LEG into its notch in the collating rack 186G.

In general, the 12-pulse counting circuit 452GCTP functions in a manner similar to the three and nine-pulse counting circuits 391TP and 392NP in the wire fan-and-identify control circuit 354 of FIG. 28. More specifically, the high potential produced on the output lead WN = NN of the binary comparator 444GCR is applied to an input of an AND gate 457GCW, a second input of which is being held at a high potential by the "registers empty" lead 374GRE of the control shift register in the ground wire memory 353GM (FIG. 25). The gate 457GCW then produces positive-going output pulses in response to the second phase pulses C2 of the two-phase clock oscillator 359 (FIG. 25), which output pulses are applied to an input of an AND gate 458GCW having a second input being held at a high potential by the collate mode lead 371CM. The resultant high potential output of the gate 458GCW is applied to the first of two interconnected flip-flops 459GCW and 461GCW, causing the first flip-flop to change to a set state. The flip-flop 461GCW then changes state in response to the leading edge of a next positive-going pulse PGC-2 from a pulse generator 462GCW, to apply a high level signal to an input of a pulse control AND gate 463GCW. Positive pulses PGC-1 from the pulse generator 462GCW then cause high level pulses to be produced at the output of the pulse control gate 463GCW, to operate the collating wheel stepping motor 194G, and to actuate a 4-bit binary counter 464GCW. The output pulses of the gate 463GCW also operate the one-shot multivibrator 451GC to produce a negative signal which inhibits operation of the gates 449GCR-R and 449GCR-L of the collating rack positioning circuit 441GCR during the indexing of the collating wheel 181G.

The outputs of the binary counter 464GCW are connected to inputs of an AND gate 466GCW so as to produce a high potential at the output of this gate when the counter has received 12 pulses from the pulse control gate 463GCW. The high potential output of the gate 466GCW is applied to an input of a reset NOR gate 467GCWR having a second input being held at a high level by the collate mode lead 371CM. The gate 467GCWR then applies a low output potential to a reset lead of the flip-flop 459GCW, whereby the flip-flop 461GCW changes state in response to the next pulse PGC-2 to produce a low level output signal which inhibits operation of the gate 463GCW and resets the counter 464GCW.

The outputs of the pulse control gate 463GCW and the gate 466GCW also are connected to a memory clocking AND gate 468GCM, whereby operation of the gate 466GCW in conjunction with the twelfth output pulse from the gate 463GCW also causes the memory clocking gate to conduct and to feed a high level output signal back to the ground wire memory clocking gate 397G (FIG. 25) via the lead 398G. This causes the next stored wire number WN to be read out of the memory 353GM (FIG. 25) to the binary comparator 444GCR of the collating rack positioning circuit 441GCR, which then functions as above-described to locate the collating rack 186G (FIGS. 14–16) in proper position for reception of the next wire leading end portion 31LEG.

After all of the wire end portions 31LEG have been inserted in their respective notches in the collating rack 186G, driving of the rack to the left in FIGS. 14 and 15 to discharge the collated wire portions into the discharge slot 208ds-G, and to operate the sensor switch 219G to determine if the rack has been properly indexed during the collating operation, as above described under the heading "Wire Collating Station", may be accomplished in any suitable manner. For example, the sequence control circuit 34SCC (FIG. 25), in response to the low level output signal on the "registers empty" lead 374GRE of the ground wire memory 353GM, can apply a "zero" binary number on the memory output leads 399G via leads 469G (L0–L4) to cause the stepping motor 193G to be initially driven to its "zero" reference position under the direction of the binary comparator 444GCR. After a preselected time delay, the sequence control circuit 34SCC applies the required pulses to the stepping motor 193G to advance the rack 186G to the left in FIG. 14 so that the bracket 218G thereon operates the sensor switch 219G in conjunction with suitable logic circuitry (not shown) in the sequence control circuit. Assuming that the rack 186G has been properly indexed, whereby the apparatus continues to function, the sequence control circuit 34SCC then applies "*n*" pulses to the stepping motor 193G to return the rack to the right in FIG. 14 to its zero reference position, in readiness for the next collating operation.

Alternate Embodiment-Dual Source Cable Supply

As has been described hereinabove in connection with the embodiment of the invention disclosed in FIGS. 1 through 29, on alternate first cycles of operation the wire fan-and-identify station 38 and the wire rotating station 42 are inoperative, and on second alternate operating cycles the cable desheathing station 36, the wire collating station 39 and the wire-plug connectorizing station 43 are inoperative. Accordingly, where greater production output of the apparatus is desired, an embodiment of the invention as disclosed schematically in FIGS. 31, 32 and 33, which utilizes first and second cables 32'-1 and 32'-2 on respective cable supply reels 32S'-1 and 32S'-2, may be employed.

The first cable 32'-1 is fed from its respective supply reel 32S'-1 through an upper cable length measuring device 47'-1 and an upper cable cutter mechanism 40'-1, by a set of upper cable feed rolls 46'-1. Similarly, the second cable 32'-2 is fed from its respective supply reel 32S'-2 through a lower cable length measuring device 47'-2 and a lower cable cutter mechanism 40'-2, by a lower set of cable feed rolls 46'-2. As is bestsshown in FIGS. 31 and 32, each of the cables 32'-1 and 32'-2 feed from their respective cutter mechanisms 40'-1 and 40'-2, into respective upper and lower rectangularly shaped guideways **52*a*'-1 and 52*a*'-2. Adjacent its left-hand end as viewed in FIG. 31, each of the upper and lower guideways 52*a*'-1 and 52*a*'-2 communicates with a respective branch of a horizontally disposed essentially Y-shaped guideway 471*a* suitably mounted adjacent one side of a main conveyor 37' and in alignment with a second rectangular-shaped guideway 471*b* suitably mounted on the opposite side of the conveyor adjacent a cable desheathing station 36'**.

On alternate first cycles of operation, the first cable 32'-1 is initially fed by its feed rolls 46'-1 through the upper guideway **52*a*'-1, the Y-shaped guideway 471*a*, an aligned set of clamping jaws 49' on a carrier 48' of the main conveyor 37', the guideway 471*b*, and into the cable desheathing station 36'. The first cable 32'-1 then is clamped by the clamping jaws 49', by release of an air cylinder 51', and a leading end portion of the cable is desheathed in the cable desheathing station 36', as described hereinabove in the embodiment of the invention disclosed in FIGS. 1 through 29**.

As soon as the first cable 32'-1 has been clamped by the conveyor clamping jaws 49', a vertical sidewall member **52*s*'-1 of the upper cable guideway 52*a*'-1, which is mounted for vertical sliding movement in a suitable manner (not shown), is moved from a closed position as shown in FIG. 32A, to an upper open position as shown in FIG. 32B, by air cylinders 53'-1 mounted on an upper wall of the guideway. At the same time a vertically slidable member 471*s*, which defines sidewalls of the Y-shaped guideway 471*a* and the guideway 471*b*, is similarly moved from a lower closed position (solid lines in FIG. 31) to an upper open position (dashed lines in FIG. 31) by air cylinders 472 mounted on upper walls of these guideways. This opening of the sidewall members 52*s*'-1 and 471*s* permits the portion of the first cable 32'-1 between the conveyor clamping jaws 49' and the cable cutter mechanism 40'-1 to loop horizontally out of the upper guideway 52*a*'-1, as illustrated in FIG. 32B, as the cable continues to be fed by the feed rolls 46'-1 during the desheathing of the cable, and to drop onto an auxiliary cable length conveyor 44'**, in a manner as described hereinabove in connection with the embodiment of the invention in FIGS. 1 through 29. The upper cable feed rolls 46'-1 then continue to operate until the desired length of the cable 32'-1 has been fed, as measured by the upper cable length measuring device 47'-1.

After a leading end portion of the first cable 32'-1 has been desheathed, the main conveyor 37' indexes the cable out of the desheathing station 36' and into a wire fan-and-identify station 38' (FIG. 33) as described in the embodiment of the invention in FIGS. 1 through 29. Similarly, after the fanning and identifying of the wires of the cable 32'-1 has been completed in the wire fan-and-identify station 38' (and after the desired length of the cable has been fed by the cable feed rolls 46'-1), the cable is cut to length by the cutter mechanism 40'-1 and the resultant cable length drops onto the auxiliary conveyor 44' for subsequent transfer through the apparatus. At this time, the guideway sidewall member 52s'-1 is returned to its lower closed position by the air cylinders 53'-1 in preparation for the next feeding of the first cable 32'-1.

As soon as the above-mentioned indexing of the main conveyor 37' has been completed, the guideway sidewall member 471s is returned to its lower closed position by the air cylinders 472. Then, while the first cable 32'-1 is being processed in the wire fan-and-identify station 38', the second cable 32'-2 is fed by its lower feed rolls 46'-2 through the lower guideway 52a'-2, the Y-shaped guideway 471a, the next empty set of conveyor clamping jaws 49', the guideway member 471b, and into the cable desheathing station 36', where it is desheathed. As in the case of the first cable 32'-1, after the second cable 32'-2 has been clamped by the jaws 49', the sidewall defining member 471s is again moved to its upper open position by the air cylinders 472, and a slidably mounted sidewall member 52s'-2 of the lower guideway 52a'-2 is moved vertically downward to a lower open position by associated air cylinders 53'-2 mounted on a lower wall of the guideway. The cable 32'-2, between the clamping jaws 49' and the lower cable cutter mechanism 40'-2, then loops laterally out of the lower guideway 52a'-2 and the Y-shaped guideway 471a onto the auxiliary conveyor 44', as the cable continues to be fed by the lower cable feed rolls 46'-2.

After a leading end portion of the second cable 32'-2 has been desheathed and the wires of the first cable 32'-1 have been identified and cut to length, the main conveyor 37' indexes to move the length of the cable 32'-1 from the wire fan-and-identify station 38' into a wire collating station 39' (FIG. 33), and to move the cable 32'-2 from the cable desheathing station 36' into the wire fan-and-identify station 38'. At this time, the guideway sidewall member 471s is again closed, and the first cable 32'-1 is again fed to the desheathing station 36'. Subsequently, after fanning and identifying of the wires of the cable 32'-2 has been completed in the wire fan-and-identify station 38' (and after the desired length of cable has been fed by the feed rolls 46'-2), the cable cutter mechanism 40'-2 operates to cut the cable to length. The sidewall member 52s'-2 then is returned to its closed position in preparation for the next feeding of the second cable 32'-2, following the next indexing of the main conveyor 37'.

FIG. 33 is a schematic representation of a modified controller 34' suitable for use with the dual source cable supply system disclosed in FIGS. 31 and 32. The controller 34' includes first and second wire fan-and-identify and collate control circuits 34'-1 and 34'-2 for the cables 32'-1 and 32'-2, respectively, in association with a sequence control circuit 34SCC' for controlling the operation of the various mechanisms of the apparatus in the proper sequence as herein described. The control circuits 34'-1 and 34'-2 may be essentially identical to those of the controller 34 disclosed in FIGS. 25 through 29, as represented by the diode matrix binary encoder 352, the memories 353, the wire fan-and-identify feed wheel control circuit 354, the collate control circuits 356 and the identify-collate mode control circuit 358. It is also considered to be within the purview of the invention to utilize a controller in which the same wire fan-and-identify feed wheel control circuit (i.e., 354) and the same wire collate control circuits (i.e., 356), with suitable interfacing circuitry, are utilized for processing both of the cables 32'-1 and 32'-2, or to utilize a suitably programmed computer, such as a microprocessor, for processing both of the cables, as noted herein with reference to the single cable supply source embodiment of the invention of FIGS. 1 through 29.

From the foregoing description, it is apparent that in the dual source cable supply system shown in FIGS. 31, 32 and 33, the cable desheathing station 36', the wire fan-and-identify station 38' and the collating station 39', as well as an associated wire rotating station 42' (FIG. 33) and a wire-plug connectorizing station 43' (FIG. 33) each process one or the other of the cables 32'-1 and 32'-2 on each cycle of operation, whereby the production output of the apparatus can be essentially doubled, if so desired.

Summary

A new and improved method and apparatus for arranging randomly positioned articles, such as the cable wires 31, into preselected positions, has been disclosed. More specifically, a new and improved method and apparatus (FIG. 1) for manufacturing cable length-connector plug assemblies 32L-33 (FIG. 30) has been provided wherein successive leading end portions of a cable 32 on a supply reel 32S initially are rapidly desheathed (FIGS. 2–8) in the cable desheathing station 36. The desheathing operation is accomplished utilizing radiant heat without contacting the cable jacket 32J, in a manner which precludes damage to the insulated wires 31 of the cable, and which produces a smooth edge of separation 32JE on the jacket remaining on the cable.

The desheathed wire leading end portions 31LE, which are in random unknown positions, then are rapidly pressed or "ironed" from a twisted pair bundle configuration into an untwisted common plane configuration, and sorted into ground wire and signal wire subgroups 31LEG and 31LES, in the wire fan-and-identify station 38 (FIGS. 9–13). In a station 38, the wire end portions 31LE also are identified by completing an electrical circuit through each of the wires 31 to a respective matrix cross-point 383 (FIG. 27) of the binary encoder 352 and the numbers of the wire portions are stored in the order in which the wires are identified, in the ground and signal wire memories 353GM and 353SM (FIG. 25). The cable 32 then is cut to produce the cable length 32L (FIG. 1) by the cable cutting mechanism 40, under the control of the cable length measuring device 47.

The ground and signal wire leading end portions 31LEG and 31LES of the cable length 32L then are arranged in their respective subgroups in proper order for connection to their respective terminals 33TG and 33TS of the cable connector plug 33 in the wire collating station 39 (FIGS. 14–16), utilizing the wire number information which was previously stored in the memories 353GM and 353SM. Subsequently, each subgroup of the collated wire end portions 31LEG and 31LES is rotated 180° in the wire rotating station 42 (FIGS. 17 and 18) to remove the twist inherently placed in the subgroups at the preceding wire fan-and-identify station 38 and the collating station 39. The collated wire end portions 31LEG and 31LES then are cut to length and inserted into their respective terminals 33TG and 33TS of the cable connector plug 33 in the wire-plug connectorizing station 43 (FIGS. 19–22), to produce a finished cable length-connector plug assembly 32L-33. Transfer of the wire leading end portions 31LEG and 31LES between the stations 38, 39, 42 and 43 is accomplished automatically in an expeditious manner by the shuttle transfer mechanisms 41G and 41S (41G being shown in detail in FIGS. 23 and 24), with processing of the cable 32 and the wires as described herein being accomplished rapidly and efficiently under the direction of the controller 34 (FIGS. 25–29). Similarly, where cable plugs 33 are desired on both ends of the cable length 32L, the second plug can readily be provided on its respective end by connecting the first mounted plug to the controller 34 and then processing the second end of the cable substantially as described herein.

What is claimed is:

1. A method of arranging portions of electrical conductor wires which are initially in random positions into preselected positions on a wire-receiving member, which comprises:

connecting trailing portions of the wires to electrical reference points, representative of respective ones of the positions on the wire-receiving member, in a preselected numerical order which corresponds to a preselected numerical order of the positions on the wire-receiving member;

sequentially completing electrical circuits through the wires to the reference points from adjacent the randomly positioned wire portions, to identify the wire portions;

sequentially arranging each wire portion in an identified reference position within at least one randomly disposed, linear array, of wire portions on the wire-receiving member;

causing relative movement between the wire-receiving member and each identified wire portion of the linear array thereof in the reference position to locate the preselected position for the wire portion on the wire-receiving member adjacent the reference position, said relative movement, with the exception of the first-identified wire portion, being an amount representative of the difference between the numerical position of each wire portion while in the reference position and the preselected numerical position of the wire portion previously identified with an electrical reference point, and feeding each identifed wire portion in an automated manner out of the reference position into its preselected position on the wire-receiving member after the preselected position has been located adjacent the reference position.

2. A method of arranging portions of electrical conductor wires which are initially in random positions, into preselected positions in at least two subgroups so as to facilitate the respective positioning thereof in preselected positions on a wire-receiving member, which comprises:

connecting trailing portions of the wires to electrical reference points representative of respective ones of the subgroups in which the wires are to be arranged;

sequentially completing electrical circuits through the wires to the reference points from adjacent the randomly positioned wire portions, to identify the subgroup in which each randomly positioned wire portion is to be located;

sequentially arranging the wire portions first into random reference positions within the particular subgroup with which each wire has been previously identifiably associated, and secondly, into their preselected reference positions within their respective subgroups;

causing relative movement between the wire-receiving member and each identified wire portion while the latter is in its preselected reference position of the associated subgroup, to locate the corresponding preselected position for each wire portion on the wire-receiving member adjacent the associated reference position, and feeding each identified wire portion out of the preselected reference position in each subgroup into its preselected position on the wire-receiving member.

3. A method of arranging leading end portions of electrical conductor wires which are in random positions, into preselected positions, which comprises:

connecting trailing portions of the wires to an electrical reference;

feeding the wire leading end portions from a continuous supply;

sequentially completing electrical circuits through the wires to the electrical reference from adjacent the wire leading end portions, to identify the wire leading end portions;

cutting the wires to length between their leading end portions and the continuous supply after identifying the wire leading end portions, to produce new leading end portions on the wires;

arranging the identified randomly positioned wire leading end portions into their preselected positions; and repeating the feeding, identifying, wire cutting and arranging steps for the new wire leading end portions.

4. A method as recited in claim 3, in which the electrical conductor wires are the first of first and second separate sets of electrical conductor wires having leading end portions in random positions and extending from separate continuous supplies, and which further comprises:

connecting trailing portions of the second set of electrical conductor wires to an electrical reference; and performing the same feeding, identifying, wire cutting and arranging steps on the second set of electrical conductor wires as are performed on the first set of electrical conductor wires, with the identifying steps on each set of wires being performed thereon while the arranging steps are being performed on the other set of wires.

5. A method as recited in claim 3, in which: the leading end portions of the wires are fed into their preselected positions after the wires have been cut to length.

6. A method of arranging randomly positioned portions of electrical conductor wires which are enclosed in a plastic sheath, into preselected positions, which comprises:

connecting trailing portions of the wires to an electrical reference;

softening a portion of the plastic sheath by radiant heat without contacting the sheath;

applying tension to the plastic sheath to separate the sheath along the softened portion and to expose the randomly positioned portions of the wires;

sequentially completing electrical circuits through the wires to the electrical reference from adjacent the exposed randomly positioned wire portions, to identify the wire portions; and arranging the identified randomly positioned wire portions into their preselected positions.

7. A method as recited in claim 6, which further comprises:

terminating the application of radiant heat to the sheath after separating the sheath so as to preclude heat damage to the wires.

8. A method as recited in claim 6, in which the randomly positioned wire portions are leading end portions, and in which a circumferential portion of the sheath is softened by radiant heat and the sheath is separated along the circumferential portion, with a leading end portion of the sheath then being removed from the wires to expose the randomly positioned wire leading end portions.

9. A method as recited in claim 8, in which the electrical conductor wires are the first of first and second separate sets of electrical conductor wires enclosed in respective plastic sheaths and extending from separate continuous supplies, and which further comprises:

connecting trailing portions of the second set of electrical conductor wires to an electrical reference;

repetitively performing the sheath softening, separating and removal steps on successive leading end portions of each of the sets of electrical conductor wires;

repetitively performing the identifying and arranging steps on the successive leading end portions of each of the sets of electrical conductor wires, with the identifying steps being performed on the successive leading end portions of each set of wires simultaneously with the performing of the sheath softening, separating and removal steps and the arranging steps on different successive leading end portions of the other set of wires; and repetitively cutting each of the sets of electrical conductor wires and their plastic sheath between their wire leading end portions and their respective continuous supply after the wire leading end portions have been identified, to produce a new set of the successive wire leading end portions enclosed in the plastic sheath.

10. A method of arranging randomly positioned leading end portions of electrical conductor wires which are in a bundle configuration into preselected wiring positions in at least two subgroups, which comprises:

connecting trailing portions of the wires in each subgroup to respective points in an electrical reference, which points are representative of respective ones of the preselected positions for the wire leading end portions in the subgroup and also are representative of the subgroup;

progressively exerting opposed pressure forces to opposite successive portions of the wire leading end portions in a direction extending from points spaced from free ends of the wires toward the free ends, to move the wire leading end portions from the bundle configuration into a common plane configuration;

sequentially completing electrical circuits through the wires to the electrical reference from adjacent the randomly positioned wire-leading end portions after they have been moved into the common plane configuration, to identify the wire leading end portions;

moving the leading end portions of the wires out of the common plane configuration sequentially and electrically contacting them in the same sequence, thereby completing electrical circuits through the wires to identify each wire leading end portion and the subgroup in which the wire leading end portion is to be located;

sorting the identified leading end portions of the wires into their respective subgroups in random position; and arranging the identified randomly positioned leading end portions of the wires in each subgroup into their preselected positions in the subgroup.

11. A method of connecting leading end portions of a bundle of randomly positioned conductor wires which are intertwisted at least in pairs and enclosed in a plastic sheath, to respective electrical terminals which are arranged in at least two subgroups in a preselected numerical order in each subgroup, which comprises:

connecting trailing ends of the wires in each subgroup to electrical reference points in the preselected numerical order of the terminals for that subgroup, with the leading end portions in insulated relationship to produce a plurality of normally open electrical circuits which are representative of respective ones of the wire leading end portions and of the subgroups;

feeding the sheathed leading end portions of the wires from a continuous supply;

softening a narrow circumferential portion of the plastic sheath adjacent a leading end of the sheath by radiant heat without contacting the sheath;

applying tension to the plastic sheath to separate the sheath along the softened circumferential portion and to remove the leading end portion of the sheath from the leading end portions of the wires;

terminating the application of radiant heat to the sheath after separating the leading end portion of the sheath from the remainder of the sheath so as to preclude heat damage to the wires;

progressively exerting opposed pressure forces to opposite successive portions of the leading end portions of the bundle of intertwisted wires in a direction extending from points spaced from free ends of the wires toward the free ends, to cause the wires to move from the intertwisted bundle configuration into a common plane untwisted configuration;

moving the untwisted leading end portions of the wires out of the common plane configuration sequentially and electrically contacting the wire leading end portions in the same sequence, thereby sequentially closing the electrical circuits through the wires to the electrical reference points to identify each wire leading end portion and the subgroup in which the wire leading end portion is to be located;

sequentially sorting the leading end portions of the wires into their respective subgroups in random positions;

storing data information representative of each sorted wire leading end portion and the sequential position of the wire leading end portion in its respective subgroup as the wire leading end portions and their respective subgroups are being identified;

arranging the sorted wire leading end portions in each subgroup into the same numerical order as the terminals, utilizing the stored data information;

connecting the arranged leading end portions of the wires to their respective terminals; and cutting the sheathed wires to length between their leading end portions and the continuous supply after the data information has been stored, to produce new leading end portions on the wires.

12. Apparatus for arranging portions of electrical conductor wires which are in random positions, into preselected positions, which comprises:

means for identifying the randomly positioned portions of the wires, and their relative positions;

means for connecting trailing portions of the wires to said identifying means;

means for energizing said identifying means by electrically contacting the wires in sequence adjacent the randomly positioned wire portions to complete electrical circuits through the trailing portions of the wires to said identifying means in sequence;

means connected to and responsive to said identifying means for arranging the randomly positioned wire portions into their preselected positions;

means for connecting the arranged wire portions to respective electrical terminals, and means for automatically transferring the wire portions between said wire portion electrical contacting means, said wire portion arranging means, and said wire portion connecting means.

13. Apparatus as recited in claim 12, in which said wire portion connecting means includes:

means for receiving the arranged wired portions in their preselected positions; and means for separating each of the arranged wire portions in said wire portion receiving means from the remaining wire portions in sequence and transferring the wire portion to a wire-terminal connecting position spaced from said receiving means.

14. Apparatus as recited in claim 13, in which said separating and transferring means includes:

a rotatable member having at least one peripheral notch for receiving the arranged wire portions one at a time from said wire portion receiving means;

a cylindrical mandrel mounted adjacent said notched rotatable member for rotation therewith;

means for biasing the arranged wire portions from said wire portion receiving means into the notch in said rotatable member;

means for rotating said notched rotatable member and said mandrel to partially wrap a wire portion which is in the notch in said rotatable member about said mandrel and thereby to transfer the wire portion to the wire-terminal connecting position; and means spaced from said notched rotatable member and said mandrel for engaging each wire portion as the wire portion is rotated by said notched rotatable member, said mandrel and said engaging means cooperating to guide the wire portion into the wire-terminal connecting position.

15. Apparatus as recited in claim 12, in which:

said wire portion identifying means includes means for storing data representative of each randomly positioned wire portion and the sequence in which the leading wire portion was identified by said identifying means.

16. Apparatus as recited in claim 12, in which the randomly positioned wire portions are leading end portions, and which further comprises:

means for feeding the leading end portions of the wires from a continuous supply; and means for cutting the wires to length between their leading end portions and the continuous supply after the wire portions have been identified by said identifying means, to produce new leading end portions on the wires.

17. Apparatus as recited in claim 16, in which the electrical conductor wires are the first of first and second separate sets of electrical conductor wires extending from separate continuous supplies, in which said identifying means also is energized to identify the randomly positioned portions of the second set of wires by said electrical contacting means completing electrical circuits through trailing portions of the wires in sequence, and which further comprises:

second feed means separate from said first-mentioned feed means, for feeding the leading end portions of the second set of wires from their respective continuous supply;

second wire cutting means separate from said first-mentioned wire cutting means, for cutting the second set of wires to length between their leading end portions and their respective continuous supply after the wire portions have been identified by said identifying means, to produce new leading end portions on the second set of wires; and transfer means for alternately transferring wire leading end portions of the first and second sets of wires between said wire portion electrical contacting means and said wire portion arranging means, said first and second feed means alternately feeding the leading end portions of the first and second sets of wires, respectively, from their respective continuous supplies to said transfer means.

18. Apparatus as recited in claim 17, in which the first and second sets of wires are enclosed in respective sheaths, and which further comprises:

desheathing means for removing leading end portions of the sheaths from the first and second sets of wires, said first and second feed means alternately feeding the leading end portions of the first and second sets of wires, respectively, from their respective continuous supplies to said desheathing means simultaneously with the feeding of the leading end portions to said transfer means, and said transfer means alternately feeding the desheathed leading end portions of the first and second sets of wires from said desheathing means to said electrical contacting means.

19. Apparatus as recited in claim 12, wherein the wires are enclosed in a plastic jacket, which further comprises:

means for automatically separating a portion of the jacket to expose the wires for contact by said electrical contacting means.

20. Apparatus as recited in claim 19, in which said jacket separating means includes:

a heat source for softening a portion of the plastic jacket without contacting the jacket; and means for applying tension to the jacket on opposite sides of the heat softened portion to separate the jacket along the softened portion and thereby expose the wires for contact by said electrical contacting means.

21. Apparatus as recited in claim 12, wherein the wires are enclosed in a plastic jacket and the randomly positioned wire portions are leading end portions, which further comprises:

an annular heat source of greater diameter than the sheath;

means for causing relative movement between said annular heat source and a leading end portion of the jacket to cause the leading end portion of the jacket to be received axially within the annular heat sorce to cause softening of an annular portion of the plastic jacket; and means for applying tension to the jacket to separate the jacket along the softened annular portion and to remove the leading end portion of the jacket from the leading end portions of the wires.

22. Apparatus as recited in claim 21, which further comprises:

means for terminating the application of heat to the wires after the leading end portion of the jacket has been separated from the remainder of the jacket, to preclude heat damage to the wires.

23. Apparatus as recited in claim 12, in which the randomly positioned wire portions are leading end portions which initially are in a bundle configuration, and which further comprises:

means for moving the wire leading end portions from the bundle configuration into a common plane configuration.

24. Apparatus as recited in claim 23, in which said moving means includes:

opposed first and second means for progressively applying opposed pressure forces to opposite successive portions of the bundle of wire leading end portions in a direction extending from points spaced from free ends of the wires toward the free ends, to move the wire leading end portions from the bundle configuration into the common plane configuration.

25. Apparatus as recited in claim 24, in which:

said first means is a flat planar surface and said second means is a reciprocably and pivotally mounted anvil member.

26. Apparatus as recited in claim 23, which further comprises:

an electrical probe forming a part of said electrical contacting means; and means for sequentially feeding the leading end portions of the wires out of their common plane configuration to cause said electrical probe to contact the wires electrically in sequence.

27. Apparatus as recited in claim 26, in which said sequential feeding means includes:

opposed members defining a slot for receiving the leading end portions of the wires in their common plane configuration;

a rotatable carrier adjacent an exit end of the slot and having at least one peripheral notch for receiving the wire leading end portions from the slot one at a time;

means for continuously biasing the leading end portions of the wires, when in the slot, toward said rotatable carrier;

means for rotating said carrier to cause the peripheral notch therein to remove the wire leading end portions from the slot in sequence and to carry each wire leading end portion into engagement with said electrical probe; and means for removing each wire leading end portion from the notch in said rotatable carrier after the leading end portion has been contacted by said electrical probe.

28. Apparatus as recited in claim 27, in which:

said electrical probe is a rotatable electrical contact wheel having a periphery with a knife edge; and said rotatable carrier is defined by a pair of opposed discs having aligned notches for receiving one of the wire leading end portions and positioned to receive the knife edge of said electrical contact wheel therebetween.

29. Apparatus as recited in claim 12, wherein the randomly positioned wire portions are to be arranged in preselected positions in at least two subgroups, which further comprises:

means for identifying the subgroup in which each of the randomly positioned wire portions is to be located, said means including said electrical contacting means.

30. Apparatus as recited in claim 29, which further comprises:

means responsive to said subgroup identifying means for sorting the randomly positioned wire portions into their respective subgroups.

31. Apparatus as recited in claim 30, in which:

said wire portion arranging means arranges the sorted wire portions in each subgroup into their preselected positions; and which further comprises:

wire connecting means for connecting the arranged wire portions to respective terminals on opposite sides of an electrical device.

32. Apparatus as recited in claim 31, in which:

said wire connecting means connects at least one wire portion in each subgroup to their respective terminals on the opposite sides of the electrical device simultaneously.

33. Apparatus as recited in claim 32, which further comprises:

means for automatically transferring the wire portions between said wire portion electrical contacting means, said wire portion arranging means and said wire portion connecting means.

34. Apparatus as recited in claim 30, in which said wire portion arranging means includes:

first and second magazines for receiving respective ones of the subgroups of the wire portions from said sorting means;

a rotatable transfer device adjacent the exit end of each of said magazines and having at least one peripheral notch for receiving and removing the wire portions from said magazine one at a time;

means for biasing the wire portions from said magazines into the notches in said transfer devices;

a plurality of movable racks, one for each subgroup of the wire portions and each having a series of slots for receiving respective ones of the wire portions;

means for removing a wire portion from the peripheral notch of each of said rotatable transfer devices and inserting the wire portion in a respective slot of its associated rack as said rotatable transfer device rotates with the wire portion in the peripheral notch; and separate means for rotating said transfer devices and moving said racks in response to signals from said wire portion identifying means to remove the wire portions from said magazines and to transfer the wire portions into the slots in said racks in their preselected wiring positions.

35. Apparatus for arranging articles from random positions into preselected positions, which comprises:

means for holding the articles in a random but sequential order and in a linear array along a first reference plane;

means for receiving all of the articles from said holding means in their preselected positions and in a linear array along a second reference plane oriented at a predetermined angle from the first reference plane;

means for causing relative movement between said article holding means and said article receiving means to locate said article holding means and said article receiving means in different relative positions for the sequential transfer of respective ones of the articles from said article holding means to said article receiving means such that the articles are received by said article receiving means in their preselected positions;

means responsive to said moving means for sequentially transferring the articles from said article holding means to said article receiving means in their preselected positions as said article holding means and said article receiving means are moved into their different relative positions by said moving means, and means for sequentially transferring said articles from their preselected positions to and positioning them in respectively associated receiving assembly areas of a utilization device.

36. Apparatus for arranging articles from random positions into preselected positions, which comprises:

means for holding the articles in a random but sequential order, said article holding means including a magazine having a slot for receiving the articles in the random but sequential order;

means for receiving the articles from said holding means in their preselected positions, said article receiving means including a movable rack having a series of slots for receiving respective ones of the articles in their preselected positions;

means for causing relative movement between said article holding means and said article receiving means to locate said article holding means and said article receiving means in different relative positions for the sequential transfer of respective ones of the articles from said article holding means to said article receiving means such that the articles are received by said article receiving means in their preselected positions, and means responsive to said moving means for sequentially transferring the articles from said article holding means to said article receiving means in their preselected positions as said article holding means and said article receiving means are moved into their different relative positions by said moving means, said article transfer means including a rotatable member adjacent the exit end of the slot in said magazine and having at least one peripheral notch for receiving the articles from said magazine one at a time, means for biasing the articles from said magazine into the notch in said rotatable member, and means for moving an article from the peripheral notch of said rotatable member into a respective slot of said rack as said rotatable member rotates with the article in the peripheral notch.

37. Apparatus for arranging articles in the form of electrical conductors from random positions into preselected positions, which comprises:

means for holding the articles in a random but sequential order;

means for receiving the articles from said holding means in their preselected positions;

means for causing relative movement between said article holding means and said article receiving means to locate said article holding means and said article receiving means in different relative positions for the sequential transfer of respective ones of the articles from said article holding means to said article receiving means such that the articles are received by said article receiving means in their preselected positions;

means responsive to said moving means for sequentially transferring the articles from said article holding means to said article receiving means in their preselected positions as said article holding means and said article receiving means are moved into their different relative positions by said moving means, means for connecting the conductors to respective electrical terminals, and means for automatically transferring the conductors from said article receiving means to said connecting means.

38. Apparatus as recited in claim 36, which further comprises:

means for storing data representative of the random positions and the preselected positions of the articles, said article transferring means and said moving means being responsive to said data storing means.

39. Apparatus as recited in claim 38, in which said moving means includes:

second means for storing data representative of the relative positions of said article holding means and said article receiving means at any one time;

means for comparing the data in said first article random position storing means and said second storing means; and means responsive to said comparing means for causing the relative movement between said article holding means and said article receiving means into their different relative positions for the reception of each of the articles by said article receiving means.

40. Apparatus as recited in claim 36, in which the articles are electrical conductors, and which further comprises:

electrical circuit means for identifying the articles and the random positions of the articles.

41. Apparatus as recited in claim 38, in which the articles are electrical conductors, and which further comprises:

electrical circuit means for identifying the articles and their random positions and generating the data stored by said storing means.

42. Apparatus as recited in claim 41, in which:

said electrical circuit means includes electrical contacting means for sequentially engaging the articles at a location in spaced relationship to said article holding means and prior to the articles being received by said article receiving means, and which further comprises:

means for automatically transferring the articles from said electrical contacting means to said article holding means in the random order in which they are engaged by said electrical contacting means.

43. Apparatus as recited in claim 42, in which the electrical conductors are elongated insulated wires, and which further comprises:

means for feeding leading end portions of the wires from a continuous supply to said electrical contacting means of said electrical circuit identifying means; and means for cutting the wires to length between their leading end portions and the continuous supply after the wire portions have been identified by said electrical circuit identifying means.

44. Apparatus as recited in claim 42, in which the wires are enclosed in a plastic jacket, and which further comprises:

means for automatically separating a portion of the plastic jacket to expose the wires for contact by said electrical contacting means.

45. Apparatus as recited in claim 44, in which said jacket separating means includes:

a heat source for softening a portion of the plastic jacket without contacting the jacket; and means for applying tension to the jacket on opposite sides of the heat softened portion to separate the jacket along the softened portion and thereby expose the wires for contact by said electrical contacting means.

* * * * *